US006374077B1

(12) United States Patent
Hirai et al.

(10) Patent No.: US 6,374,077 B1
(45) Date of Patent: Apr. 16, 2002

(54) SHEET PROCESSING APPARATUS AND IMAGE FORMING APPARATUS HAVING THIS

(75) Inventors: Katsuaki Hirai, Kitasouma-gun; Masaaki Sato, Abiko; Katsuhito Kato, Toride; Koji Fukuyama, Kashiwa, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/174,424

(22) Filed: Oct. 19, 1998

(30) Foreign Application Priority Data

| | | |
|---|---|---|
| Oct. 17, 1997 | (JP) | 9-285108 |
| Dec. 27, 1997 | (JP) | 9-369095 |
| Jan. 13, 1998 | (JP) | 10-005163 |
| Jun. 22, 1998 | (JP) | 10-175206 |

(51) Int. Cl.[7] ..... G03G 15/00

(52) U.S. Cl. ..... 399/407; 270/58.07; 399/85; 399/110; 399/401

(58) Field of Search ..... 399/407, 408, 399/410, 401, 404, 405, 107, 110, 85; 270/4, 18, 37, 58.01, 58.07, 58.08, 58.12, 58.14, 58.16, 59; 271/3.02, 3.14, 226, 243, 249, 270, 279

(56) References Cited

U.S. PATENT DOCUMENTS

| | | | | | |
|---|---|---|---|---|---|
| 4,928,150 | A | * | 5/1990 | Hatta | 399/401 |
| 5,379,101 | A | * | 1/1995 | Takahashi et al. | 399/110 |
| 5,443,248 | A | * | 8/1995 | Hayashi et al. | 399/408 X |
| 5,852,765 | A | * | 12/1998 | Yamashita et al. | 399/407 |
| 5,854,965 | A | * | 12/1998 | Kasiwabara et al. | 399/401 X |
| 5,884,137 | A | * | 3/1999 | Shida et al. | 399/401 |
| 5,911,414 | A | * | 6/1999 | Kato et al. | 270/58.07 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus has an image forming section for forming images on sheets, including a sheet processing apparatus disposed to be piled up with a sheet conveying section and the image forming section in a housing of the image forming apparatus. The sheet processing apparatus aligns and binds sheets on which images are formed.

52 Claims, 66 Drawing Sheets

SHEET PROCESSING APPARATUS AND IMAGE FORMING APPARATUS HAVING THIS

BACKGROUND OF THE INVENTION

1. Field of the Invention

This invention relates to a sheet processing apparatus sorting recording sheets and making post-processing and an image forming apparatus having this sheet processing apparatus such as a photocopier and a laser beam printer (LBP), etc.

2. Description of Related Art

A sheet processing apparatus 1001, such as a sorter that performs sorting or stapling sheets or a finisher, conventionally has a frame, a housing, a controller, and so on, which are separated, as well as an automatic original document feeding apparatus 1002 or the like, from an image forming apparatus 1003, and such a sheet processing apparatus is constituted to be detachable from the image forming apparatus 1003.

Such a conventional structure, however, as the whole system, disadvantageously occupies a large installation area, because the sheet processing apparatus 1001 is attached to a side panel of the image forming apparatus 1003. Moreover, when paper jamming occurs at a sheet transfer portion located between the sheet processing apparatus 1001 and the image forming apparatus 1003, such a conventional apparatus is required to separate the sheet processing apparatus 1001 far away from the image forming apparatus 1003 to handle the paper jamming, and a space for such handling is also needed as opposing to a scheme of an office automation. Furthermore, since the sheet processing apparatus 1001 and the image forming apparatus 1003 are separated units, the conventional apparatus has increased number of parts, which invites higher costs.

SUMMARY OF THE INVENTION

It is an object of the invention to provide an image forming apparatus, including a sheet processing apparatus, made compact as a whole, installed in a smaller space, and made with reduced costs.

A representative structure of the invention to accomplish the above object is an image forming apparatus having an image forming section for forming images on sheets, characterized in incorporating a sheet processing apparatus in a housing of the image forming apparatus for performing sorting, aligning, stapling and the like of sheets on which images are formed.

For example, the image forming apparatus capable of forming images in a multiple or double-sided way on sheets is characterized in disposing the sheet processing apparatus substantially below a conveying route reintroducing the sheets on which images are formed to the image forming section.

According to such a structure, since the sheet post-processing apparatus for performing sorting, aligning, stapling and the like of sheets on which images are formed is incorporated in an image forming apparatus, and more specifically, since the image forming apparatus capable of forming images in a multiple or double-sided way on sheets is formed in disposing the sheet processing apparatus substantially below a conveying route reintroducing the sheets on which images are formed to the image forming section, the image forming apparatus can render the whole apparatus compact, the installation area small, and costs reduced.

Furthermore, the above sheet processing apparatus is characterized in including a processing tray for collecting once sheets on which images are formed, bundle conveying means for conveying a sheet bundle on the processing tray, a reference member serving as a mounting reference for front ends of sheets in a feeding direction of the sheets mounted on the processing tray, aligning means for aligning the sheets placed on the processing tray in a direction perpendicular to the sheet feeding direction, and stapling means for stapling the sheets on the processing tray.

According to the sheet processing apparatus of the invention, since the sheet post-processing apparatus for performing sorting, aligning, stapling and the like of sheets on which images are formed is incorporated in an image forming apparatus, and more specifically, since the image forming apparatus capable of forming images in a multiple or double-sided way on sheets is formed in disposing the sheet processing apparatus substantially below a conveying route reintroducing the sheets on which images are formed to the image forming section, the image forming apparatus can render the whole apparatus compact, the installation area small, and costs reduced.

Another sheet processing apparatus can have an image forming section for forming images on a sheet surface, a sheet conveying section for conveying sheets on which images are formed at the image forming section, a first sheet delivery section disposed at an end of a first conveying route branching from the sheet conveying section, a second sheet delivery section disposed at an end of a second conveying route branching from the sheet conveying section, a sheet stacking section for stacking the sheets conveyed from the first and second conveying routes, a sheet bundle containing section arranged at a location other than the sheet stacking section for containing a stacked sheet bundle, and conveying speed regulating means for setting sheet conveying speed in the second conveying route faster than sheet conveying speed on an upstream side of the second conveying route and sheet conveying speed from the sheet conveying section to the first sheet delivery section, during a mode for delivering the sheets from the second sheet delivery section onto the sheet stacking section to stack the sheets thereon until the sheet bundle is completely delivered onto the sheet bundle containing section after the sheets are delivered from the first sheet delivery section onto the sheet stacking section to stack the sheets thereon.

With such a sheet processing apparatus, the sheet conveying speed in the second conveying route is set faster than the sheet conveying speed on an upstream side of the second conveying route and the sheet conveying speed from the sheet conveying section to the first sheet delivery section, and therefore, after completion of sheet bundle containing operation, time until the sheets are delivered from the first sheet delivery section after the sheets are delivered from the second sheet delivery section is increased to enable the sheet bundle to be movable to the first sheet delivery section, thereby achieving high productivity of the apparatus itself.

As another sheet processing apparatus, this invention can have an image forming section for forming images on a sheet surface, a sheet conveying section for conveying sheets on which images are formed at the image forming section, a first sheet delivery section disposed at an end of a first conveying route branching from the sheet conveying section, a second sheet delivery section disposed at an end of a second conveying route branching from the sheet conveying section, a sheet stacking section for stacking the sheets conveyed from the first and second conveying routes, and a sheet bundle containing section for containing a sheet bundle brought and stacked at a location other than the sheet stacking section, in having a mode for delivering the sheets from the second sheet delivery section onto the sheet stacking section to stack the sheets thereon until the sheet bundle is completely delivered onto the sheet bundle containing section after the sheets are delivered from the first sheet delivery section onto the sheet stacking section to stack the sheets thereon, and the sheet processing apparatus may further include movable stopper means movable along a sheet stacking surface to regulate front ends of the sheets while the sheets from the first and second delivery sections are stacked, stationary stopper means secured to the sheet stacking surface to regulate the front ends of the sheets while the sheets from either of the first and second delivery sections are stacked, and conveying speed regulating means for setting sheet conveying speed in the second conveying route faster than sheet conveying speed on an upstream side of the second conveying route and sheet conveying speed from the sheet conveying section to the first sheet delivery section.

With such a sheet processing apparatus, in addition the above structure, the sheet processing apparatus has the movable stopper means movable along a sheet stacking surface to regulate front ends of the sheets while the sheets from the first and second delivery sections are stacked and the stationary stopper means secured to the sheet stacking surface to regulate the front ends of the sheets while the sheets from either of the first and second delivery sections are stacked, so that the obtained apparatus can be of a relatively simple structure with reduced costs but highly productive.

Another sheet processing apparatus includes sheet conveying means for conveying sheets, first sheet delivery means disposed at an end of a first conveying route branching from the sheet conveying section, second sheet delivery means disposed at an end of a second conveying route branching from the sheet conveying section, sheet stacking means for stacking sheets conveyed from the first and second conveying routes, sheet bundle processing means for processing individually sheet bundles stacked on the sheet stacking means, sheet bundle aligning means for aligning the sheet bundle stacked on the sheet stacking means, a plurality of sheet bundle conveying means capable of conveying independently the sheet bundle stacked on the sheet stacking means, and sheet bundle stacking means arranged at a location other than the sheet stacking means for stacking individual sheet bundles conveyed by the sheet bundle conveying means.

According to such a sheet processing apparatus, in a sheet processing apparatus applying a parallel stacking method to process the sheets after images are formed and in an image forming apparatus having this, it is advantageous that the apparatus can be made more compact and simpler with reduced costs where the apparatus itself adequately maintains and utilizes necessary prescribed functions and performances.

A further image forming apparatus according to the invention has an image forming apparatus main unit having an image forming section for forming images on supplied recording sheets, a sheet processing unit detachably attached below the image forming apparatus main unit, having a sheet processing section for post-processing recording sheets on which images are formed by the image forming section, a sheet feeding unit detachably attached below the sheet processing unit, having recording sheet stacking means for stacking image recording sheets to be fed to the image forming apparatus main unit, and a sheet feeding route arranged at the sheet processing unit for guiding the recording sheets from the sheet processing unit to the image forming apparatus main unit.

According to this image forming apparatus, the image forming apparatus main unit, the sheet processing unit, and the short feeding unit are separably formed, and because main parts of the apparatus are placed in respective housings of those units in consideration of various functions of respective units, the image forming apparatus can be made relatively compact as a whole, with a smaller occupied area for installation, and as a result, the invention can remarkably improve productivity of the image forming apparatus and the nature of the maintenance.

The above image forming apparatus may further have a new sheet feeding unit detachably arranged, which has recording sheet stacking means, disposed between the image forming apparatus and the image forming apparatus main unit, for stacking the recording sheets thereon to feed the sheets to the image forming apparatus main unit.

According to this image forming apparatus, because the sheet feeding route in the sheet processing unit guides the recording sheets from the sheet feeding unit to the image forming apparatus main unit, the above advantageous points would be further promoted.

Moreover, the image forming apparatus may have the image forming apparatus main unit formed with a delivery tray arranged outside the apparatus for receiving the recording sheets on which images are formed.

According to this image forming apparatus, since the image forming apparatus main unit has a delivery tray, when the apparatus performs only image formation on the recording sheets, or namely, when any post processing, which is most frequently accessed by users, is not performed, the recording sheets formed with images can be directly delivered out of the apparatus without passing each section for the post processing, and in such a situation, the apparatus can make the whole structure relatively compact while keeping its convenience when the apparatus is used, and also, the advantageous points of the image forming apparatus system would be further promoted.

Those image forming apparatus ensures expandability of the image forming apparatus to correspond to versatility of users and, for example, has excellent advantages to easily provide a product that can increase kinds and number of the sheet feed units and arbitrarily select existence or kinds of the sheet processing unit.

DETAILED DESCRIPTION OF THE PREFERRED EMBODIMENTS

Figure 1:
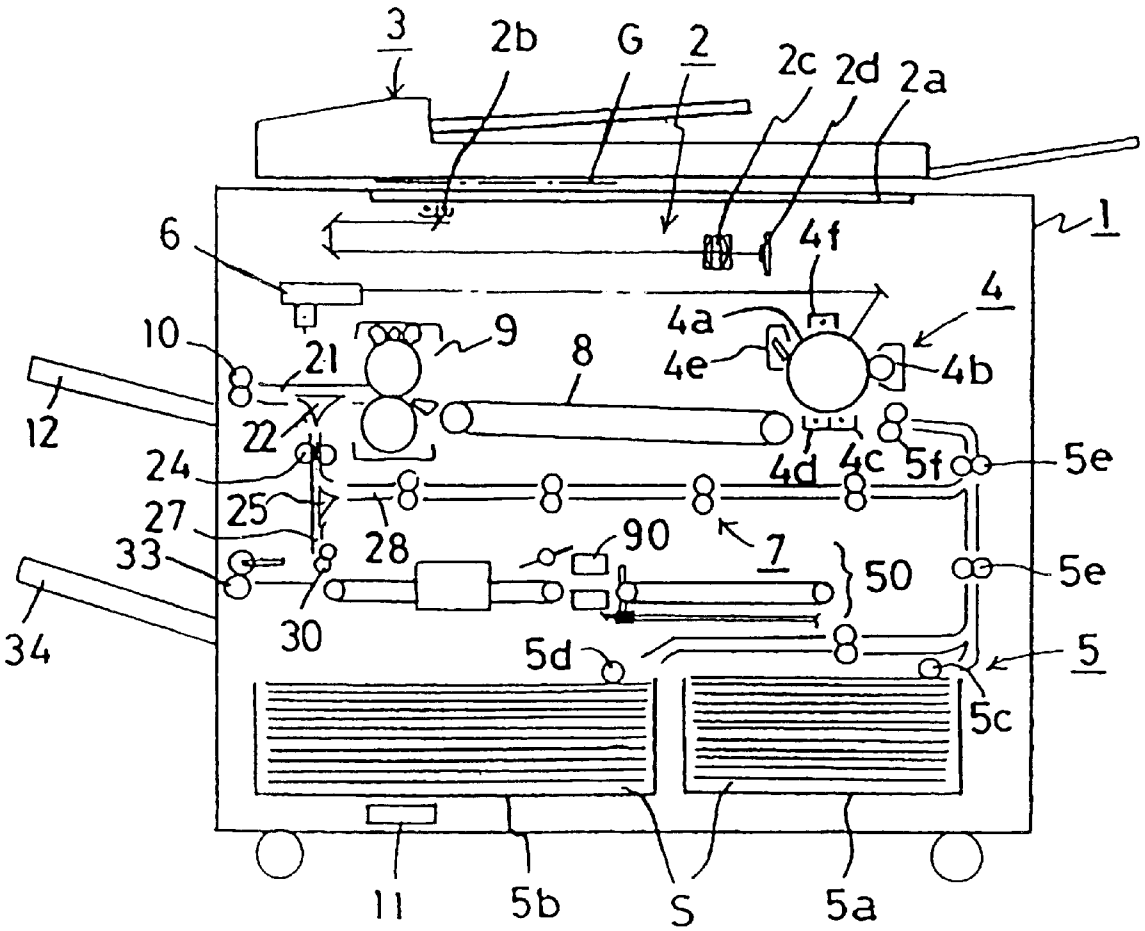
FIG. 1 is an illustrative cross section showing a schematic structure of an image forming apparatus according to a first embodiment.

Hereinafter, referring to the drawings, embodiments of image forming apparatuses to which this invention applies will be described specifically.

First Embodiment

Referring to FIGS. 1 to 7 an image forming apparatus according to the first embodiment is described in detail. FIG. 1 is an illustrative cross section showing a schematic structure of the image forming apparatus according to the first embodiment.

This image forming apparatus 1 can form images multiply on or on double sides of sheets and have a reading section 2 constituted of a platen glass 2*a* serving as a base for placing original documents, a light source 2*b*, a leng system 2*c*, a CCD sensor 2*d* and so on, an automatic original document feeding apparatus 3 for feeding original documents G to the platen glass 2*a*, an image forming section 4 for forming images on sheets S, a feeding section 5 for feeding sheets S to the image forming section 4, a laser scanner 6, a re-conveying section 7 for reintroducing the sheets formed with images to the image forming section 4, and so on.

A sheet processing unit 50 serving as a sheet processing apparatus for performing aligning, stapling, and the like of the sheets formed with images is incorporated in the image forming apparatus 1 and, more specifically, disposed substantially below the re-conveying section 7. The structure and operation of the sheet processing unit 50 will be described below.

The feeding section 5 includes decks 5*a*, 5*b* retractable in the apparatus housing 1 for containing the recording sheets S, various rollers 5*c*, 5*d*, 5*e* for feeding the sheets S in the decks 5*a*, 5*b* selectively to the image forming section 4 sheet by sheet, and so on.

The image forming section 4 is formed with a cylindrical photosensitive drum 4*a*, a developer 4*b*, a charger for transfer 4*c*, a separation charger 4*d*, a cleaner 4*e*, and a primary charger 4*f* which are arranged around the drum. A conveying apparatus 8, a fixing apparatus 9, and a delivery roller pair 10 are disposed on a downstream side of the image forming section 4.

In operation of this image forming apparatus, a sheet S is fed from the decks 5*a*, 5*b* when a control apparatus 11 formed at the apparatus 1 outputs a feeding signal. Meanwhile, light from the light source 2*b* reflected at an original document G placed on the platen glass 2*a* is radiated to the CCD sensor 2*d* by way of the lens system 2*c* and is converted into an image signal by a processor not shown. Laser light is radiated based on the image signal from the laser scanner onto the photosensitive drum 4*a*. An electrostatic latent image is formed by radiation of the laser light on the photosensitive drum 4*a* where the drum is pre-charged by the primary charger 4*f*, and subsequently, a toner image is formed by developing the electrostatic latent image by the developer 4*b*.

The sheet S fed from the feeding section 5 is corrected to go straight if going obliquely by a register roller 5*f* and is fed to an image forming apparatus at an adjusted timing. The toner image on the photosensitive drum 4*a* is transferred onto the fed sheet S by the transfer charger 4*c* in the image forming section 4. The sheet S onto which the toner image is transferred is charged to a polarity reversed to the that of the transfer charger 4*c* by means of the separation charger 4*d* and thereby separated from the photosensitive drum 4*a*.

The separated sheet S is fed by the conveying apparatus 8 to the fixing apparatus 9, which permanently fixes the transferred image on the sheet S.

Figure 2:
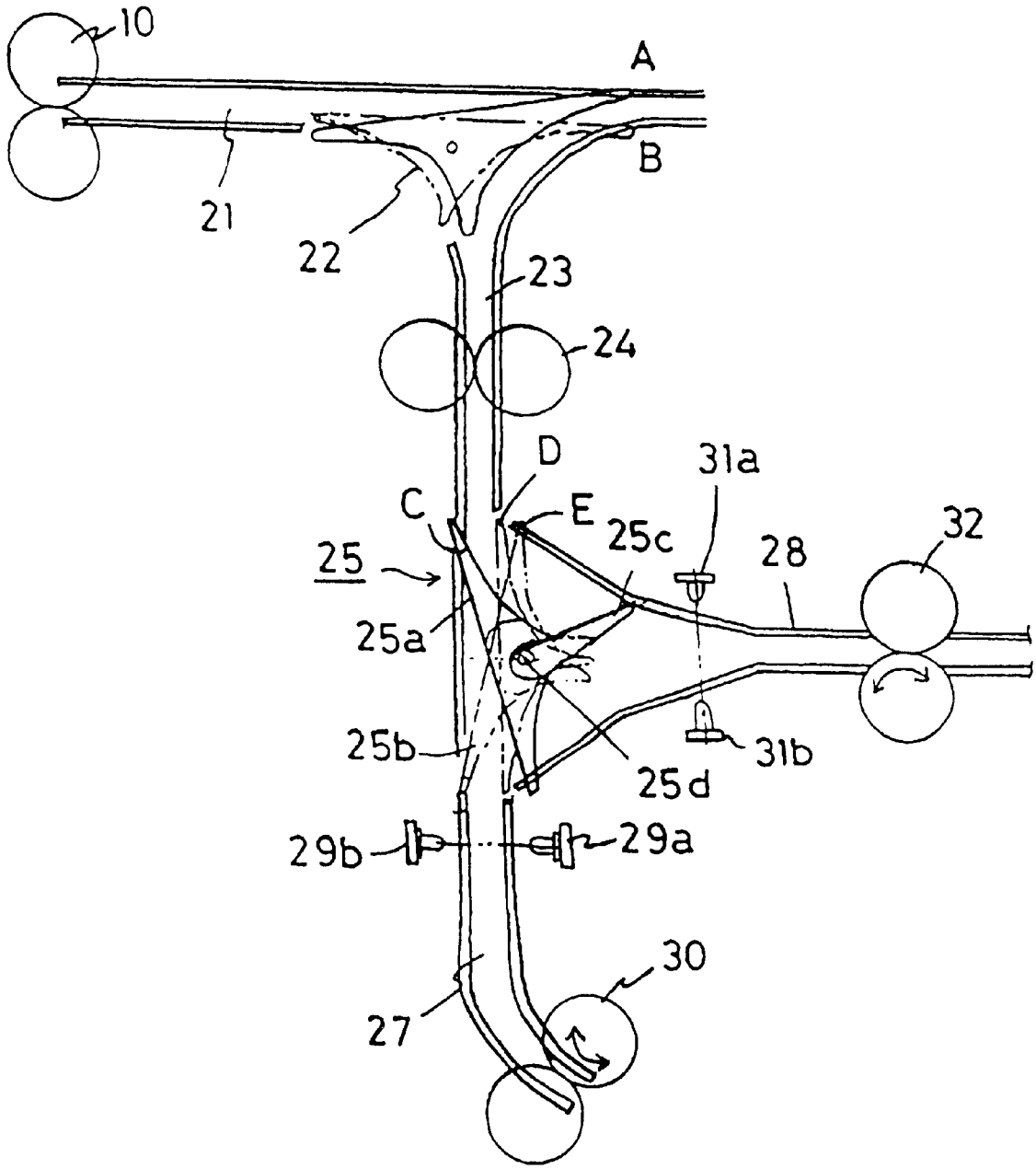
FIG. 2 is a cross section showing a path structure.

First, a mode in which sheets formed with images are not subject to any post-processing (non-finishing mode) will be described using FIGS. 1, 2.

When copying is made on only one side, the sheet to which images are fixed by means of the fixing apparatus 9 is delivered on a delivery tray 12 located outside the housing by the delivery roller pair 10 through a path 21.

When copying is made on double sides, the sheet passing by the fixing apparatus 9 is deflected toward a path 23 by a first flapper 22 that has shifted from Position B to Position A and deflected toward a path 27 by a second flapper 25 through a conveying roller 24.

Figure 3:
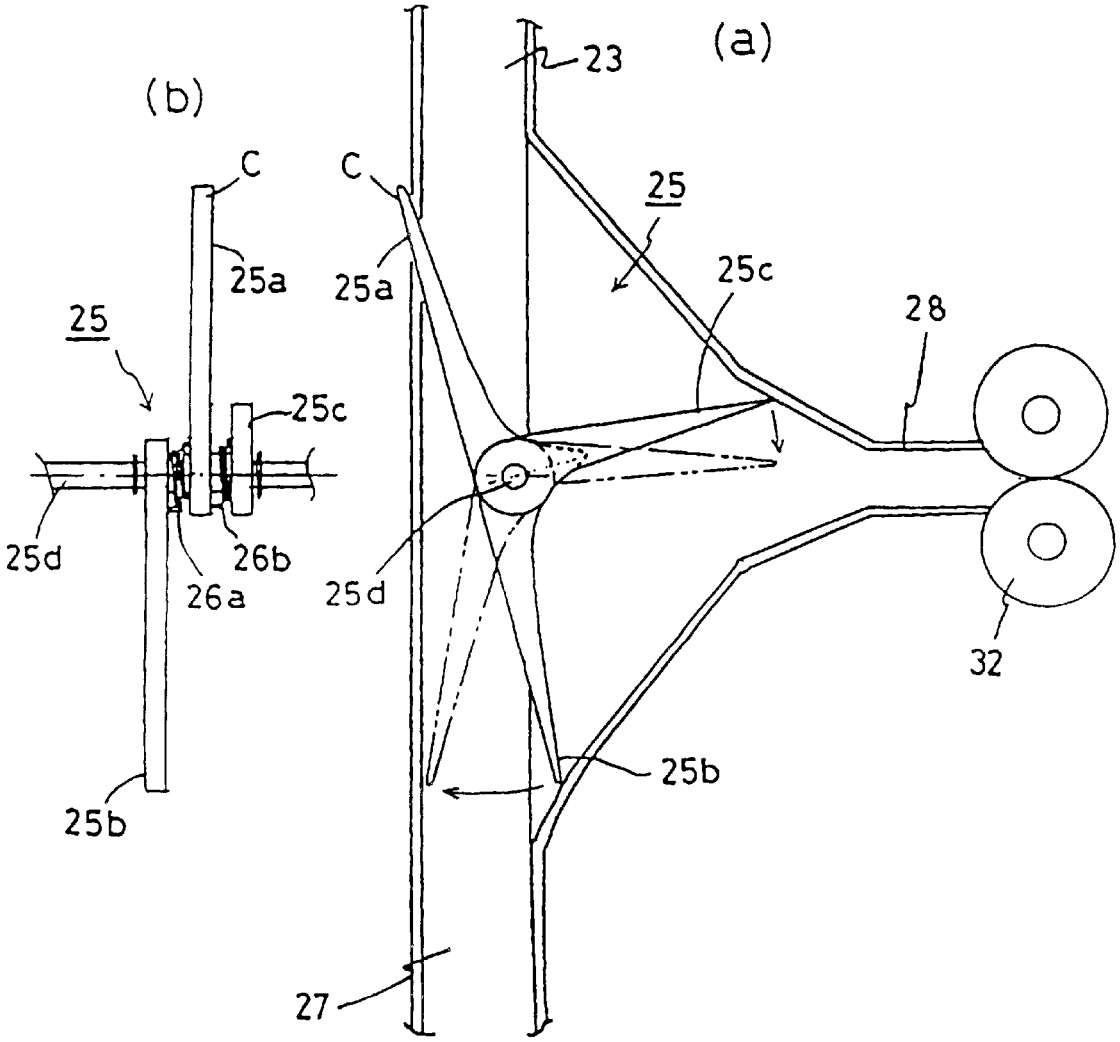
FIG. 3 is a detailed illustration showing a flapper.

The second flapper 25 is made as shown in FIG. 3 of a flapper 25*a* for deflecting sheets from the path 23 to the path 27 or a buffer path 28, a flapper 25*c* for deflecting sheets carried from the buffer path 28 toward the path 27, and a flapper 25*b* for deflecting sheets carried from the path 27 to the path 23 or the buffer path 28; the flapper 25*a* is fixed to a shaft 25*d* and is rotatable together with the shaft 25*d*; the flappers 25*c*, 25*b* are pivotable around the shaft 25*d*, urged respectively in a counterclockwise direction in FIG. 3(*a*) by twisted springs 26*a*, 26*b* with respect to the flapper 25*a*, and stayed at a solid line position by a stopper not shown. The flappers 25*c*, 25*b* are designed escapable in an arrow direction with respect to the flapper 25*a* upon reception of pushing force of one sheet. That is, the second flapper 25 is so structured that the sheets can be conveyed from the path 23 to the buffer path 28 and cannot be conveyed in the opposite way and also can be conveyed from the buffer path 28 to the path 27 and cannot be conveyed in the opposite way.

When the rear end of a sheet is detected with transmission type paper detection sensors 29*a*, 29*b* after the sheet passes by the second flapper 25, the sheet is conveyed toward the buffer path 28 where the second flapper 25 moves from Position D to Position E and where the delivery roller 30 begins reverse rotation. When paper detection sensors 29*a*, 29*b* detects the front end of the sheet (an end on the downstream side in the conveyance direction), the delivery roller 30 resumes normal rotation, and after a prescribed time passes, the second flapper 25 again moves from Position E to Position D to change sides of the sheets one by one in the same steps as the above. The side-changed sheet is reintroduced in the image forming section 4 by way of the buffer path 28, conveyed to the fixing apparatus 9 by the conveying apparatus 8 after images are formed, and then, delivered on the delivery tray 12 located outside the housing by the delivery roller pair 10 in passing the path 21 after images are fixed.

When a multiple copying such as "two in one" or the like is made, the sheet that has passed by the fixing apparatus 9 is deflected toward the path 23 by the first flapper 22 moved from Position B to Position A, and the sheet is conveyed by the second flapper 25 by way of the conveying roller 24 toward the buffer path 28. The second flapper 25 moves to Position C at that time, and the sheet proceeds in pushing back the flapper 25*c* of the second flapper 25 in an arrow direction in FIG. 3(*a*). The sheet is introduced again in the image forming section 4 through the buffer path 28 and delivered onto the delivery tray 12 in substantially the same steps.

In this embodiment, since multiple sheets, five sheets of a small size, and two sheets of a large size, can be stored in the series of paths without overlapping each other, when the sheets are of a placing number N greater than five and of the small size, the above operation is repeated five times for each original document until the placing number becomes equal to the copying number.

Figure 4:
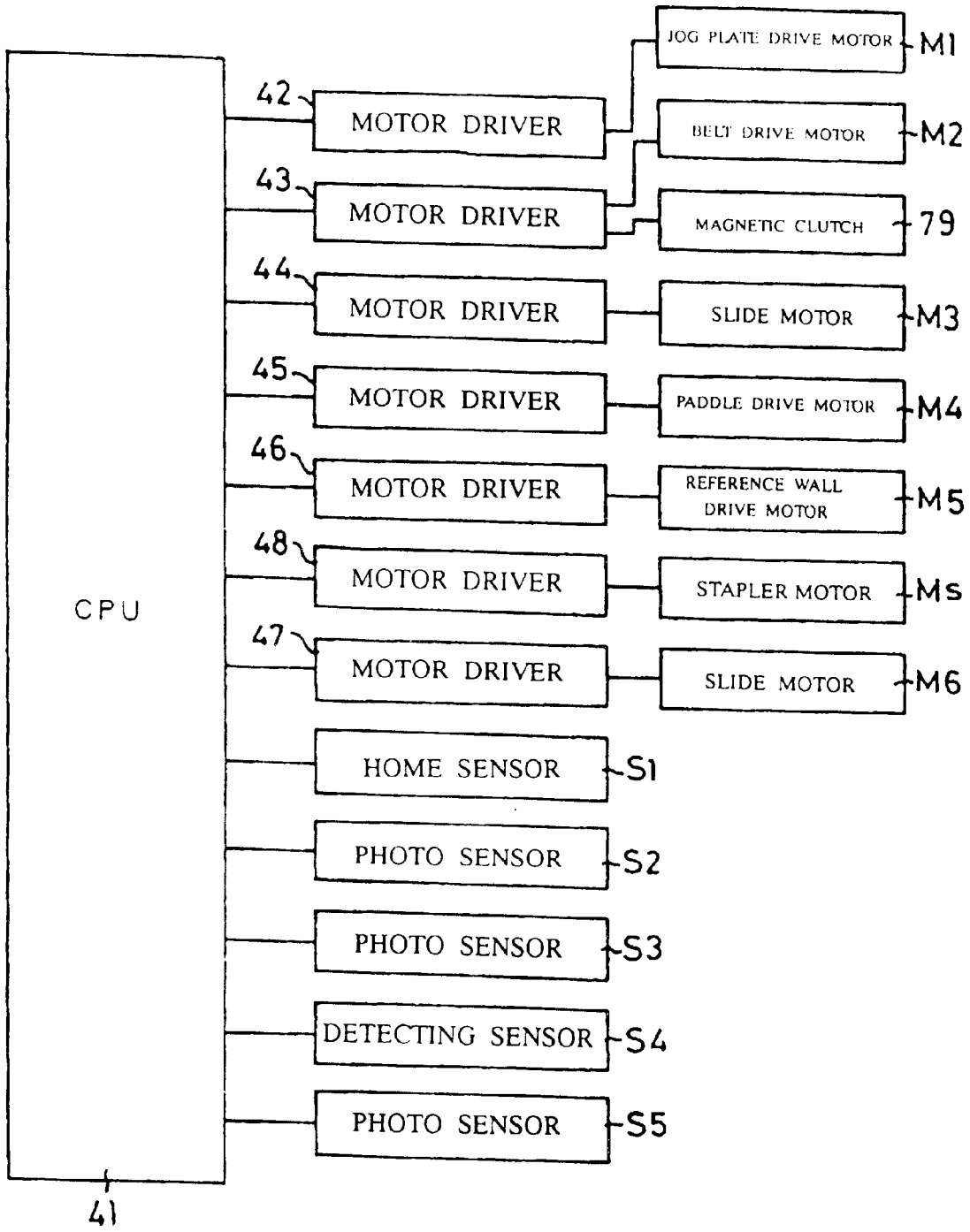
FIG. 4 is a block diagram showing a structure of a control system of the image forming apparatus.

Notedly, FIG. 4 is a block diagram for a control system of the sheet processing unit 50 in the image forming apparatus according to the first embodiment. In FIG. 4, numeral 41 represents a CPU for controlling the entire system, which is constituted of an MPU, ROMs for storing control programs for the MPU, RAMs used for work area of various data processings and temporary memory of image information, and so on. The control system has a structure that the CPU 41 is connected to motors M1 to M6 and a stapler motor Ms through respective motor drivers 42 to 48 and further connected to photo sensors S1 to S5.

Figure 5:
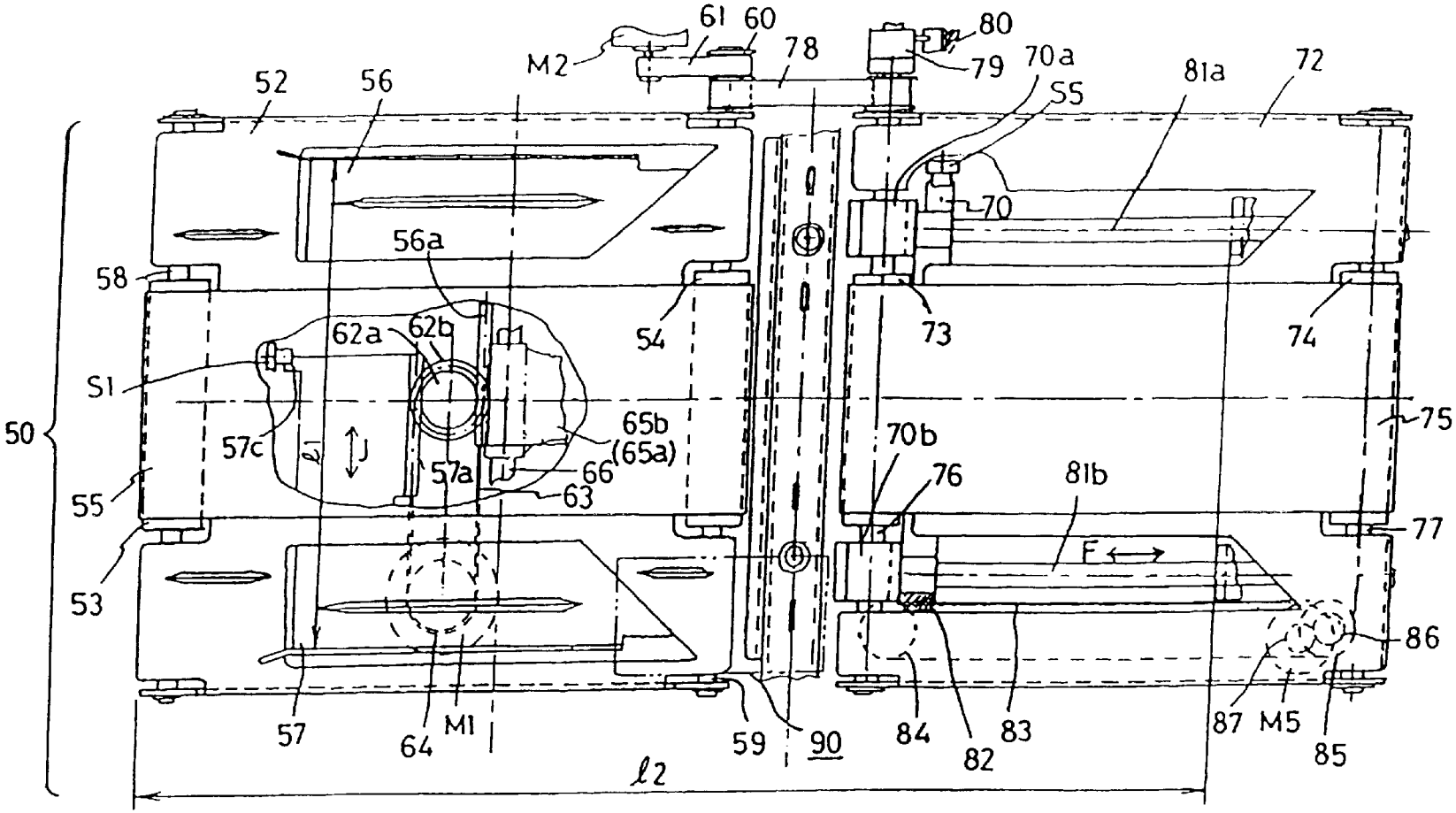
FIG. 5 is a top view showing a sheet processing apparatus in the image forming apparatus of the first embodiment.
Figure 6:
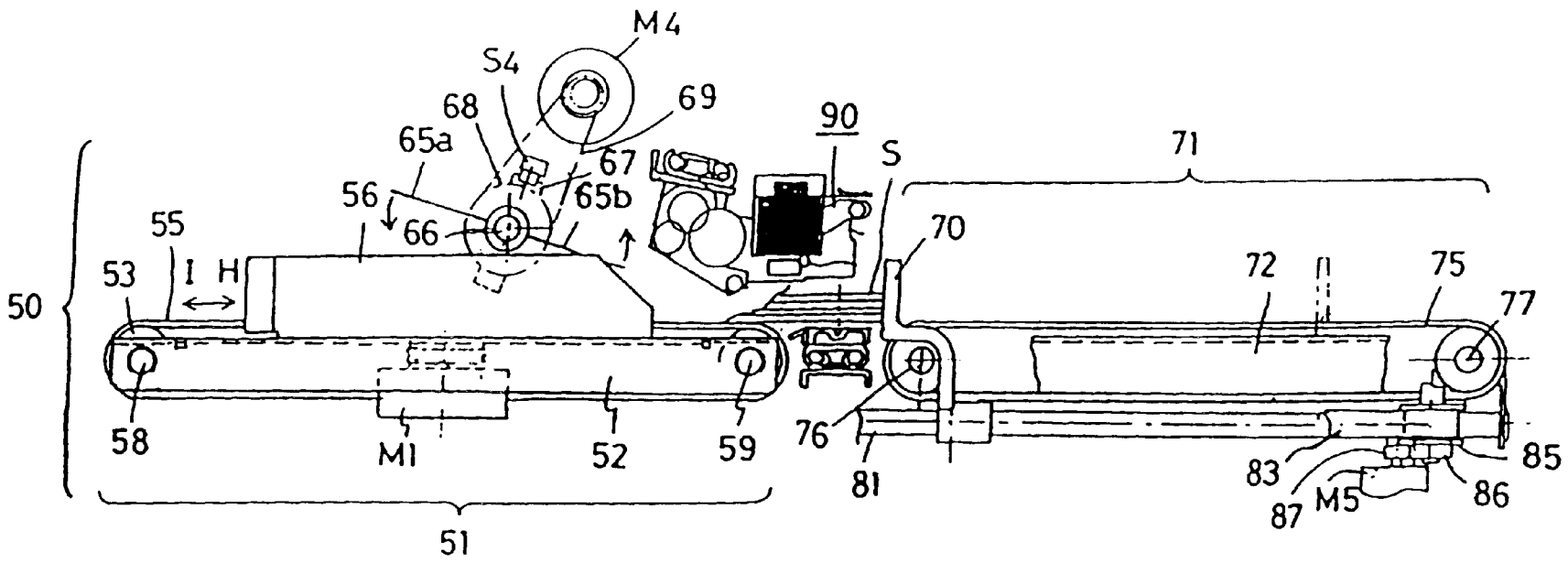
FIG. 6 is a side view showing a sheet processing apparatus in the image forming apparatus of the first embodiment.

Referring to FIGS. 5, 6, the sheet processing unit 50 will be described.

A processing tray 51 is formed of a frame 52, belt drive rollers 53, 54, a conveying belt 55 serving as a bundle conveying means, jog plates 56, 57, and so on. Belt drive shafts 58, 59 are supported to the frame 52 by way of bearings, and the belt drive shaft 59 is connected to the belt drive motor M2 by way of a drive pulley 60 and a timing belt 61. The belt drive motor M2 is capable of rotating in normal and reverse directions, and rotation of the motor M2 make the conveying belt 55 rotate, thereby moving sheet bundles stacked on the processing tray 51.

Racks 56*a*, 57*a* are formed on the jog plates 56, 57 and in meshing with the pinion 62*a*. A pulley 62*b* is arranged coaxially with the pinion 62*a*, which is connected to the jog plate drive motor M1 by way of the timing belt 63 and the motor pulley 64, and normal rotation of the jog plate drive motor M1 makes the jog plates 56, 57 reciprocally move in arrow J direction (perpendicular direction to the sheet proceeding direction) in FIG. 5. Numeral 57*b* is a home position flag formed on the jog plate 57 and its position is to be detected by a home sensor S1. The jog plate drive motor M1, in this embodiment, is a pulse motor, and a distance l1 between the jog plates 56, 57 at the home sensor detecting position is set to A4 size plus around 20 mm in width. Therefore, normal and reverse rotations of the motor M1 by controlling, from the home position, the pulse number can make sheets in an arbitrary size align on the processing tray 51.

Numerals 65*a*, 65*b* are alignment paddles as urging means and formed at about the center position above the processing tray 51 by way of a drive shaft 66. A flag 67 and a drive pulley 68 are formed on the drive shaft 66 and connected to the paddle drive motor M4 by a timing belt 69. The alignment paddles 65*a*, 65*b* are formed of an elastic material such as a rubber and rotate in a counterclockwise direction (arrow direction in FIG. 6) around the drive shaft 66, and align the sheets on the processing tray 51 in pushing the sheets toward a reference wall 70 as a reference member. In this embodiment, because the home position of the alignment paddles 65*a*, 65*b* in the rotation direction is set an angle not disturbing entries of sheets delivered onto the processing tray 51 by the delivery roller 30 and because a half rotation detecting sensor S4 can detect rotation number and positions of the paddles, the paddles 65*a*, 65*b* are operated with timings that the paddles do not disturbing entries of the sheets at every delivered sheet, thereby aligning the sheet toward the reference wall 70.

A processing tray 71 for stacking large size sheets as an auxiliary tray is constituted of a frame 72, belt drive rollers 73, 74, a conveying belt 75 serving as an auxiliary bundle conveying means, a reference wall 70, and so on. A belt drive shaft 76 is connected to the belt drive shaft 59 by way of a timing belt 78 and receives drive force from the belt drive motor M2. An electromagnetic clutch 79 is formed on the belt drive shaft 76 and engages with a rotation stopper 80. Where the clutch 79 is turned on during rotation of the belt drive motor M2, the conveying belts 55, 75 come associated, and where the clutch 79 is turned off, the conveying belt 55 only operates.

The reference walls 70*a*, 70*b* as reference members engage with slide shafts 81*a*, 81*b* and have a structure slidable in arrow F direction (sheet proceeding direction) in FIG. 5. Numeral 70*c* is a home position flag for the reference wall 70 and its position is detected by the photo sensor S5. The home position of the reference wall 70 is a position prescribed with respect to the stapling position of the stapler unit 90 serving as stapling means as described below. A timing belt 83 is supported by pulleys 84, 85, and a gear 86 is formed coaxially with the pulley 85 and connected to a reference wall drive motor M5 through a gear 87. The reference wall drive motor M5 is a pulse motor rotatable in normal and reverse directions and can move to an arbitrary position from the home position by controlling the pulse number. A distance l2 from a reference surface of the reference walls 70*a*, 70*b* to the upstream end of the processing tray 51 when the walls move by a maximum distance is designed larger than the length of the large size. The sheets from in the small size to in the large size, therefore, can be stacked on the sheet processing unit 50 by shifting the reference walls 70. Herein, the small size is a sheet size that can be processed only above the processing tray 51, and the large size is a sheet size that cannot be processed only above the processing tray 51.

A stapler unit 90 serving as a stapling means is described next.

Figure 7:
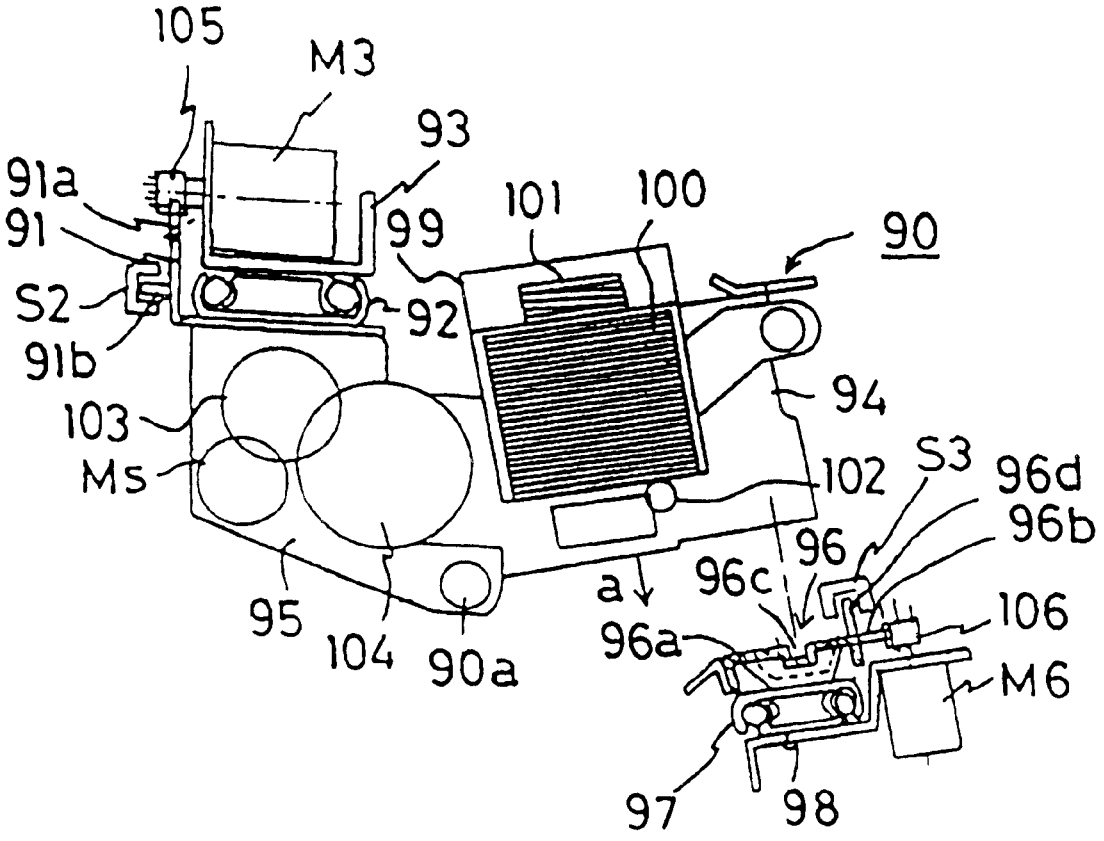
FIG. 7 is a cross section showing a structure of a stapler unit.

The stapler unit 90 is secured as shown in FIG. 7 to an upper frame 93 by way of a support plate 91 and slide rails 92. The stapler unit 90 is constituted of a forming section 94 (staple hitting member) located on an upper side and supported pivotably around a shaft 90*a*, a drive unit 95, and an anvil section (folding member) 96.

An anvil base 96*a* for stapling the guided sheet bundle is secured to a lower frame 98 below the shaft 90*a* by way of slide rails 97. In this embodiment, four anvil grooves are provided in a longitudinal direction (a perpendicular direction to a sheet proceeding direction) for folding legs of the staple.

In a meantime, a staple cartridge 99 is detachably attached to the forming section 94, and staples 100 (about 5000 pieces in this embodiment) connected in a plate form are filled in the staple cartridge 99. The staples 100 in the plate form filled in the staple cartridge 99 are pushed downward by a spring 101 arranged on a top of the staple cartridge 99 and provide conveyance force to a feeding roller 102 disposed at a bottom of the cartridge.

The staples 100 fed by the feeding roller 102 are formed into one piece in a rectangularly U-shape by moving the forming section 94 pivotally around the rotary shaft 90*a*. The forming section 94 moves pivotally toward the anvil base 96*a* (in arrow a direction in FIG. 7) by operation of an eccentric cam not shown attached unitedly to an eccentric cam gear 104 where the eccentric cam gear 104 rotates by way of a gear series 103 upon start of moving of the stapler motor Ms, clinching the pinned staple 100 with the anvil groove 96*c* located below the sheet bundle upon pinning the staple to fasten the sheet bundle.

It is to be noted that a flag, not shown, is disposed coaxially with the eccentric can gear 104, and whether the stapler is during clinching or finishes clinching (or before start) can be detected by detecting the flag with a flag sensor not shown.

Moving operation of the stapler unit 90 in the longitudinal direction (the perpendicular direction to the sheet proceeding direction) will be described next.

A rack 91*a* is formed as to extend in the longitudinal direction on the support plate 91, which is supporting the stapler unit 90. The rack 91*a* engages with a pinion 105 of the slide motor M3 provided on the upper frame 93, and when the slide motor Ms rotates, the stapler unit 90 moves in the longitudinal direction by way of the slide rails 92. A sensor flag 91*b* is formed on the support plate 91 at a position corresponding to the home position of the stapler unit 90, and the photo sensor S2 detects its position. In this embodiment, a stapling position is set to a position 5 mm inside from edges of the A4 size paper. The slide motor M3 is a pulse motor rotatable in normal and reverse directions, and the stapler unit 90 can move at an arbitrary position in the longitudinal direction by controlling the pulse number from the home position.

Similarly, a rack 96*b* is formed as to extend in the longitudinal direction on the anvil base 96*a* having the anvil groove 96*c*. The rack 96*b* engages with a pinion 106 of the slide motor M6 provided on the lower frame 98, and when the slide motor M6 rotates, the anvil section 96 moves in the longitudinal direction by way of the slide rails 97. At that time the anvil section 96 moves to a position corresponding to the stapler unit 90 with respect to the sheet conveyance passage. A sensor flag 96*b* is formed on the anvil base 96*a* at a position corresponding to the home position of the anvil section 96, and the photo sensor S3 detects its position. The slide motor M6 is a pulse motor rotatable in normal and reverse directions, and the anvil section 96 can move at an arbitrary position in the longitudinal direction by controlling the pulse number from the home position.

A mode for post processing sheets on which images are formed (finishing mode) will be described next. A sheet on which images are fixed by the fixing apparatus 9 is deflected toward the path 23 by the first flapper 22 and deflected toward the buffer path 28 by the second flapper 25 by way of the conveying roller 24. The second flapper 25 exists at Position C at that time. The conveying rollers are reversely rotated at a timing when transmission type paper detection sensors 31*a*, 31*b* detect the rear end of the sheet. The sheet is deflected toward the path 27 from the buffer path 28 by means of the flapper 25*c* of the second flapper 25. As described above, because the flapper 25*b* of the second flapper 25 is urged with no more than a slight spring pressure, the flapper is retired from rigidity of the sheet, thereby allowing the sheet to enter to the path 27. The sheet whose side is changed by the above steps is then delivered onto the processing tray 51 of the sheet processing unit 50 by the delivery roller 30. When the delivered sheet is in the small size, the reference wall 70 is located at the home position (solid line position shown in FIG. 6). When the front end of the first sheet is detected by the paper detection sensors 29*a*, 29*b*, the belt drive motor M2 is turned on to rotate the conveying belt 55 in arrow H direction in FIG. 6 with a speed nearly equal to the peripheral speed of the delivery roller 30.

In this embodiment, where conveying speed of the delivery roller 30 serving as delivering means is v1, and where conveying speed of the conveying belt 55 serving as bundle conveying means is v2, the conveying belt 55 is operated so that a relation of the conveying speeds is that v1 is equal to or less than v2 when the sheet is delivered onto the processing tray 51.

The sheet stops where the front end comes in contact with the reference wall 70, and the conveying belt 55 stops after a prescribe time passes after the rear end of the sheet is detected with the paper sensors 29*a*, 29*b*. The sheets are therefore stacked on the processing tray 51 without suffering from bending or scars, etc. even where the front end contacts during delivery to the conveying belt 55 which has a high friction coefficient. The motors M1, M4 begin to operate before the subsequent sheet enters in the processing tray 51, and the sheet is aligned in contacting with the reference wall 70 by the alignment paddles 65*a*, 65*b* even where the sheet is positionally shifted due to bounds at the reference wall 70 when the front end hits the reference wall 70. The sheet is also aligned to the center position by the jog plates 56, 57 with respect to the direction perpendicular to the sheet proceeding direction. After alignment operation is over, the subsequent sheet is delivered on the processing tray 51 by the delivery roller 30 in substantially the same steps. At and after the second sheet, because the friction coefficient between the sheets is very lower than the friction coefficient between the conveying belt and the sheet, and because bending or flipping would not occur when the delivered sheet front end contacts to the already stacked sheets, the sheet is aligned by the alignment paddles 65*a*, 65*b* and the jog plates 56, 57 while the conveying belt 55 does not operate. Then, the sheets are stacked and aligned one by one.

After completion of stacking sheets, in the case of the staple mode, the sheet bundle is stapled (e.g., at one location or two locations) in the above described steps by the stapler unit 90. Since the sheet on which images are formed is stacked on the processing tray 51 after its side is reversed, stapling can be made from the side of the transfer surface (image surface). After stapling, the belt motor M2 operates, and the sheet bundle is conveyed in arrow I direction in FIG. 3 by the conveying belt 55 and delivered on a stacking tray 34 by a bundle conveying roller 33.

It is to be noted that in this embodiment the stacking tray 34 is an offset tray movable up and down and since the stacking tray has the same system as the conventional one, a further detailed description is omitted.

A finishing mode where the sheet on which images are formed are in the large size will described next. Where the large size is set by a controller not shown is set, the reference wall 70 moves to a position at an arbitrary distance l2 corresponding to the sheet size by drive of the reference wall drive motor M5. When the sheet front end of the first sheet, whose sides have been reversed in the buffer path 28, is detected by the paper sensors 29*a*, 29*b*, the belt drive motor M2 and the electromagnetic clutch 79 operate to rotate the conveying belts 55, 75 at about the same speed as the peripheral speed of the delivery roller 30 in arrow H direction in FIG. 3. The relation at that time between the conveying speed v2 of the conveying belts 55, 75 and the conveying speed v1 of the delivery roller 30 is as described above (i.e., v1 is equal to or less than v2). The sheet front end stops upon contacting to the reference wall 70, and the conveying belts 55, 75 stop after a prescribed time after the sheet rear end is detected by the paper sensor 29*a*, 29*b*.

The sheets are therefore stacked on the processing trays 51, 71 without occurrence of bending or scars even where the front end contacts to the conveying belts 55, 75 having a high friction coefficient during delivery. The motors M1, M4 operate before the subsequent sheet enters in the processing tray 51, and the sheet is surely aligned in contacting to the reference wall 70 by the alignment paddles 65*a*, 65*b* even where the sheet is positionally shifted due to a bound when the sheet front end contacts to the reference wall 70. The sheet is also aligned at the center position by the jog plates 56, 57 with respect to the direction perpendicular to the sheet proceeding direction. After completion of the aligning operation, the subsequent sheet is also delivered onto the processing trays 51, 71 by the delivery roller 30 in substantially the same manner. At and after the second sheet, because the friction coefficient between the sheets is very lower than the friction coefficient between the conveying belt and the sheet, and because bending or flipping would not occur when the delivered sheet front end contacts to the already stacked sheets, the sheet is aligned by the alignment paddles 65*a*, 65*b* and the jog plates 56, 57 while the conveying belts 55, 71 do not operate. Then, the sheets are stacked and aligned one by one.

After completion of stacking sheets, in the case of the staple mode, the belt drive motor M2 and the electromagnetic clutch 79 operate to move the conveying belts 55, 75 in arrow I direction in FIG. 6, and the reference wall 70 moves by the reference wall drive motor M5 to the home position at about the same speed as the conveying belts 55, 75, thereby moving and stopping the sheet bundle. The sheet bundle moved as a bundle is stapled by the stapler unit 90 in a manner as described above (e.g., stapled at one location or two locations). After staple operation ends, the belt drive motor M2 operates, and the sheet bundle is transferred as a bundle by the conveying belt 55 in the arrow I direction in FIG. 6 and is immediately delivered as a bundle on the stacking tray 34.

As described above, according to this embodiment, the sheet processing unit 50 for processing such as stapling sheets is disposed below the re-conveying section 7 (paths for double sides and multiple image formation) for introducing again the sheets, on which images are formed, to the image forming section 4 and is incorporated in the image forming apparatus, thereby making the apparatus more compact, as well as reducing installation area and costs. The apparatus has a structure such that the bundle moving distance for half side is minimized and thereby realizes high productivity. The apparatus can realize highly reliable sheet bundle conveyances because the conveying belts 55, 75 serving as bundle conveying means are disposed at two locations on the upstream and downstream sides with respect to the stapler unit 90 and because a large size bundle moving is performed where the moving type reference wall 70 is moved in association with the conveying belts 55, 75.

Second Embodiment

Figure 8:
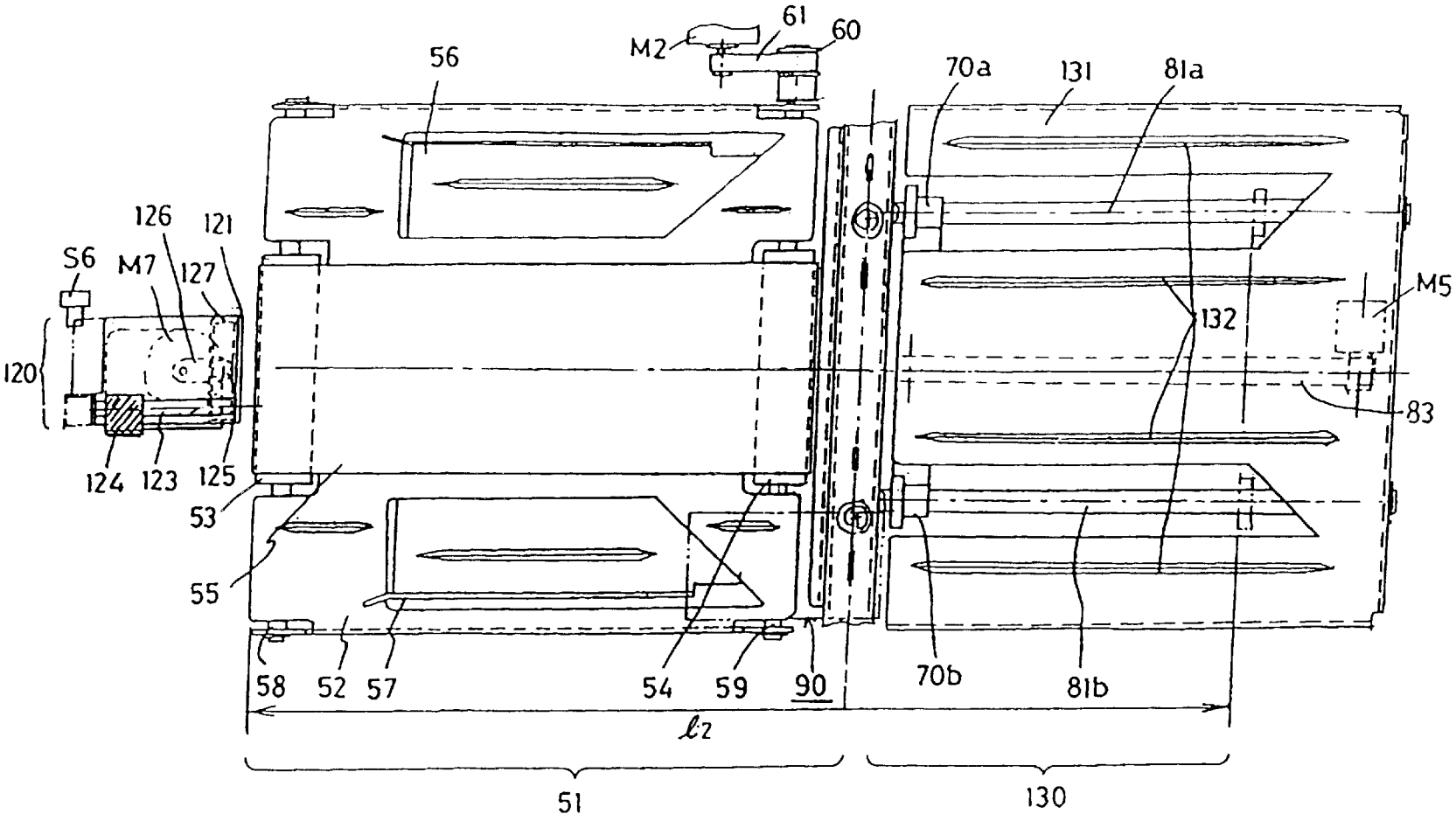
FIG. 8 is a top view showing a sheet processing apparatus in an image forming apparatus of the second embodiment.
Figure 9:
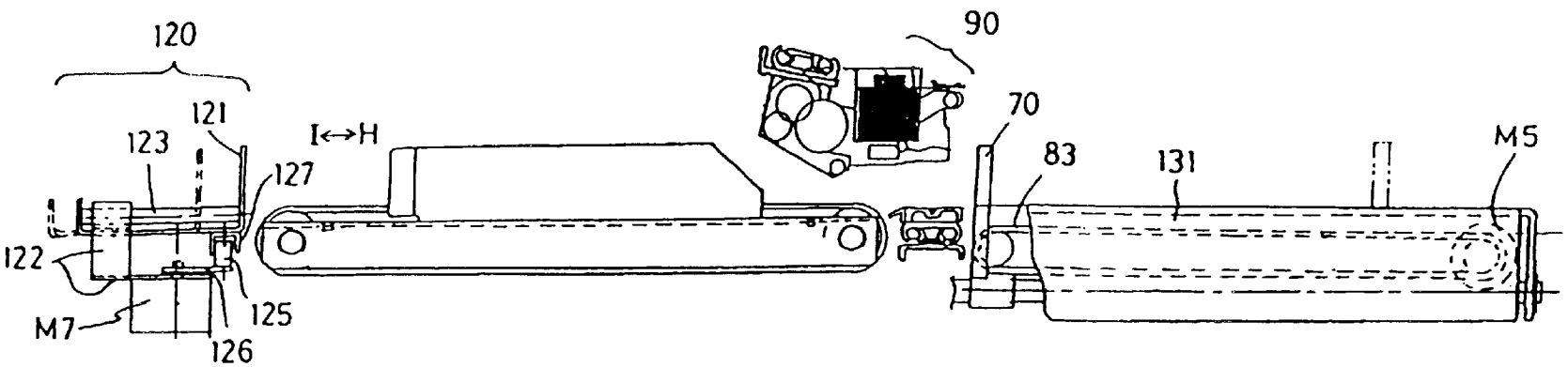
FIG. 9 is a side view showing the sheet processing apparatus in the image forming apparatus of the second embodiment.

Referring to FIGS. 8, 9, an image forming apparatus according to the second embodiment is described. It is to be noted that the structural outline of the image forming apparatus except the sheet processing unit is almost the same as the first embodiment described above, and here, structural portions different from the first embodiment described above are described.

Numeral 120 is a jog unit as an urging means, is a unit serving as the same role as the alignment paddles 65*a*, 65*b* of the first embodiment, and is made of a jog plate 121, a jog plate drive motor M7, a motor support plate 122, and so on. The jog plate 121 is provided with a slide shaft 123, which engages with a slider 124. The slider 124 is secured to the motor support plate 122, and the jog plate 121 can move smoothly with respect to the motor support plate 122. A crank pin 125 is secured to a crank arm 126 and is coupled to a link 127 secured to the jog plate 121. The crank arm 126 engages with the drive shaft of the jog plate drive motor M7, and the jog plate 121 reciprocally moves (one return movement) in the sheet proceeding direction when the crank arm 126 rotates upon operation of the motor M7. Numeral S6 is a home position sensor for jog plate 121. The jog unit 120, by the above operation, pushes the delivered sheet rear end toward the reference wall 70 to align the sheets.

A processing tray 130 serving as an auxiliary tray is described next. The processing tray 130 is constituted of a frame 131, a reference wall 70 as a reference member, and so on. Ribs 132 are formed on the sheet stacking surface of the frame 131 to reduce friction resistance against the sheets in this embodiment. It is to be noted that the structure of the movable reference wall 70 and its operation is substantially the same as the first embodiment as described above, so that a detailed description is omitted here.

A finishing mode in which the sheet on which images are formed are to be post-processed will described next. Where the large size is set by a controller not shown is set, the reference wall 70 moves to a position at an arbitrary distance l2 corresponding to the sheet size by drive of the reference wall drive motor M5. In the case of the large size, as the same way as the first embodiment, when the sheet front end of the first sheet, whose sides have been reversed in the buffer path 28, is detected by the paper sensors 29*a*, 29*b*, the belt drive motor M2 operates to rotate the conveying belt 55 at about the same speed as the peripheral speed of the delivery roller 30 in arrow H direction in FIG. 9. The relation at that time between the conveying speed v2 of the conveying belt 55 and the conveying speed v1 of the delivery roller 30 is substantial the same as in the above embodiment (i.e., v1 is equal to or less than v2). The sheet front end stops upon contacting to the reference wall 70, and the conveying belt 55 stops after a prescribed time after the sheet rear end is detected by the paper sensor 29*a*, 29*b*.

The sheets are therefore stacked on the processing trays 51, 131 without occurrence of bending or scars even where the front end contacts to the conveying belt 55 having a high friction coefficient during delivery. The motors M1, M7 operate before the subsequent sheet enters in the processing tray 51, and the sheet is surely aligned in contacting to the reference wall 70 by the jog plate 121 even where the sheet is positionally shifted due to a bound when the sheet front end contacts to the reference wall 70. The sheet is also aligned at the center position by the jog plates 56, 57 with respect to the direction perpendicular to the sheet proceeding direction. After completion of the aligning operation, the subsequent sheet is also delivered onto the processing tray 51 by the delivery roller 30 in substantially the same manner. At and after the second sheet, because the friction coefficient between the sheets is very lower than the friction coefficient between the conveying belt and the sheet, and because bending or flipping would not occur when the delivered sheet front end contacts to the already stacked sheets, the sheet is aligned by the jog plate 121 and the jog plates 56, 57 while the conveying belt 55 does not operate. Then, the sheets are stacked and aligned one by one.

After completion of stacking sheets, in the case of the staple mode, the belt drive motor M2 operates to move the conveying belt 55 in arrow I direction in FIG. 9, and in association with this, the reference wall 70 moves by the reference wall drive motor M5 to the home position at about the same speed as the conveying belt 55, thereby moving and stopping the sheet bundle. The sheet bundle moved as a bundle is stapled by the stapler unit 90 in a manner as described above (e.g., stapled at one location or two locations). After staple operation ends, the motors M2, M5 operate, and the sheet bundle is transferred as a bundle by the conveying belt 55 and the reference wall 70 in the arrow I direction in FIG. 9 and is delivered on the stacking tray 34 by the bundle conveying roller 33 and stacked thereon.

As described above, according to this embodiment, since the processing tray 130 as an auxiliary tray is formed merely with not bundle conveying means but ribs 132 for reducing friction resistance against the sheets, the apparatus can further reduce the costs in addition to the above advantages of the first embodiment.

Third Embodiment

Figure 10:
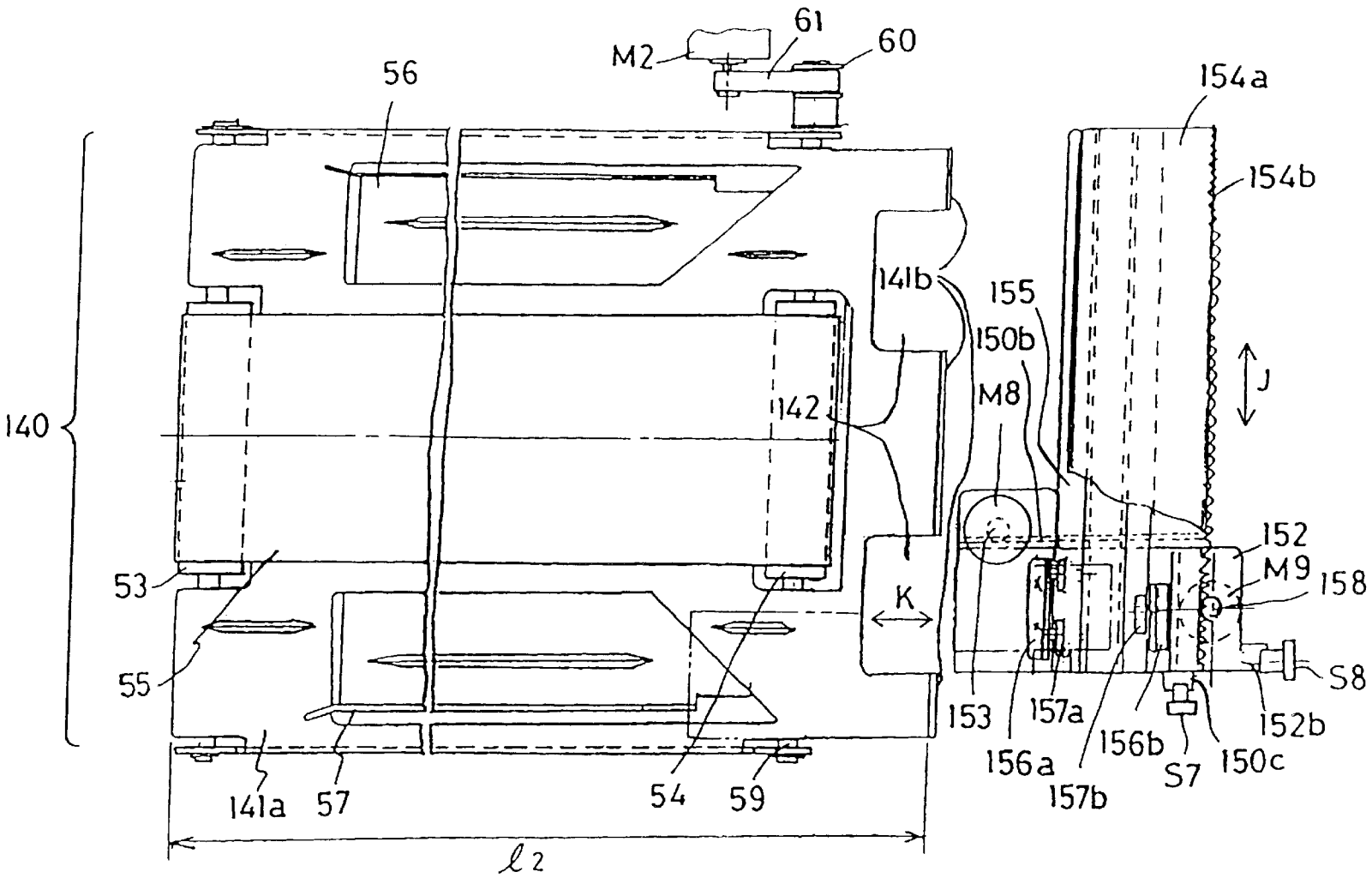
FIG. 10 is a top view showing a sheet processing apparatus in an image forming apparatus of the third embodiment.
Figure 11:
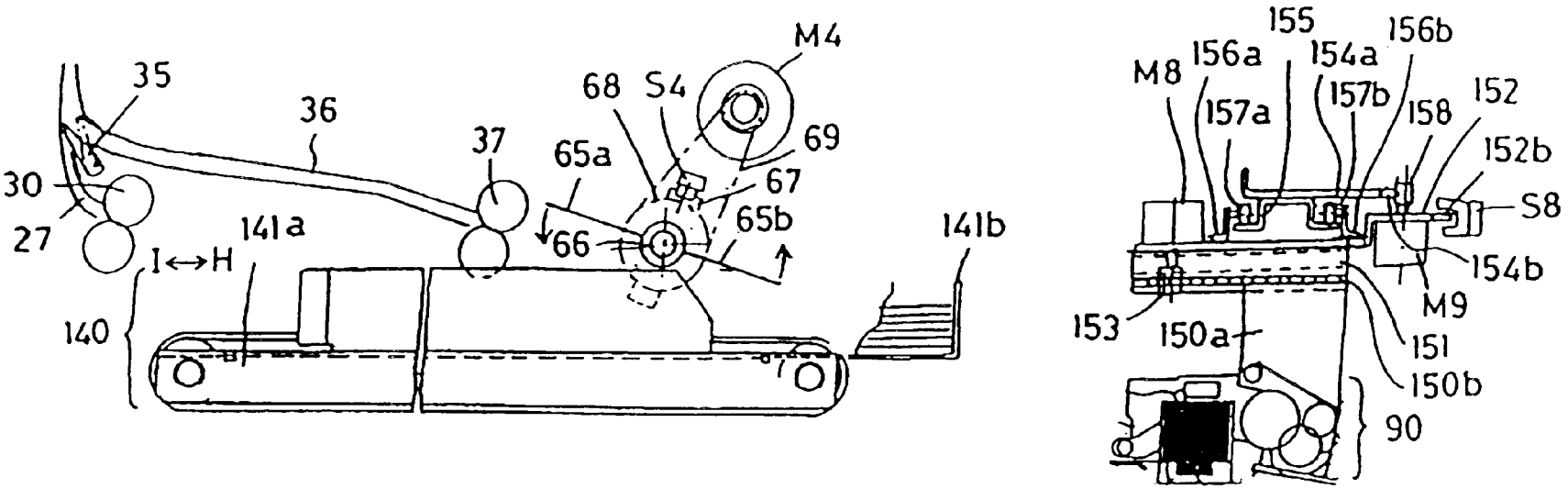
FIG. 11 is a side view showing a sheet processing apparatus in an image forming apparatus of the third embodiment.
Figure 12:
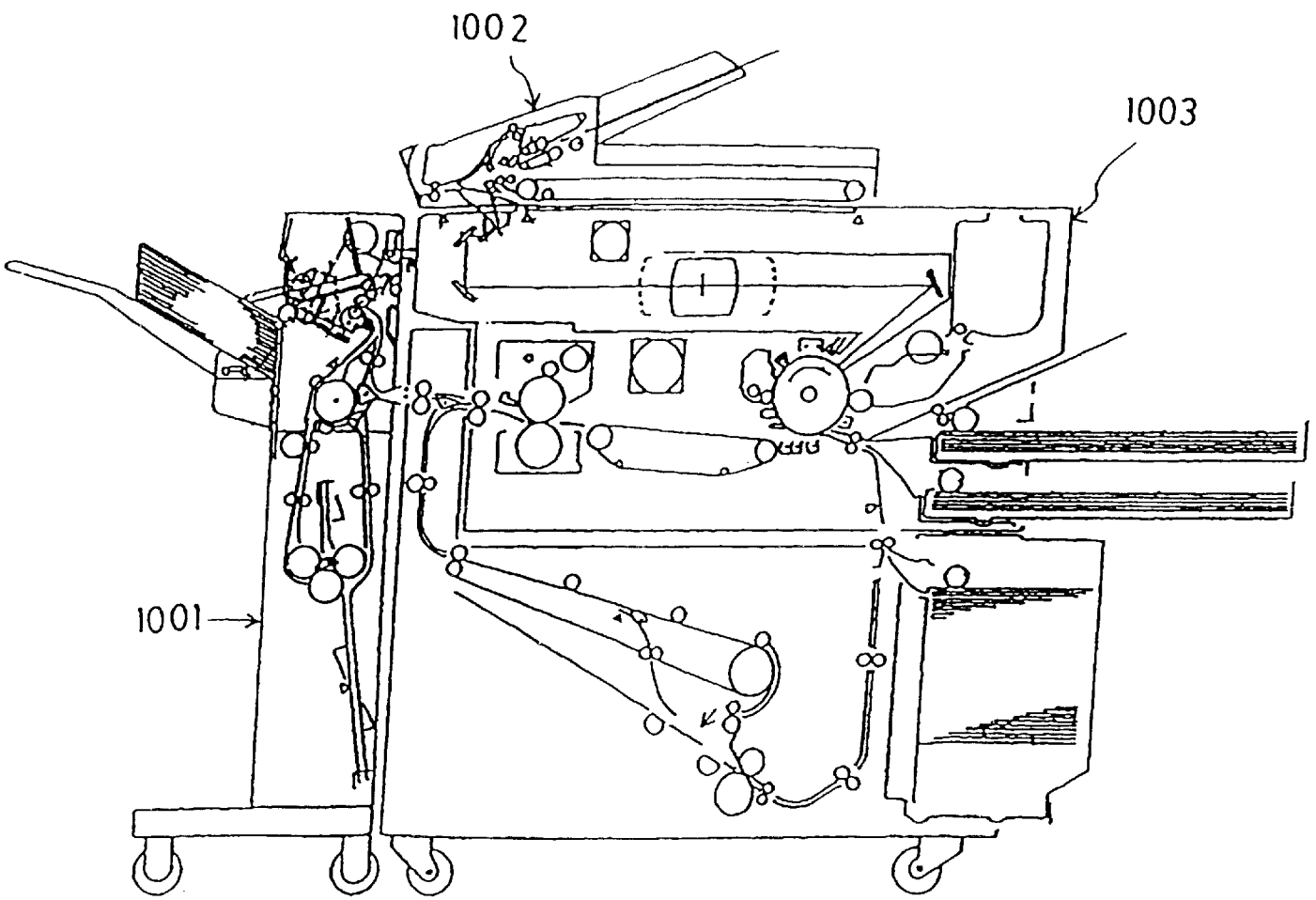
FIG. 12 is an illustration showing a conventional image forming apparatus.

Referring to FIGS. 10, 11, an image forming apparatus according to the third embodiment is described next. It is to be noted that the structural outline of the image forming apparatus except the sheet processing unit is almost the same as the first embodiment described above, and here, structural portions different from the first embodiment described above are described.

In this embodiment, the length of the processing tray 140 in the sheet proceeding direction is a distance l2 longer than the length of the above described large size, and the processing tray 140 can stack the sheets in the large size. The processing tray 140 is constituted of a frame 141*a*, a reference wall 141*b*, jog plates 56, 57 serving as aligning means, a belt drive motor M2, a conveying belt 55, and so on, and cutaways 142 are formed in the frame 141*a* on a side of the reference wall 141*b* for allowing the stapler unit 90 to enter. The stapler unit 90 in this embodiment is different from the above embodiment, placed up side down, and movable in arrows J, K in FIG. 10.

Here, movement of the stapler unit 90 is described. The stapler unit 90 is supported to a support base 150*a*, which is connected to a slide rail 151. The slide rail 151 is coupled to a transfer base 152, and the stapler unit 90 can move smoothly in arrow K direction (sheet proceeding direction) in FIG. 10 with respect to the transfer base 152. Motors M8, M9 are formed on the transfer base 152, and the motor M8 engages with rack 150*b* formed on the support base 150*a* by way of a pinion 153. The support base 150*a* has a flag 150*c* at a position corresponding to the home position, and photo sensor S7 detects the home position. The motor M8 is a pulse motor capable of rotating in the normal and reverse directions, and the stapler unit 90 can be reciprocally moved in arrow K direction in FIG. 10 by controlling the pulse number from the home position, thereby stapling the sheet bundle on the processing tray 140. A support angle 155 is formed on a base frame 154*a*, and the stapler unit 90 is supported by being suspended by the base frame 154*a* by way of roller support plates 156*a*, 156*b* and rollers 157*a*, 157*b*. A rack 154*b* is formed on the base frame 154*a* as to extend in the longitudinal direction and is engages with the motor M9 supported to the transfer base 152 by way of a pinion 158, and the transfer base 152 is movable in arrow J direction in FIG. 10 by rotating the motor M9. Numeral 152*b* is a home position flag formed on the transfer base 152, and the home position of the transfer base 152 can be detected by a home position sensor S8. The motor M9 is a pulse motor rotatable in the normal and reverse directions, and the transfer base 152 can be moved to an arbitrary position in arrow J direction in FIG. 10 by controlling the pulse number from the home position.

A finishing mode for post processing sheets on which images are formed will be described next. A sheet on which images are fixed by the fixing apparatus 9 is deflected toward the path 23 by the first flapper 22 and introduced to the path 27 by the second flapper 25 by way of the conveying roller 24. The second flapper 25 exists at Position D at that time. In a case of the large size, when the front end of the first sheet is detected by the paper detection sensors 29*a*, 29*b*, the belt drive motor M2 is turned on to rotate the conveying belt 55 in arrow H direction in FIG. 11 with a speed nearly equal to the peripheral speed of the delivery roller 30. It is to be noted that the relation at that time between the conveying speed v2 of the conveying belt 55 and the conveying speed v1 of the delivery roller 30 is substantial the same as in the above embodiment (i.e., v1 is equal to or less than v2). The sheet front end stops upon contacting to the reference wall 141b, and the conveying belt 55 stops after a prescribed time after the sheet rear end is detected by the paper sensor 29*a*, 29*b*.

The sheets are therefore stacked on the processing tray 140 without suffering from bending or scars, etc. even where the front end contacts during delivery to the conveying belt 55 which has a high friction coefficient. The motors M1, M4 begin to operate before the subsequent sheet enters in the processing tray 140, and the sheet is aligned in contacting with the reference wall 141*b* by the alignment paddles 65*a*, 65*b* even where the sheet is positionally shifted due to a bound at the reference wall 141*b* when the front end hits the reference wall 141*b*. The sheet is also aligned to the center position by the jog plates 56, 57 with respect to the direction perpendicular to the sheet proceeding direction. After alignment operation is over, the subsequent sheet is delivered on the processing tray 140 by the delivery roller 30 in substantially the same steps. At and after the second sheet, because the friction coefficient between the sheets is very lower than the friction coefficient between the conveying belt and the sheet, and because bending or flipping would not occur when the delivered sheet front end contacts to the already stacked sheets, the sheet is aligned by the alignment paddles 65*a*, 65*b* and the jog plates 56, 57 while the conveying belt 55 does not operate. Then, the sheets are stacked and aligned one by one.

After completion of stacking sheets, in the case of the staple mode, the sheet bundle is stapled (e.g., at one location or two locations) in the above described steps by the stapler unit 90. After stapling, the belt motor M2 operates, and the sheet bundle is conveyed in arrow I direction in FIG. 11 by the conveying belt 55 and delivered on the stacking tray 34 by the bundle conveying roller 33.

It is to be noted that in a case of the small size, the sheet is deflected by a third flapper 35 toward a path 36 at a branching point on an upstream side of the delivery roller 30 and delivered onto the processing tray 140 by a second delivery roller 36 located closer to the reference wall 141 than the delivery roller 30. Hereinafter, the sheet bundle is delivered onto the stacking tray 34 in the same manner as in the large size.

As described above, according to this embodiment, a high productivity can be realized since the sheets can be stacked without reversing sheets before the sheets are stacked on the sheet processing unit.

Other Embodiment

Although in the above embodiments the reference wall as a reference member is structured as movable in the sheet bundle conveying direction of the second bundle conveying means according to the sheet size, this invention is not limited to this, and such a reference member are formed in a multiple number and are retractable with respect to the sheet stacking surface of the second bundle conveying means according to the sheet size.

Although in the above embodiments the stapler unit for stapling a sheet bundle as a stapling means is exemplified, this invention is not limited to this, and other stapling means, for example, a sheet bundle is bundled in giving recesses at arbitrary locations of the sheet bundle, may be used.

Moreover, although in this embodiment as described above, the separation type stapling means which is divided into upper and lower portions with respect to the sheet conveying path is exemplified, another stapling means such as a non-separation type means can be used if a position escaped from the sheet conveying path is used as the home position.

Although in this embodiment as described above, a structure in which the delivery roller serving as a delivery means for delivering the sheets onto the processing tray is arranged at two locations in the sheet proceeding direction is exemplified, this invention is not limited to this, and such a delivery roller can be provided corresponding to necessities such as the sheet sizes to be used.

Although in the above embodiments, a through path structure is used in which sheets are not stacked during double side or multiple copying, this invention is sufficiently advantageous as a matter of course even where this invention uses an intermediate tray type structure in which the sheets are stacked once and re-conveyed. Although in the above embodiment a paddle member is used as an urging means for aligning the sheets in pushing the sheets to the reference member, this invention is not limited to this, and a roller member coming in contact with and separable from the topmost sheet may be used.

In the above embodiment, a photocopier is exemplified as an image forming apparatus, but this invention is not limited to that, and other image forming apparatuses can be a printer, a facsimile machine, etc. The same advantages are obtainable by applying this invention to the image forming apparatus.

Although in the above embodiment, an olectrophotogtaphic system is exemplified as a recording, this invention is not limited to this, and other recording method such as an ink jet method can be used.

Fourth Embodiment

Hereinafter, referring to the drawings, the fourth embodiment of a sheet processing apparatus according to this invention and an image forming apparatus having this is described.

Figure 13:
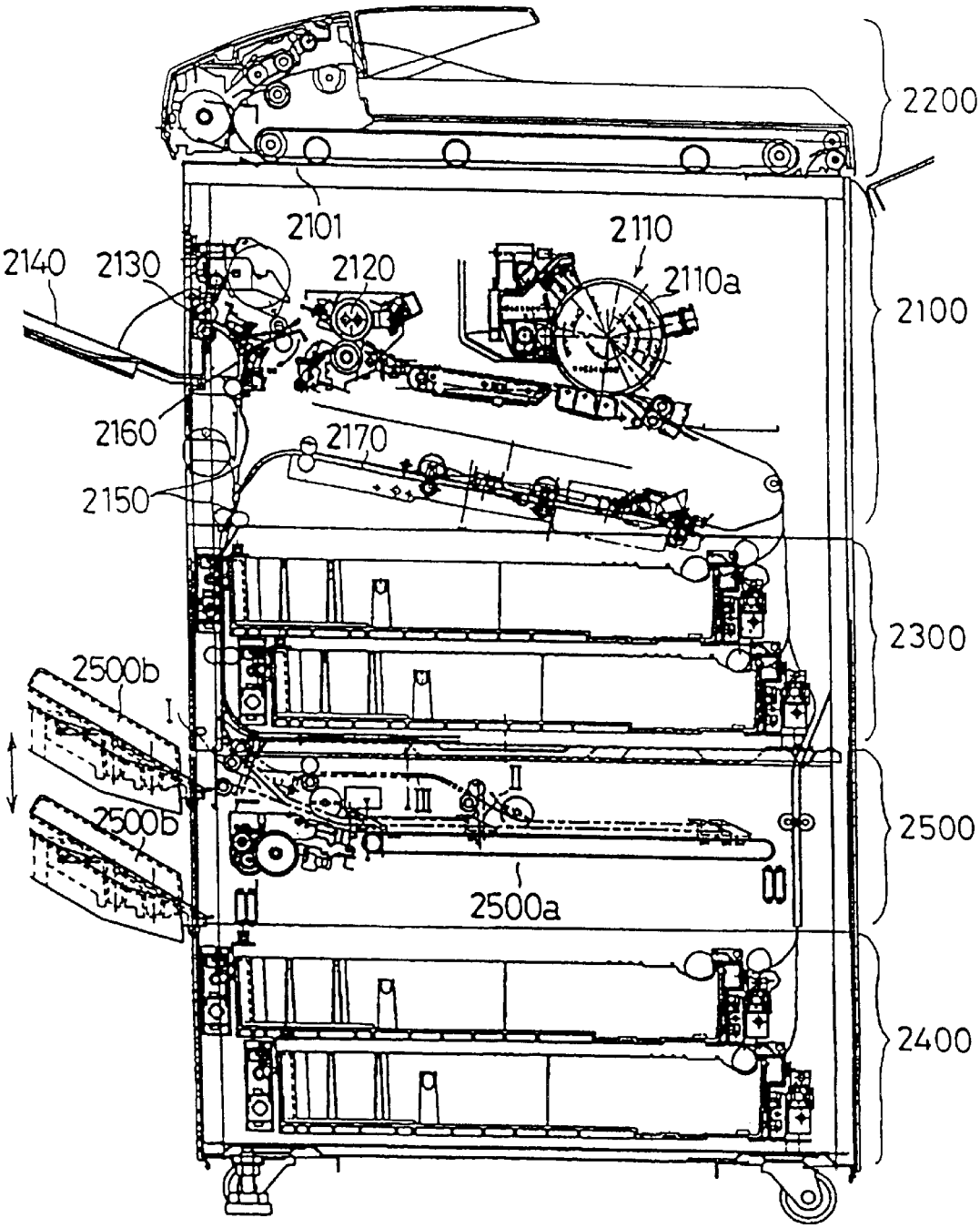
FIG. 13 is a cross section showing a schematic entire structure of an image forming apparatus system to which a sheet processing apparatus according to the invention applies.

FIG. 13 is a cross section showing a schematic entire structure of an image forming apparatus system to which a sheet processing apparatus according to this embodiment applies In the apparatus structure in FIG. 13, this image forming apparatus system has an image forming section 2100, a original document conveying apparatus 2200, first and second feeding sections 2300, 2400, and a finisher section 2500.

The image forming section 2100 transfers images on sheets as transfer materials selectively supplied from the first feeding section 2300 or second feeding section 2400.

The original document conveying apparatus 2200 separates one sheet from the original document bundle stacked on a original document tray and feeds the separated original document to an image reading section 2101 arranged at a ceiling of the image forming section 2100. On the other hand, the first and second feeding sections 2300, 2400 separate one sheet from respective sheet bundles on the respective sheet cassettes set inside the sections and convey the separated sheet to the image forming section 2110 having a photosensitive drum 2110*a* as an essential structural member via a right side portion in the drawing of the image forming section 2100.

The sheet on which images are formed at the image forming section 2110 is further delivered on a delivery tray (stacking tray) 2140 disposed outside an apparatus delivery section, or namely, a first apparatus delivery section 2130, after the transferred images are fixed at an image fixing section 2120 located on a downstream side, and is stacked thereon.

When images are to be formed on double sides of a sheet, a sheet on one side of which images are formed is reversed in a switch back manner by a switch back path 2150 branching at a sheet deflecting section 2160 formed on a downstream side of the image fixing section 2120 and by a transferring roller pair 2151 located in the switch back path 2150, and the sheet is fed again to the image forming section 2110 from the right side of the apparatus by way of a reversing path 2170. The same processes are repeated thereafter to form images on the other side of the sheet, and the sheet is delivered finally on the delivery tray 2140.

The downstream portion of the switch back path 2150 serves as a coupling portion for the finisher section 2500 which is a featured portion of the invention, and constitutes the second apparatus delivery section for delivery to the outside. The finisher section 2500 is constituted from a combination of a processing tray section 2500*a* and stacking tray section 2500*b*, and in this situation, the processing tray section 2500*a* is disposed below the image forming section 2100 between the first feeding section 2300 and the second feeding section 2400.

Referring to FIGS. 14 to 22, the finisher section 2500 will be described in detail next.

First, structures of the essential portions are described.

Figure 14:
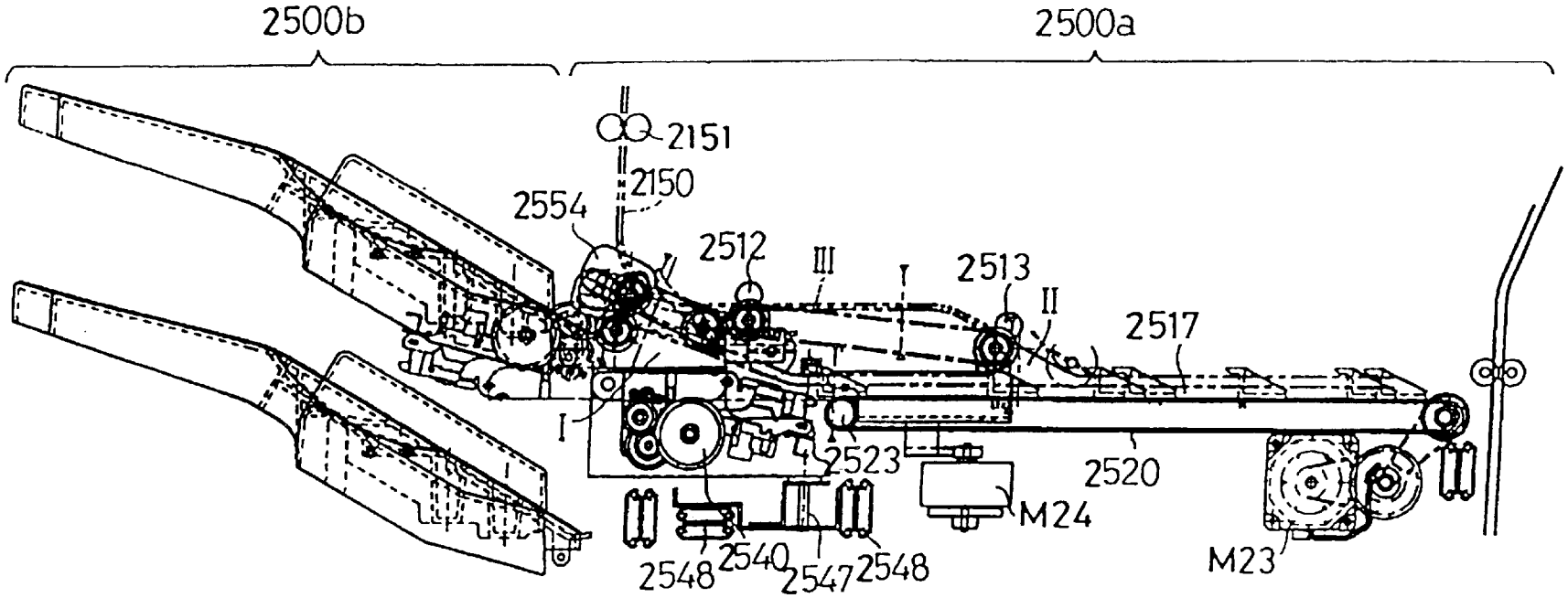
FIG. 14 is a cross section showing a schematic entire structure of the sheet processing apparatus system in the above embodiment.
Figure 15:
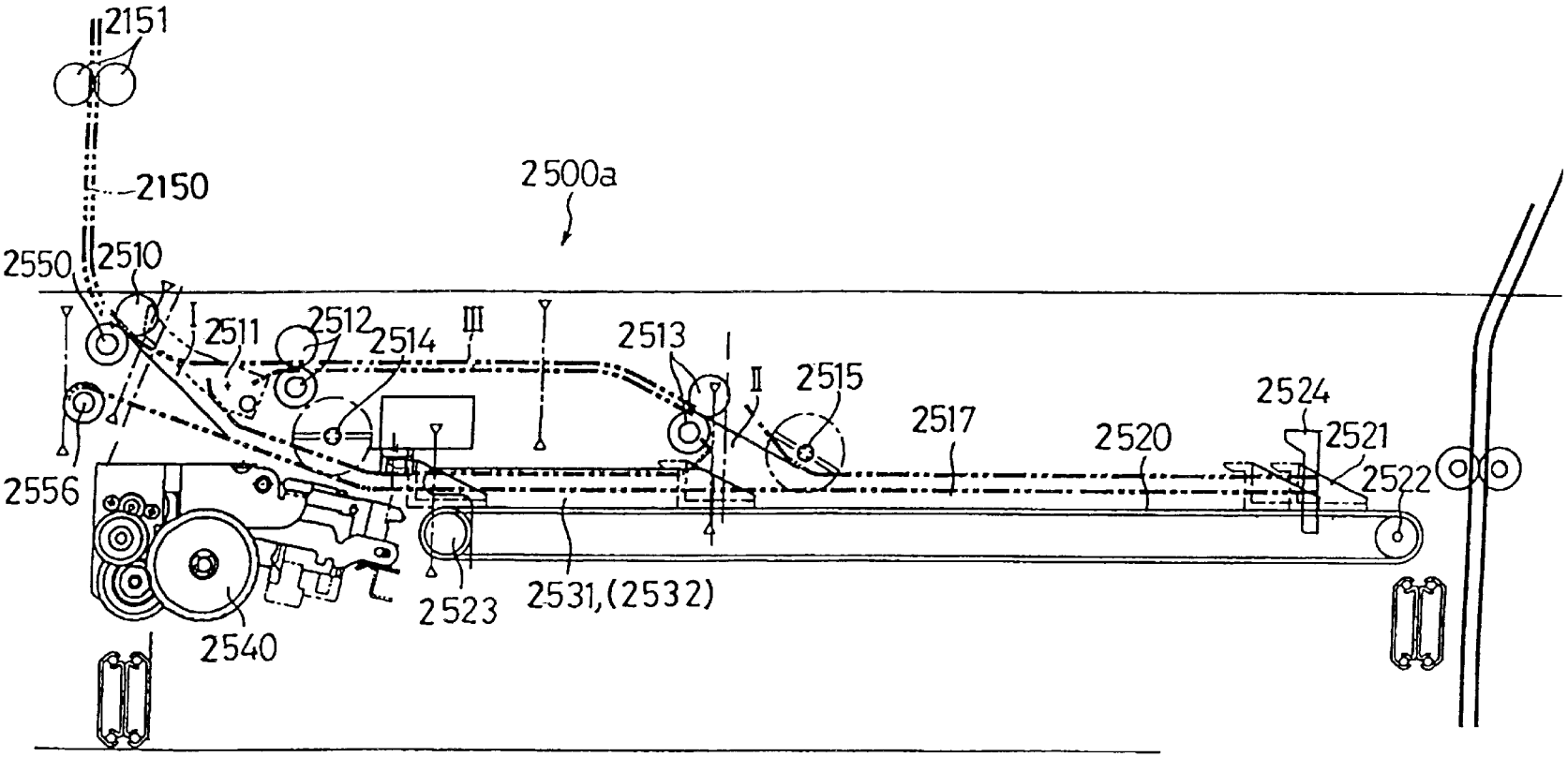
FIG. 15 is a detailed cross section showing a structure of essential portions in the above sheet processing apparatus.
Figure 16:
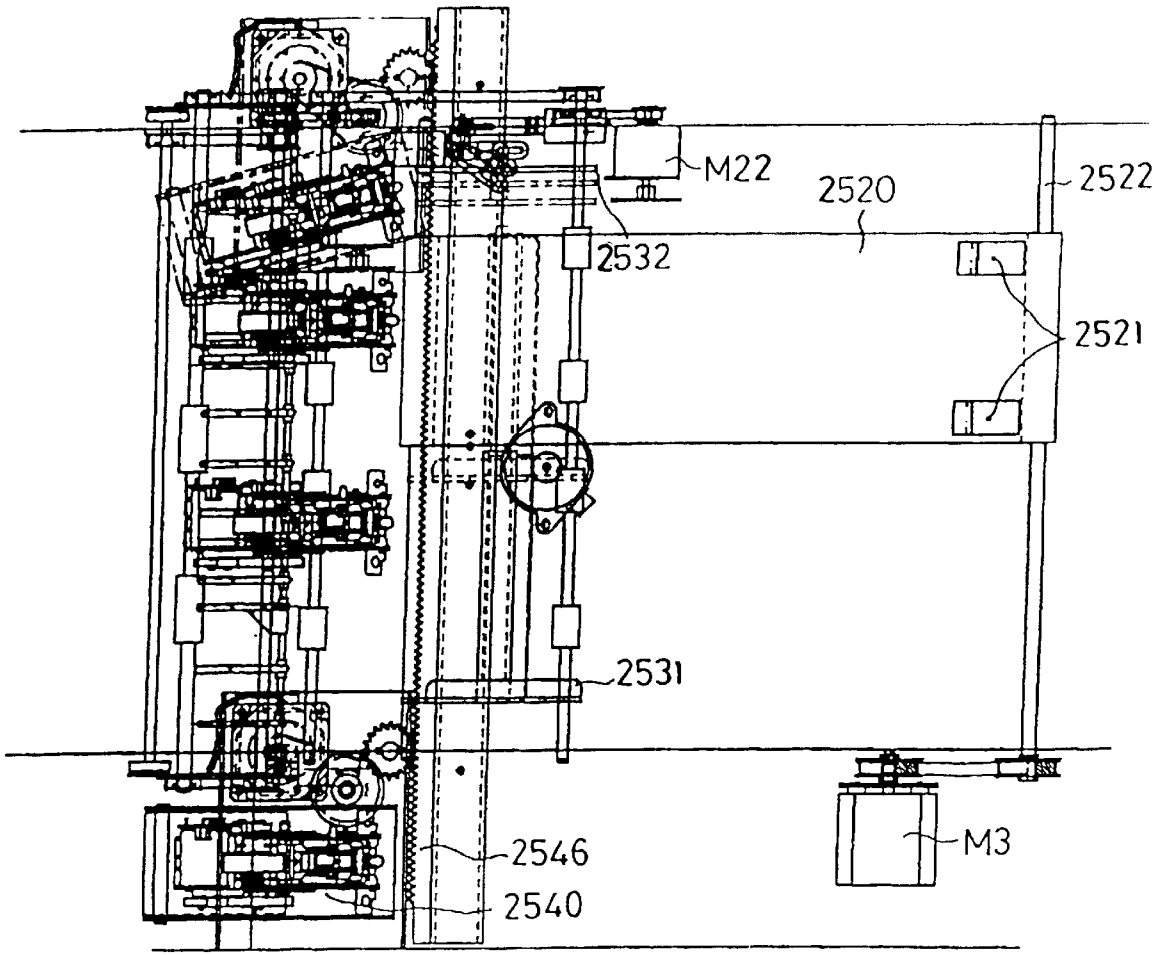
FIG. 16 is a detailed plan view showing the essential portions in FIG. 15.

FIG. 14 is a cross section showing a schematic entire structure of the sheet processing apparatus system according to this embodiment; FIG. 15 is a detailed cross section showing a structure of essential portions in the above sheet processing apparatus system; and FIG. 16 is a detailed partial plan view showing the essential portions in the above sheet processing apparatus system. FIGS. 17 to 22 are illustrations showing detailed structures of respective sections in the above sheet processing apparatus system.

[Processing Tray Section 2500*a*]

In this processing tray section 2500*a*, the conveying route for sheets on which images are formed is constituted of a first conveying route in which sheet bundles are conveyed, after completion of processing at the first sheet delivery section I where the sheets conveyed through the switch back path 2150 are delivered from the first sheet delivery section I and stacked temporarily on a delivery side (left side in FIGS. 15, 16) on a sheet stacking guide 2517, again to the stacking tray section 2500*b*, and a second conveying route in which sheet bundles are conveyed, after completion of processing at the first sheet delivery section I where the sheets conveyed are delivered from a buffer path III through a second sheet delivery section II and stacked temporarily on a non-delivery side (right side in FIGS. 15, 16) on the sheet stacking guide 2517 for temporarily stacking conveyed transfer materials while the sheets are delivered and stacked at the first sheet delivery section I from the first route and the sheets are delivered as a bundle to the stacking tray section 2500*b* after processing.

In this situation, the sheet conveying means has a main delivery roller 2510, a movable delivery roller 2550 capable of contacting to the main delivery roller 2510 upon selective switching as described below in detail, which are serving as a first delivery roller pair for delivering sheets toward the first delivery section I, a first sweeping paddle 2514 for surely stacking delivered sheets on the sheet stacking guide 2517 on a side of the delivery section, and a pair of alignment plates 2531, 2532 for aligning the delivered sheets.

The means also has a switching flapper 2511 for switching the first sheet delivery section I and the buffer path section III with each other, which are conveying paths, respectively, a relay roller pair 2512 located in the buffer path section III, a second delivery roller pair 2513 for delivering sheets from the buffer path section III to the second sheet delivery section II, a second sweeping paddle 2515 for surely stacking sheets which are delivered to the second sheet delivery section II on the sheet stacking guide 2517 on a side of the non-delivery section, and a stationary stopper 2524 for limiting temporarily the edges of the sheets delivered from the second sheet delivery section II.

The means further has pushers 2521 for limiting the edges of the sheets at the first sheet delivery section I, for conveying sheet bundles that already stacked to a processing position, and for conveying sheet bundles located at the second sheet delivery section II, a bundle delivery roller 2556 constituting a bundle delivery roller pair for holding the sheet bundle in nipping the sheet bundle at the stapling processing position and delivering the sheet bundles on the stacking tray 2500*b* after the stapling processing, and the above movable delivery roller 2550, as well as the above, capable of contacting to the bundle delivery roller 2556 upon selective switching.

Meanwhile, a sheet processing section for processing the sheet bundle on the sheet stacking guide 2517 is provided around the first sheet delivery section I for processing sheet bundles on the sheet stacking guide 2517 and is constituted, in this case, of a stapler 2540 and an alignment plate pair 2531, 2532.

The operation position of the stapler 2540 is in a region for stacking sheets delivered Prom the first sheet delivery section I but out of a region for stacking sheets delivered from the second sheet delivery section II, and the position is located between the stacking region for sheets from the second delivery section II and the stacking tray section 2500*b*. The alignment plate pair 2531, 2532 is located at a position as to operate with sheets in the stacking region for sheets from the first sheet delivery section I and as not to operate with sheets in the stacking region for sheets from the second delivery section II and is so designed as not to raise any problem upon that the sheets delivered from the second sheet delivery section II are unnecessarily restricted during the sheet alignment in order to prevent the stacked bundles from losing their order during the staple operation.

[Detailed Structures of Essential Portions]

Figure 17:
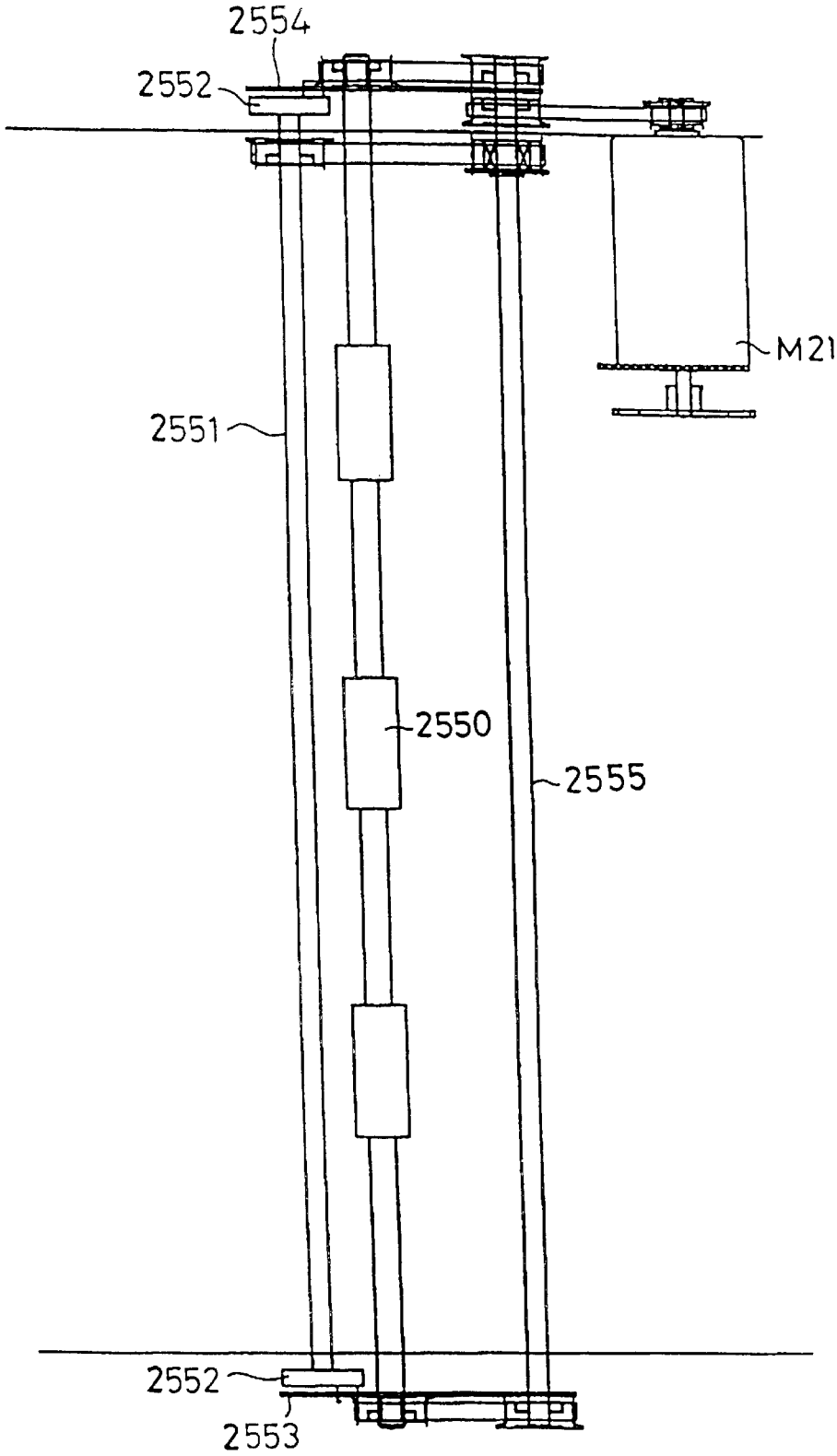
FIG. 17 is a plan view showing a switching mechanism for a movable delivery roller in the above sheet processing apparatus.
Figure 18:
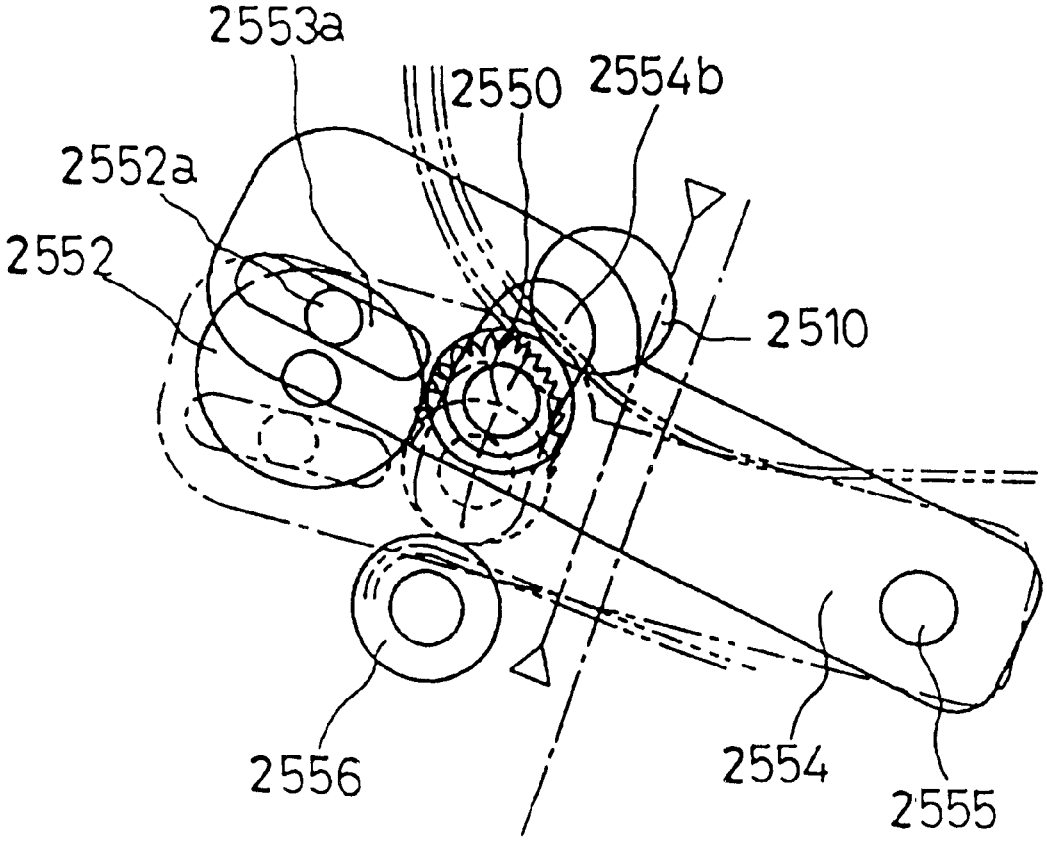
FIG. 18 is an enlarged side view showing essential portions in FIG. 17.

The movable delivery roller 2550 is located, as described above, between the main delivery roller 2510 and the bundle delivery roller 2556, makes a roller pair Pelectively at the rollers 2510, 2556 by switching contact to the rollers, and is constituted with a switching mechanism as shown in FIGS. 17, 18.

That is, with the structure in FIGS. 17, 18, this switching mechanism has one set of right and left rocker side plates 2553, 2554 for holding the movable delivery roller 2550. Each of the rocker side plates 2553, 2554 is formed with first long grooves 2553*a*, 2554*a* extending radially at the front end and second long grooves 2553*b*, 2554*b* extending in a circumferential direction at a midway portion, and is supported as to rock around a rocker shaft 2555 as a pendulum in operably connecting to the first drive motor M21 as a drive source. In the first long grooves 2553*a*, 2554*a*, engaged are shaft pins 2552*a*, 2552*a* of a set of rocker cams 2552, 2552 which are formed on an intermediate shaft 2551 rotatively driven by the motor M21, and a one way clutch is incorporated in a drive transmission of the first drive motor 21 where the movable delivery roller 2550 is held in the latter second long grooves 2553*b*, 2554*b*, so that drive force is made cutoff during sheet conveying period and transmitted to the cams only when rotating in the reverse direction.

In such a situation, the rocker cams 2952, 2552 are controlled to selectively stop during the sheet delivery at positions where the movable delivery roller 2550 comes in contact with the main delivery roller 2510 (solid line position in FIG. 17) and where the roller comes in contact with the bundle delivery roller 2556 (single dot chain line position in FIG. 17). Here, the movable delivery roller 2550 is urged by an elastic member or the like, not shown, toward the bundle delivery roller 2556 during delivery of sheet bundles, to make a nip distance automatically adjusted corresponding to the thickness of the bundle.

Figure 19:
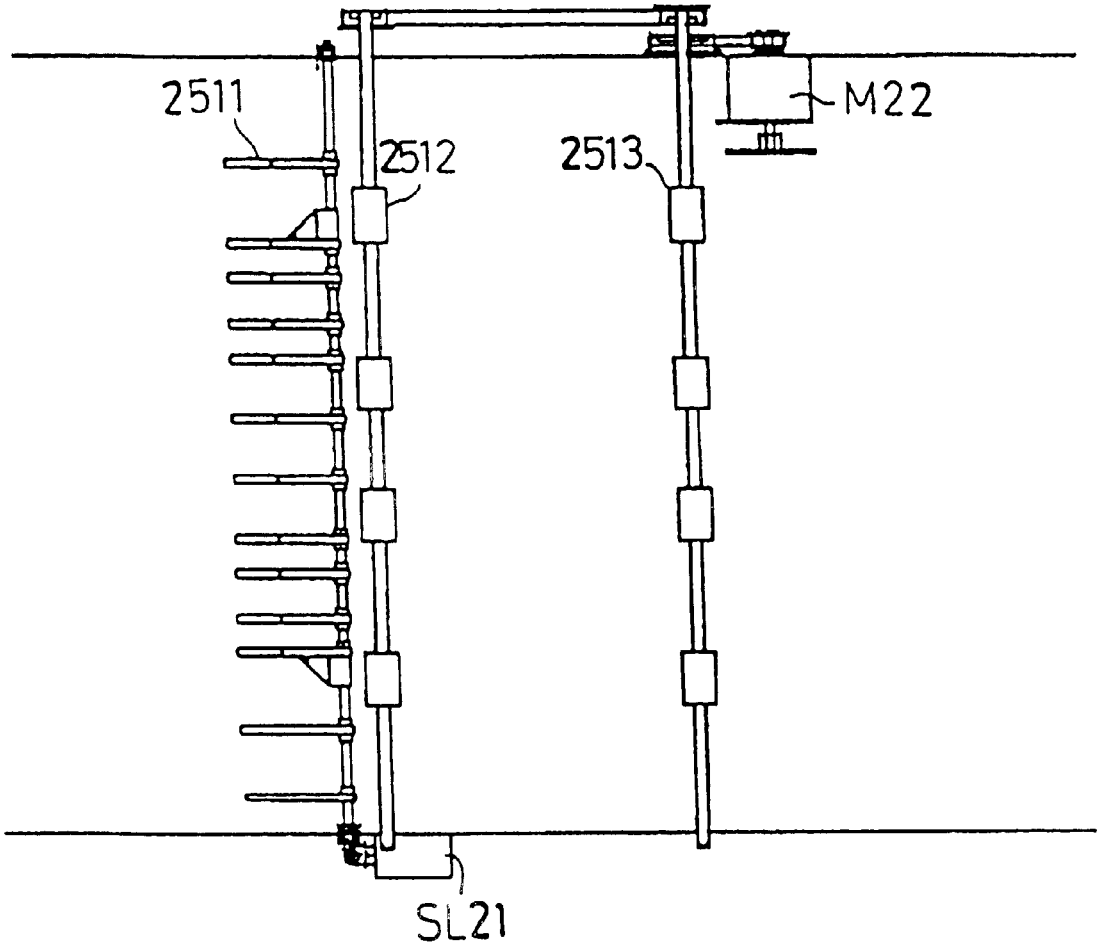
FIG. 19 is a plan illustration showing a buffer path including a switching flapper in the above sheet processing apparatus.

As shown in FIGS. 15, 19, the buffer path section III is formed with a second drive motor M22 for transmitting drive force to the relay roller pair 2512 and the second delivery roller pair 2513 and with a first drive solenoid SL 21 for driving a switching flapper 2511 for selectively switching sides of the first sheet delivery section I and the buffer path section III. The respective sweeping paddles 2514, 2515 disposed around the first and second delivery sections I, II, respectively, are driven for one turn by second and third drive solenoids SL22, SL23 not shown.

The pushers 2521 are formed as shown in FIGS. 15, 16 on a conveying belt 2520 wound with tension around a drive shaft 2522 driven by a third drive motor M23 and a driven shaft 2523, at two locations in parallel in the moving direction. The pushers have a mechanical structure, not shown, such that when the conveying belt 2520 moves in a counterclockwise direction (when the sheet bundle is conveyed to the left) the pushers are immobilized to the belt and when the belt moves in a clockwise direction (when moved to the front end of the sheet bundle temporarily stocked) the pushers can escape from the sheet stacking surface.

Figure 20:
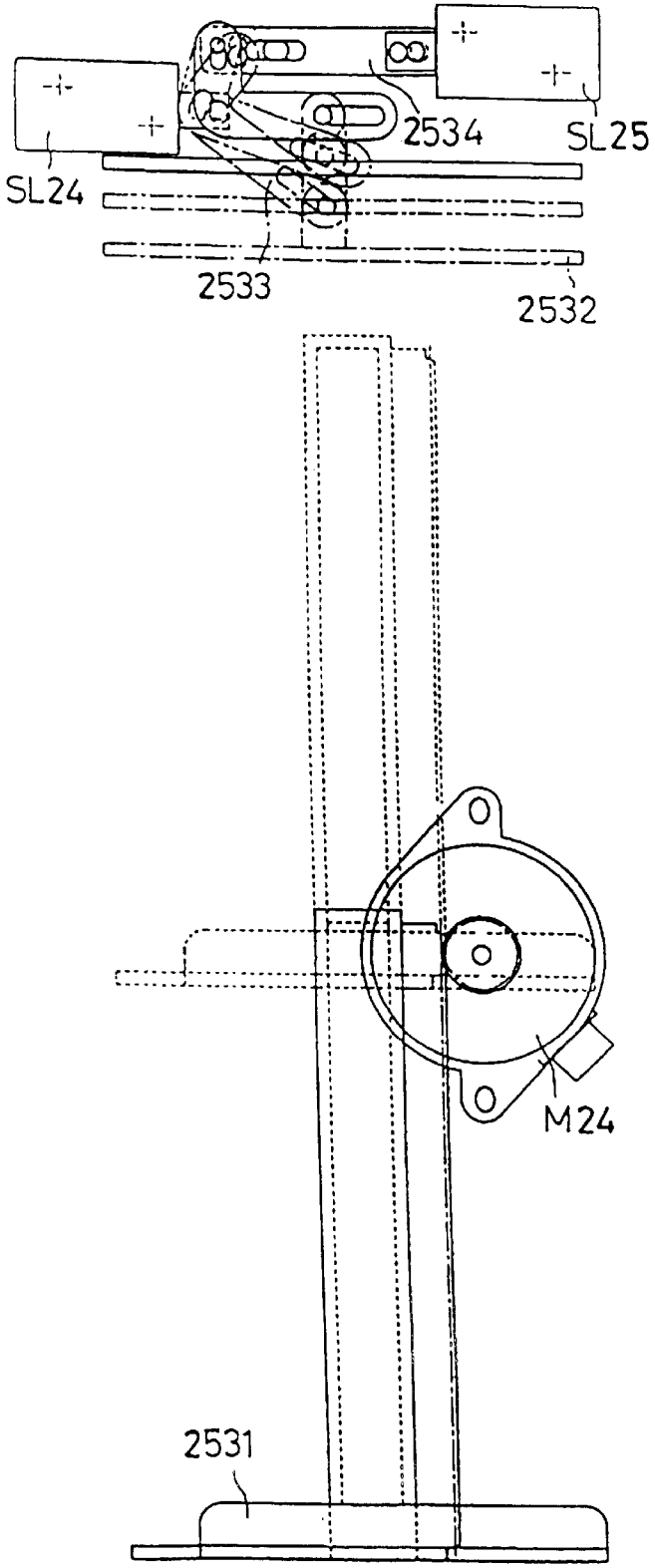
FIG. 20 is a plan illustration showing an operative situation of an aligning plate pair in the above sheet processing apparatus.

As shown in FIG. 20, the one alignment plate 2531 between the alignment plate pair 2531, 2532 can be driven by a fourth drive motor M24 so as to be linearly traveled according to the stapling mode and sheet size of the sheets delivered with the center reference, and the other alignment plate 2532 can be driven to selectively switch the position by fourth and fifth solenoids SL24, SL25 by way of respective link plates 2533, 2534 to be shifted to the three values as described below in accordance with the stapling mode and sheet size.

That is, more specifically, when stapling is made at a sheet corner and when stapling is made at two locations of A4 and A3 sheet sizes, the fourth and fifth drive solenoids SL24, SL25 are kept turned off to hold the one alignment plate 2531 and the other alignment plate 2532 at the solid line position in FIG. 20; when stapling is made at two locations of LTR and LDR size sheets, the fourth drive solenoid SL24 is turned on and the fifth drive solenoid SL25 is turned off to hold the other alignment plate 2532 upon moving the plate 2532 to a position of a double dot chain line in FIG. 20 in following movement of the one alignment plate 2531; when stapling is made at two locations of B4 and B5 size sheets, the fourth drive solenoid SL24 is turned on and the fifth drive solenoid SL25 is turned on to hold the other alignment plate 2532 upon moving the plate 2532 to a position of a single dot chain line in FIG. 20.

Figure 21:
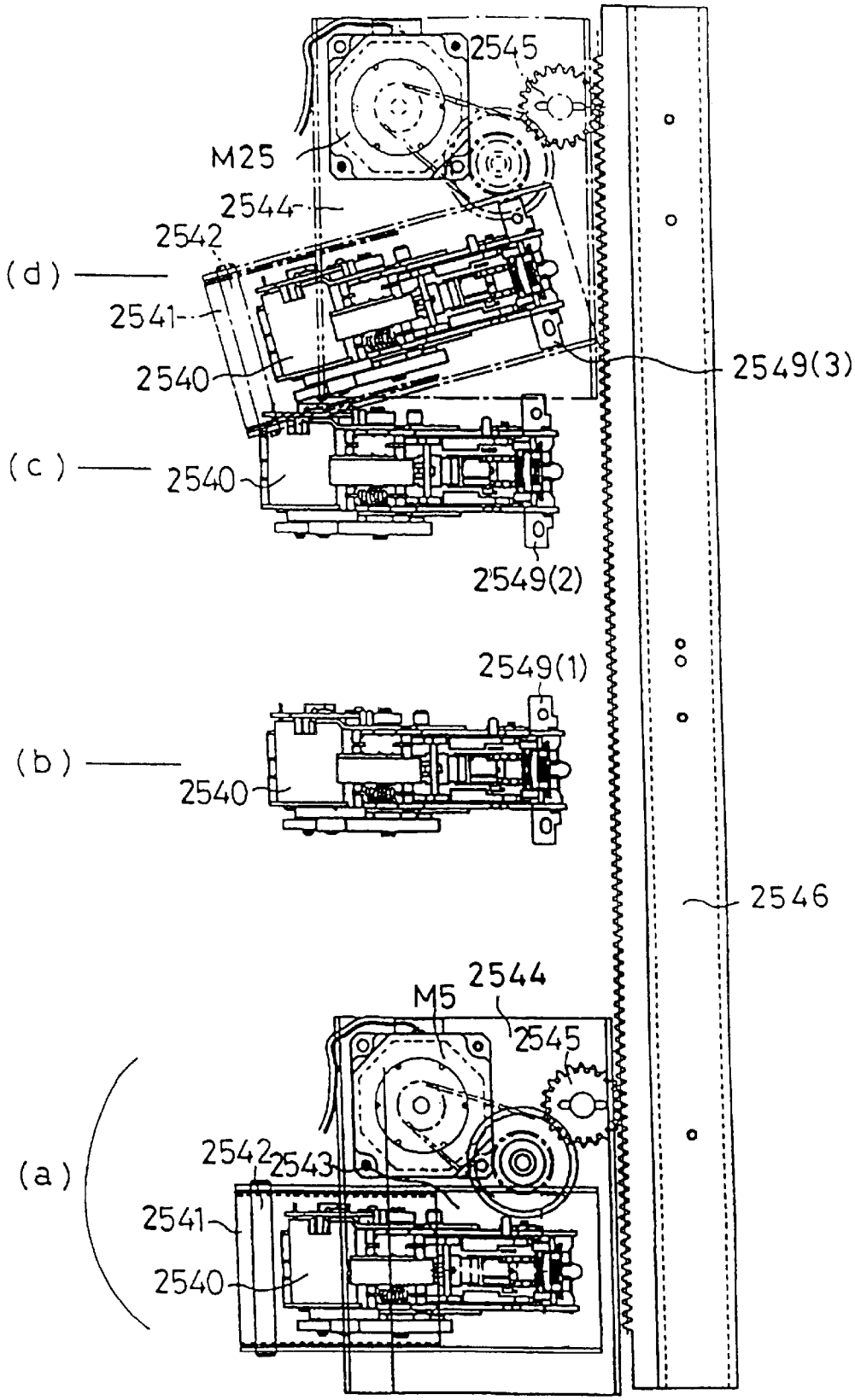
FIG. 21 is a plan illustration showing an operative situation of a stapler in the above sheet processing apparatus.
Figure 22:
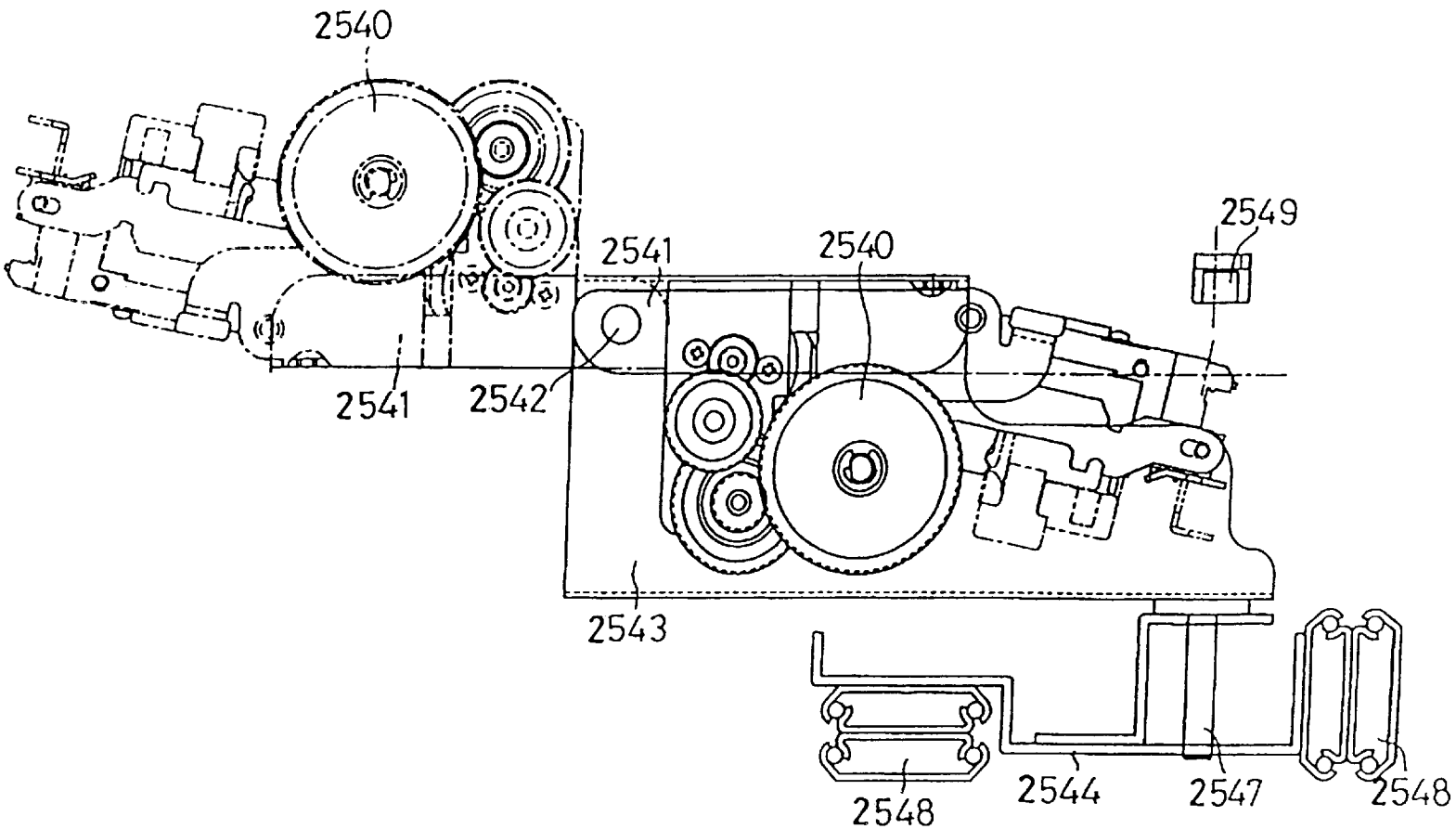
FIG. 22 is an enlarged side view showing essential portions in FIG. 9.
Figure 23:
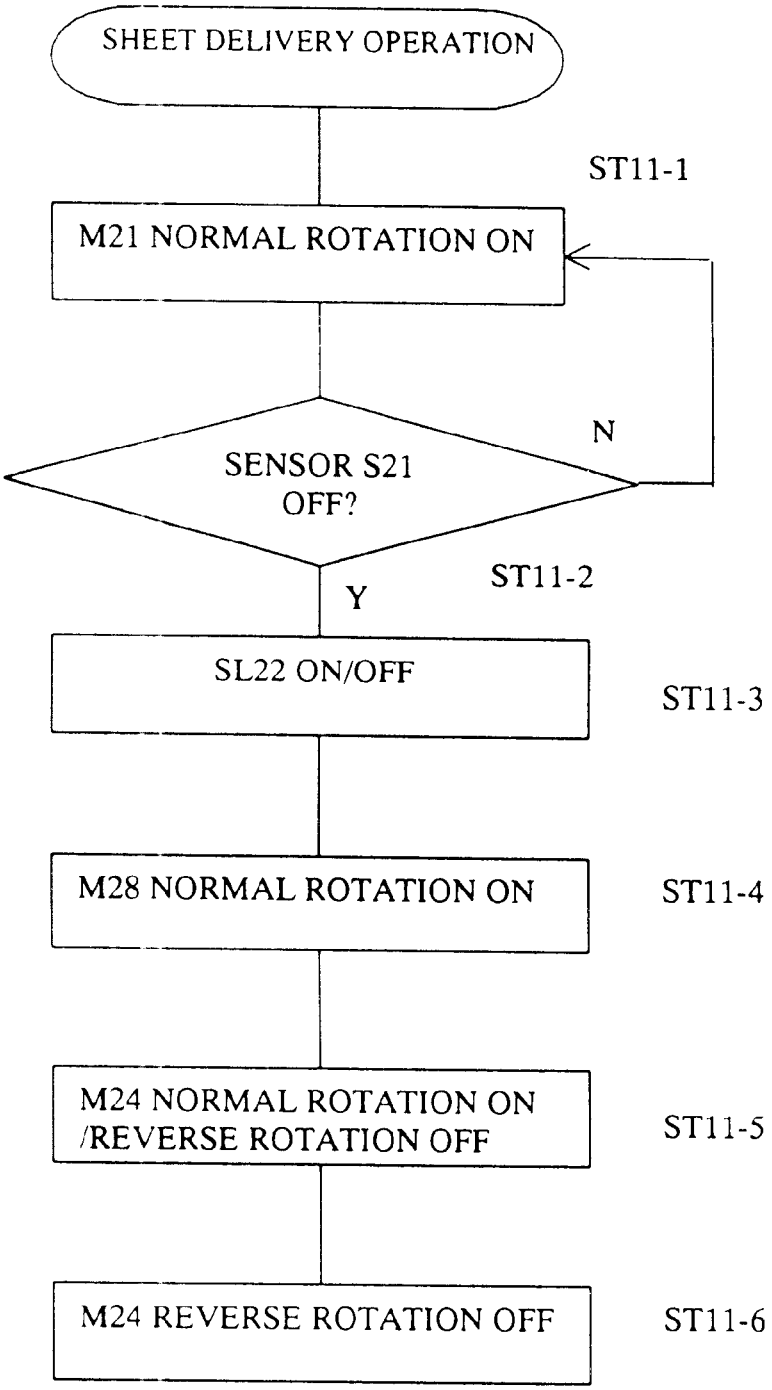
FIG. 23 is an operation flow for sheet delivery operation in the above sheet processing apparatus.
Figure 24:
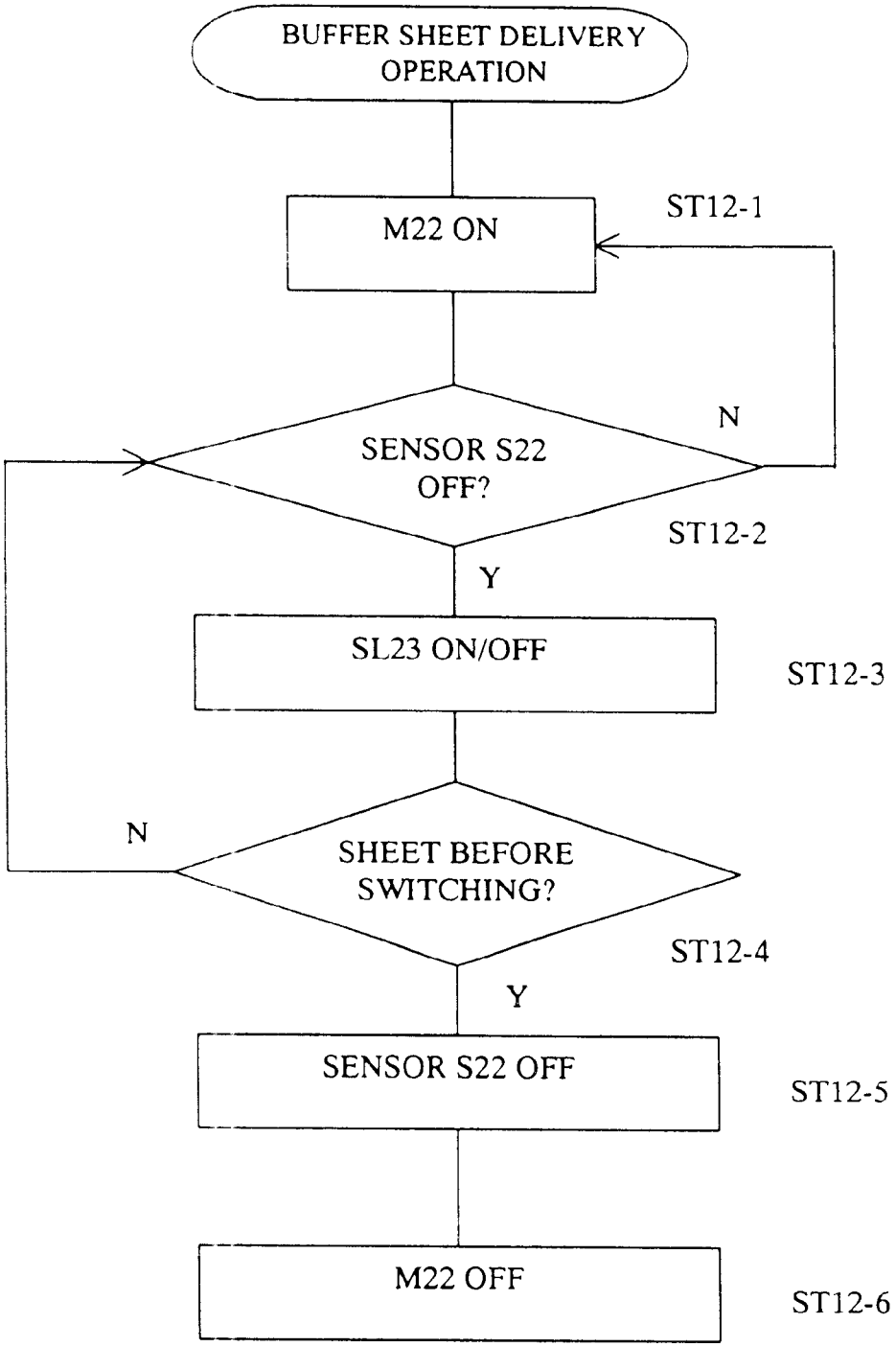
FIG. 24 is an operation flow for buffer sheet delivery operation in the above sheet processing apparatus.

The stapler 2540 is secured to a first bracket 2541 as shown in FIGS. 21, 22, and the first bracket 2541 is reversely pivotable to an up and down direction position (a single dot chain line position in FIG. 22) around a shaft 2542 extending horizontally as a pendulum fixed to a second bracket 2543. The second bracket 2543 is held pivotable to a horizontal direction position (a single dot chain line position equivalent to portion in FIG. 21) by way of a shaft 2547 extending vertically, with respect to a third bracket 2544 movable along a set of respective guide rails 2548, 2548 in a direction (front to rear direction, up and down direction on a paper surface of FIG. 21, equivalent to a direction perpendicular to a paper surface in FIG. 22) perpendicular to the sheet proceeding direction with respect to the apparatus frame not shown. A fifth drive motor M25 is arranged on the third bracket 2544, which is movable for a prescribed amount by rotating the final stage gear 2545 of the fifth drive motor M25 in meshing with a rack gear 2546 fixed to the apparatus frame.

In the case of the above stapler 2540, set position (a) in FIG. 21 is the home position, and set positions (b), (c) occupy a near position and a far position of the two location stapling with respect to set position (a), and similarly, set position (d) occupies a position during a corner stapling. Here, when it shifts from set position (c) to set position (d), the second bracket 2543 is pivotally moved in a horizontal direction by a prescribed angle by means of a cam means not shown, thereby positionally changing the stapler 2540 on the second bracket 2543 as to be in an oblique position (corresponding to a position for corner stapling) with respect to the sheet bundle. When the staple cartridge in the stapler 2540 is replaced or refilled, a user manually rotates the first bracket 2541, or the stapler 2540, in the reverse direction (single dot chain line in FIG. 22) at set position (a) as the home position, thereby bringing the cartridge opening of the stapler 2540 as to face up.

Anvils 2549 for stapling in cooperation with the stapler 2540 are formed at every set position where the stapler stops, or at total three positions, two positions for stapling positions 2549(1), 2549(2) for two stapling locations, and a position for corner stapling position 2549(3), and are individually adjustable for correlative positional shifts. The respective anvil positions corresponding to stapling positions 2549(1), 2549(2) for two locations are designed to be located closer to the stapler 2540 than the anvil position 2549(3)for the corner stapling position, thereby correcting an amount equal to bending occurring when a stay not shown for securing the anvils 2549 produces during stapling.

[Stacking Tray 2500*b*]

This stacking tray 2500*b* operates to move up and down (movable up and down by a sixth drive motor M26 not shown) one by one in following the stacked sheet bundle to keep constant the stacked level at a time of delivery, and performs an offset operation (driven by the sixth drive solenoid SL26 not shown) alternatively in a direction perpendicular to a delivery direction to distinguish the respective bundles of the stacked bundles.

[Sensors for Operation Controls]

As sensors for operation controls, the apparatus has a first sensor S21 disposed on a downstream side of the first sheet delivery section I, a second sensor S22 disposed on a downstream side of the second sheet delivery section II, and a third sensor S23 disposed on a downstream side of the sheet bundle delivery section. Each drive motor has a rotation amount detection sensor disposed at each drive motor for detecting the rotation amount of each drive motor.

Now referring to FIG. 13 to FIG. 16, operations of the above apparatus structure are described.

FIGS. 23 to 28 are operation flows charts for describing outlines of operations of the apparatus system in this embodiment.

[Sheet Delivery Operation (Corresponding to Operation Flow Shown in FIG. 23)]

In this sheet delivery operation, the switching flapper 2511 is selectively switched toward the first sheet delivery section I by the first drive solenoid SL21, and the movable delivery roller 2550 is selected as to contact to the main delivery roller 2510. Under this situation, the first drive motor M21 is turned on, and the delivered sheet on which images are formed is introduced from the first sheet delivery section I to the delivery section side on the sheet stacking guide 2517, and the second drive solenoid SL22 is turned on upon detecting the sheet rear end with the first sensor S21, thereby operating the first sweeping paddle 2514. At the same time, the alignment plate pair 2531, 2532 are driven to align sheets, and then, the apparatus prepares for the subsequent sheet delivery.

[Buffer Sheet Delivery Operation (Corresponding to Operation Flow Shown in FIG. 24)]

In this buffer sheet delivery operation, the switching flapper 2511 is selectively switched toward the buffer path section III by the first drive solenoid SL21, and the movable delivery roller 2550 is selected as to contact to the main delivery roller 2510. Under this situation, the second drive motor M22 is turned on, and the delivered sheet on which images are formed is introduced from the buffer path section III to the non-delivery section side on the sheet stacking guide 2517 via the second sheet delivery section II. Upon detection of the sheet rear end with the first sensor S21, as the third drive solenoid SL23 is turned on to operate the second sweeping paddle 2515, and after the sheet front end is received in hitting the stationary stopper 2524, the apparatus prepares for the subsequent sheet. When the sheet is before switching, the sweeping paddle does not operate, thereby reducing the switching period.

The respective rotation speeds of the relay roller pair 2512 and the second delivery roller pair 2513 of the buffer path section III, or namely, conveying speeds of the sheets, are designed slightly faster than the rotation speed of the receiving roller pair 2151 in the switch back path 2150, to make wider intervals of the sheets conveyed one by one. A one way clutch is incorporated in the drive transmission section of the receiving roller pair 2151 and allows the sheet in a midway of conveyance to be easily pulled away while the sheet is nipped by the receiving roller pair 2151 and the relay roller pair 2512.

[Buffer Switching Operation (Corresponding to Operation Flow Shown in FIG. 25)]

In switching operation to this buffer, when it is the last original document, the first drive solenoid SL21 is turned on, and after the switching flapper 2511 is operated from the first sheet delivery section I to the buffer path section III to switch the sheet conveying route, the above buffer sheet delivery operation is performed, and at the same time, the processing operation at the first sheet delivery section I is executed.

[Preparation Operation for Stapling Sheets by Means of a Stapler]

When the stapling mode is selected, the stapler 2540 is moved in advance by drive of the fifth drive motor M25 to the corresponding position.

Subsequently, the pushers 2521 holding the sheet bundle at the alignment position are driven by the third driven motor M23 to move the sheet bundle to the predetermined stapling position. With respect to the alignment position of the pushers 2521, they are made different according to the sheet size as to keep constant the rear end of the sheets when delivered, but with respect to the stapling position, they are constant notwithstanding the sheet size and can be changed according to the stapling mode. More specifically, because the distance between the staple end surface and sheet end surface is different between in a case of the corner stapling and in a case of the two location stapling, the entry amount of the sheet bundle to the stapler 2540 is made different to equalize the above distances.

After the pusher 2521 is moved, the movable delivery roller 2550 is rocked toward the bundle delivery position by reversing rotation of the first drive motor M1, thereby nipping the sheet bundle in contacting to the bundle delivery roller 2556. The sheet bundle is transferred between the pushers 2521 to the bundle delivery section before the sheet bundle is stapled, so that the processing time is reduced.

After transfer of the sheet bundle, the pushers 2521, instead of tho stationary stopper 2524, limit the sheet front ends delivered at the second sheet delivery section II after escaped to the position of the stationary stopper 2524 to move the sheet bundle stacked on the second sheet delivery section II.

On the other hand, the sheet bundle delivered at the first sheet delivery section I is delivered as a bundle by rotating the first drive motor M21 in the normal direction (operation flow in FIG. 28) after the staple operation, and after completion of the delivery operation, the motor is reversed again to rock the movable delivery roller 2550 temporarily toward the delivery position. After immediately rotated in the normal direction, the first drive solenoid SL21 is turned off to back the switching flapper 2511 toward the first sheet delivery section I, thereby allowing the sheet to be delivered to the first sheet delivery section I.

After completion of delivery through the second sheet delivery section II, the pushers 2521 makes the sheet bundle in the second sheet delivery section II move to the sheet stacking position at the first sheet delivery section I, and prepares the next sheet bundle delivery operation from the first sheet delivery section I.

[Staple Operation (Corresponding to Operation Flow in FIG. 26)]

During this staple operation, disorder of the sheet bundle due to impacts from stapling is prevented by operation of the alignment plate pair 2531, 2532, and the alignment plate pair 2531, 2532 are moved to the alignment position during operation of the clinch motor in the stapler 2540.

[Up and Down Operation of the Stacking Tray (Corresponding to Operation Flow in FIG. 25)]

To make the delivery level of the sheet bundle constant, the tray level of the stacking tray 2500*b* is moved down for a prescribed amount by the sixth drive motor M26 not shown after bundle delivery completion and is moved up to a position where the paper surface detection sensor S24 not shown is turned on again. The position of the stacking tray 2500*b* is switched between the home position and the offset position depending on whether the next sheet bundle is even number bundle or not.

[Respective Operation Flows According to Sheet Size]

(A4 and LTR and the like, in a case of half size sheets)

Figure 25:
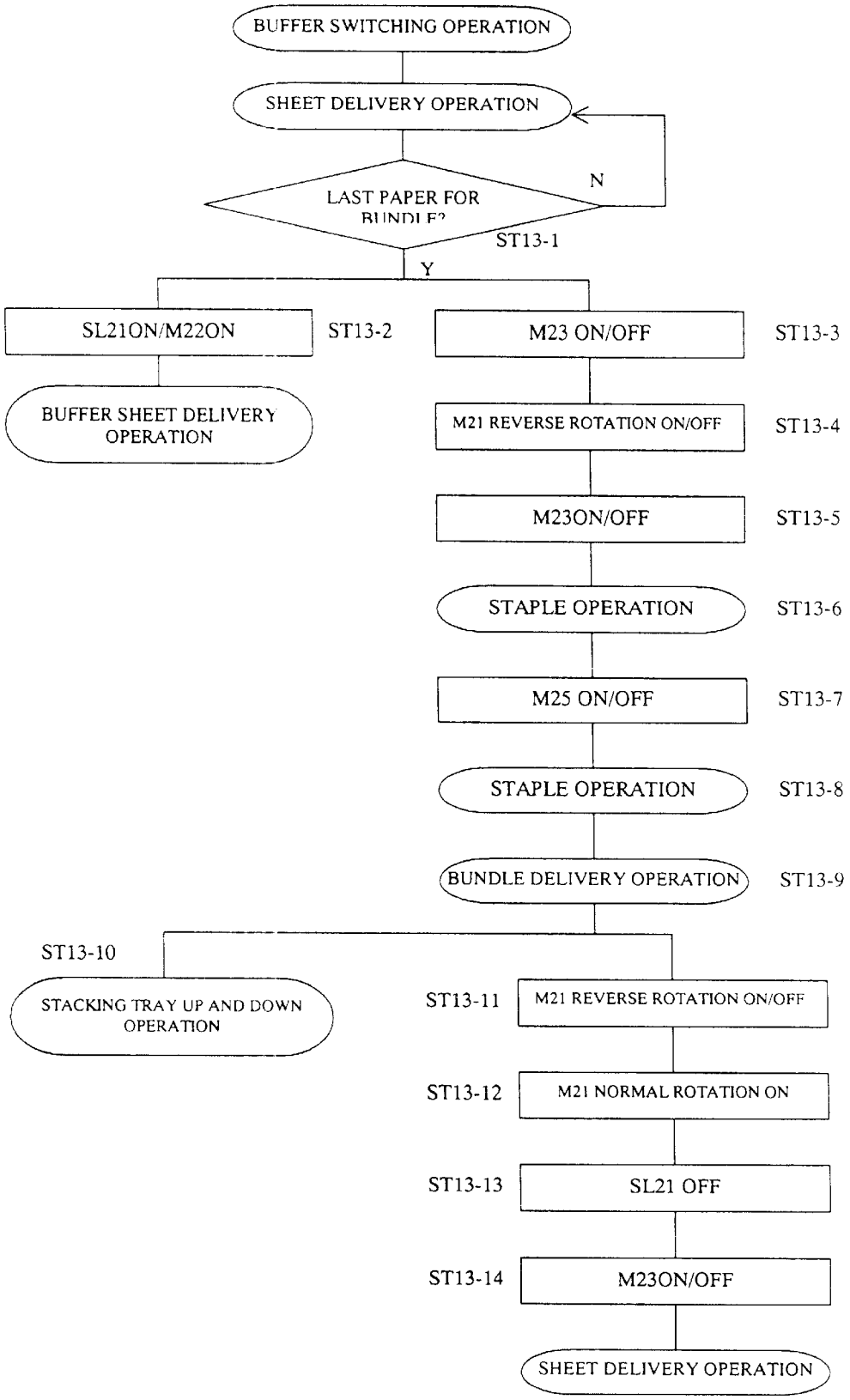
FIG. 25 is an operation flow for buffer switching operation in the above sheet processing apparatus.
Figure 26:
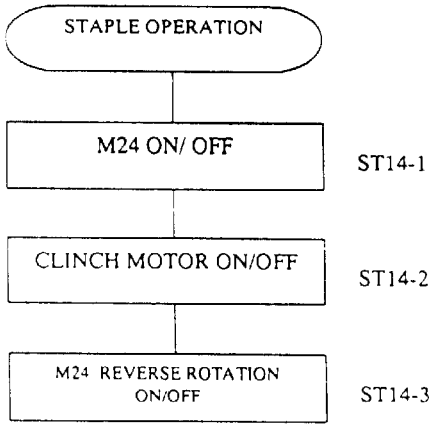
FIG. 26 is an operation flow for staple operation in the above sheet processing apparatus.
Figure 27:
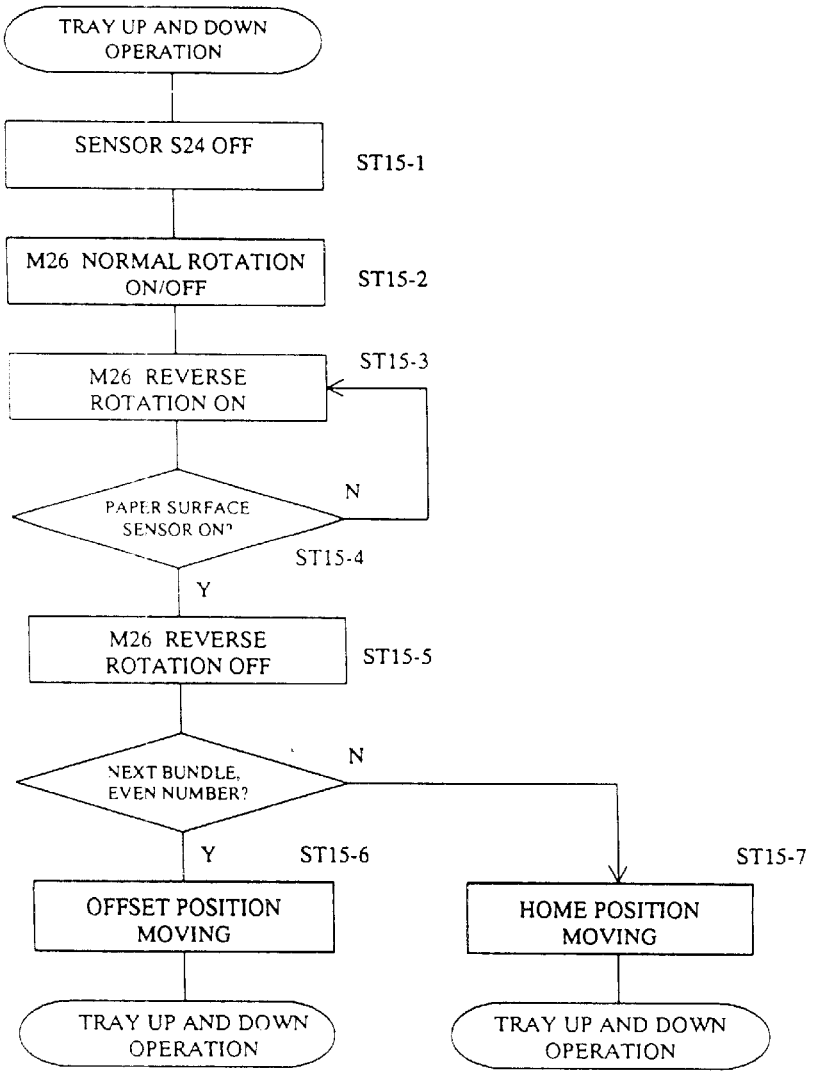
FIG. 27 is an operation flow for stacking tray up and down operation in the above sheet processing apparatus.
Figure 28:
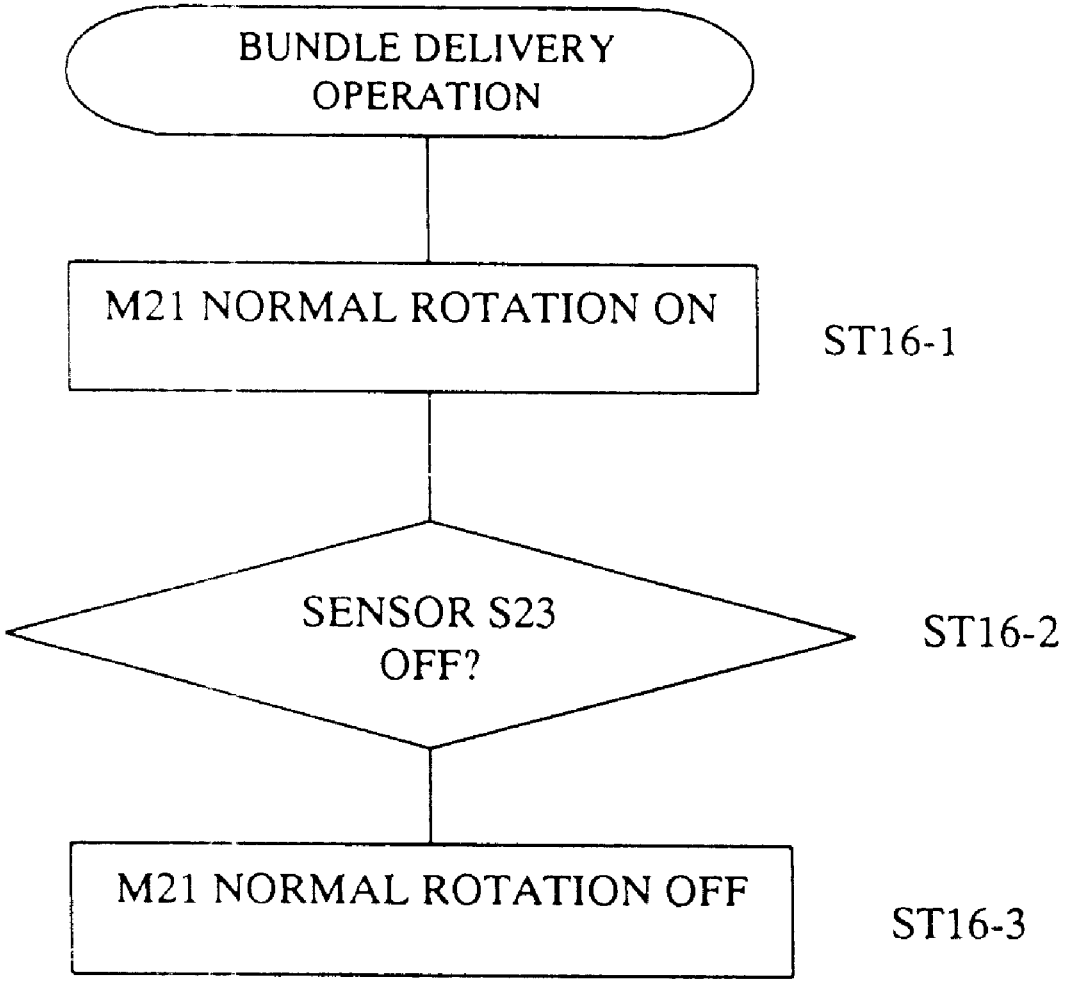
FIG. 28 is an operation flow for bundle delivery operation in the above sheet processing apparatus.

In this embodiment, the above buffer switching operation is executed only for half size sheets. As the operation flow, as shown in FIG. 25, after completion of delivery to and stacking on the first sheet delivery section I, the apparatus implements the processing operation such as stapling or the like to the sheet bundle, and the sheet from the image forming section main portion is temporarily delivered to and stacked on the second sheet delivery section II. After completion of the processing operation and the bundle delivery to the tray, the sheet bundle from the second sheet delivery section II is conveyed as a bundle to the first sheet delivery section I, and the remaining sheets are delivery and stacked at the first sheet delivery section I. The above operations are repeated until delivery of the final sheet, and then jobs ends.

(A3 and LDR and the like, in a case of large size sheet)

After completion of the above sheet delivery operation, an "image formation temporarily stop signal" is outputted from a Controller, not shown, in the sheet processing apparatus to a controller, not shown, of the image forming apparatus, thereby temporarily stopping the sheet conveyance from the image forming apparatus main body, and the above staple operation and bundle delivery operation are executed for the sheet bundle.

After completion of the processing operation and the bundle delivery operation to the stacking tray, an "image forming restart signal" is outputted, and the above sheet delivery operation is executed to deliver and stack sheets on the first delivery section I.

[Respective Operation Flow According to Copying Modes]

(In a case of a single side copying)

The description would be the same as the above respective flows according to the sheet size, and therefore, is omitted.

(In a case of a double side copying)

As described above, with respect to image formation for double sides of a sheet in an image forming section, the images are formed on the other side upon that images are formed on the one side by way of the switch back path, and the reverse path, and then, since the sheet on both sides of which images are formed is conveyed to the processing tray, the distance between the sheets becomes longer. Therefore, because the above buffer switching operation is not necessary to be executed again (processing operation can be done between a forgoing sheet and a following sheet), the sheet size does not matter, and the sheets are delivered by the same operation flow as in a case of the large size sheet, A3 and LDR and the like.

Figure 29:
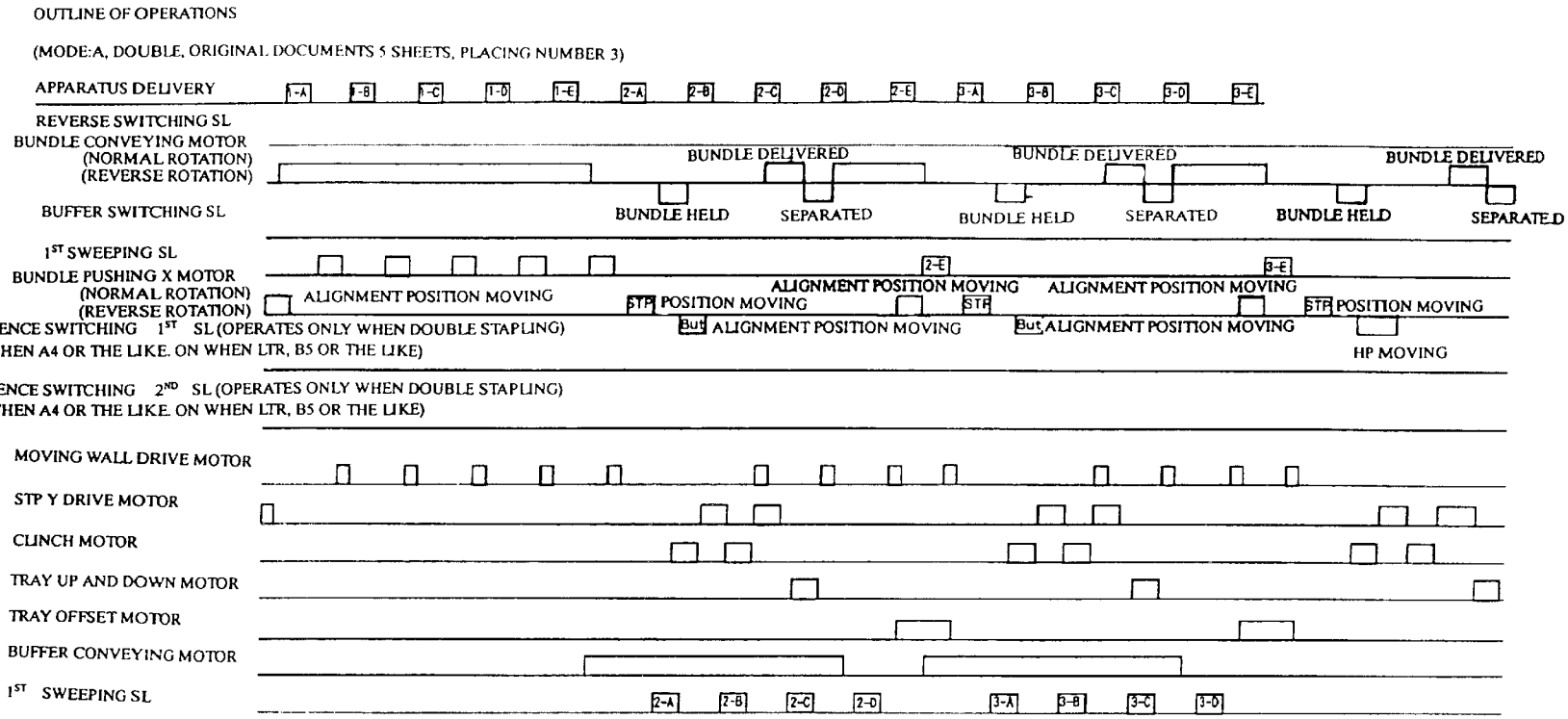
FIG. 29 is a timing chart for describing operation timings of the above image forming apparatus system.

FIG. 29 shows an outline of a timing chart where the processing is made under [sheet size: A4, stapling mode: two locations, original document number: five sheets, placing number: 3], as a series of timings for respective above operations.

Fifth Embodiment

Hereinafter, referring to the drawings, the fourth embodiment of a sheet processing apparatus according to this invention and an image forming apparatus having this is described.

Figure 30:
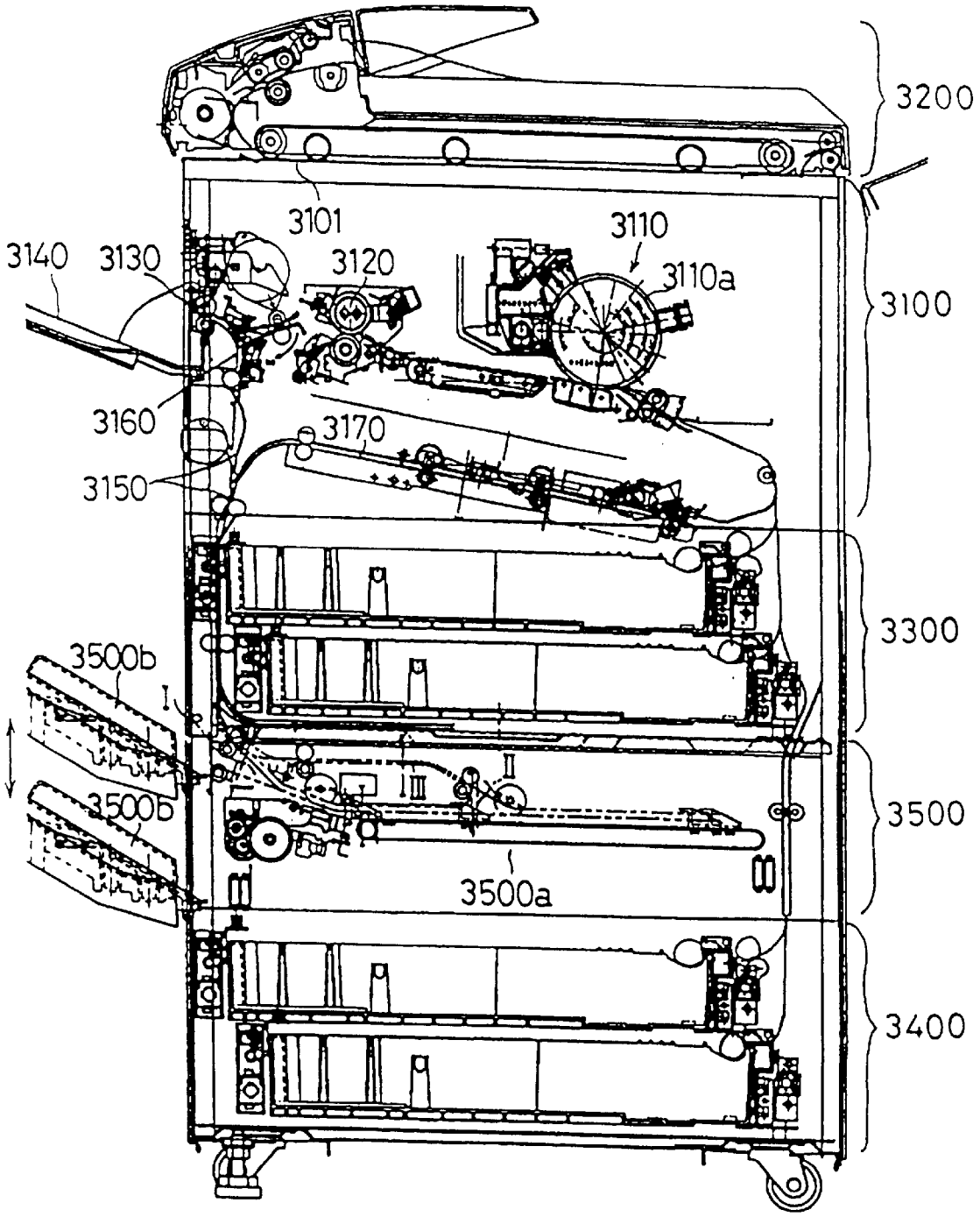
FIG. 30 is a cross section showing a schematic entire structure of an image forming apparatus system to which a sheet processing apparatus of the fifth embodiment according to the invention applies.

FIG. 30 is a cross section showing a schematic entire structure of an image forming apparatus system to which a sheet processing apparatus according to this embodiment applies In the apparatus structure in FIG. 30, this image forming apparatus system has an image forming section 3100, a original document conveying apparatus 3200, first and second feeding sections 3300, 3400, and a finisher section 3500.

The image forming section 3100 transfers images on sheets as transfer materials selectively supplied from the first feeding section 3300 or second feeding section 3400.

The original document conveying apparatus 3200 separates one sheet from the original document bundle stacked on a original document tray and feeds the separated original document to an image reading section 3101 arranged at a ceiling of the image forming section 3100. On the other hand, the first and second feeding sections 3300, 3400 separate one sheet from respective sheet bundles on the respective sheet cassettes set inside the sections and convey the separated sheet to the image forming section 3110 having a photosensitive drum 3110*a* as an essential structural member via a right side portion in the drawing of the image forming section 3100.

The sheet on which images are formed at the image forming section 3110 is further delivered on a delivery tray (stacking tray) 3140 disposed outside an apparatus delivery section, or namely, a first apparatus delivery section 3130, after the transferred images are fixed at an image fixing section 3120 located on a downstream side, and is stacked thereon.

When images are to be formed on double sides of a sheet, a sheet on one side of which images are formed is reversed in a switch back manner by a switch back path 3150 branching at a sheet deflecting section 3160 formed on a downstream side of the image fixing section 3120 and by a transferring roller pair 3151 located in the switch back path 3150, and the sheet is fed again to the image forming section 3110 from the right side of the apparatus by way of a reversing path 3170. The same processes are repeated thereafter to form images on the other side of the sheet, and the sheet is delivered finally on the delivery tray 3140.

The downstream portion of the switch back path 3150 serves as a coupling portion for the finisher section 3500 which is a featured portion of the invention, and constitutes the second apparatus delivery section for delivery to the outside. The finisher section 3500 is constituted from a combination of a processing tray section 2500*a* and stacking tray section 3500*b*, and in this situation, the processing tray section 3500*a* is disposed below the image forming section 3100 between the first feeding section 3300 and the second feeding section 3400.

Referring to FIGS. 31 to 39, the finisher section 3500 will be described in detail next.

First, structures of the essential portions are described.

Figure 31:
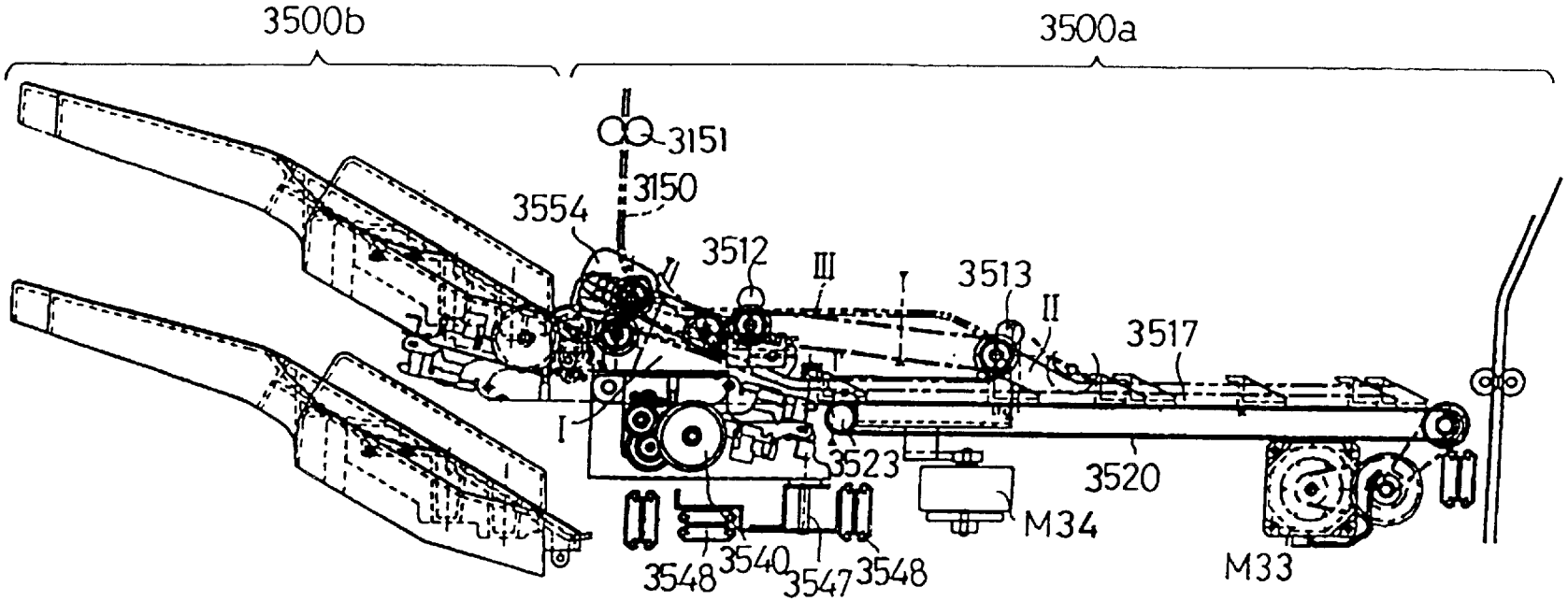
FIG. 31 is a cross section showing a schematic entire structure of the sheet processing apparatus system in the above embodiment.
Figure 32:
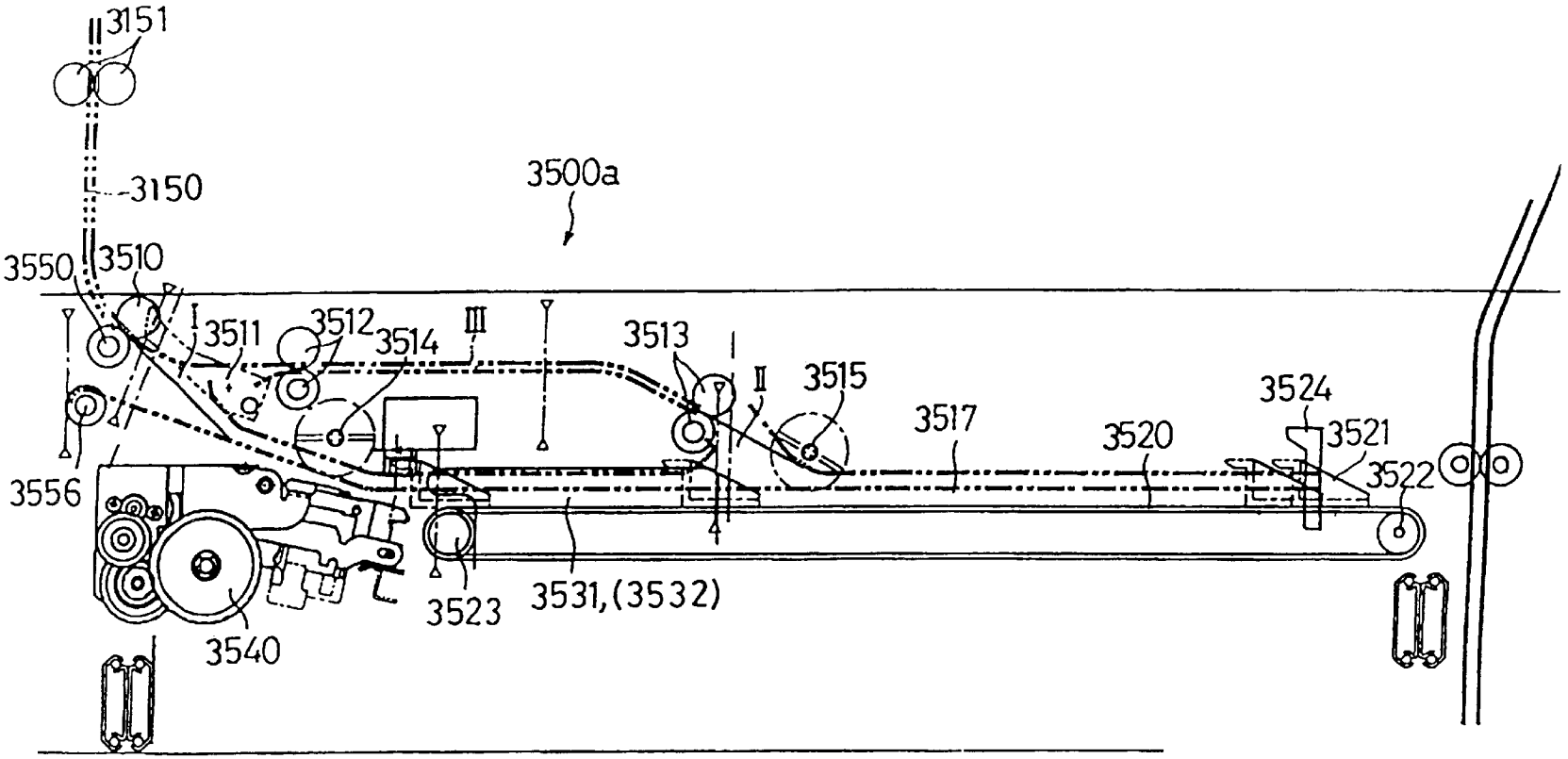
FIG. 32 is a detailed cross section showing a structure of essential portions in the above sheet processing apparatus.
Figure 33:
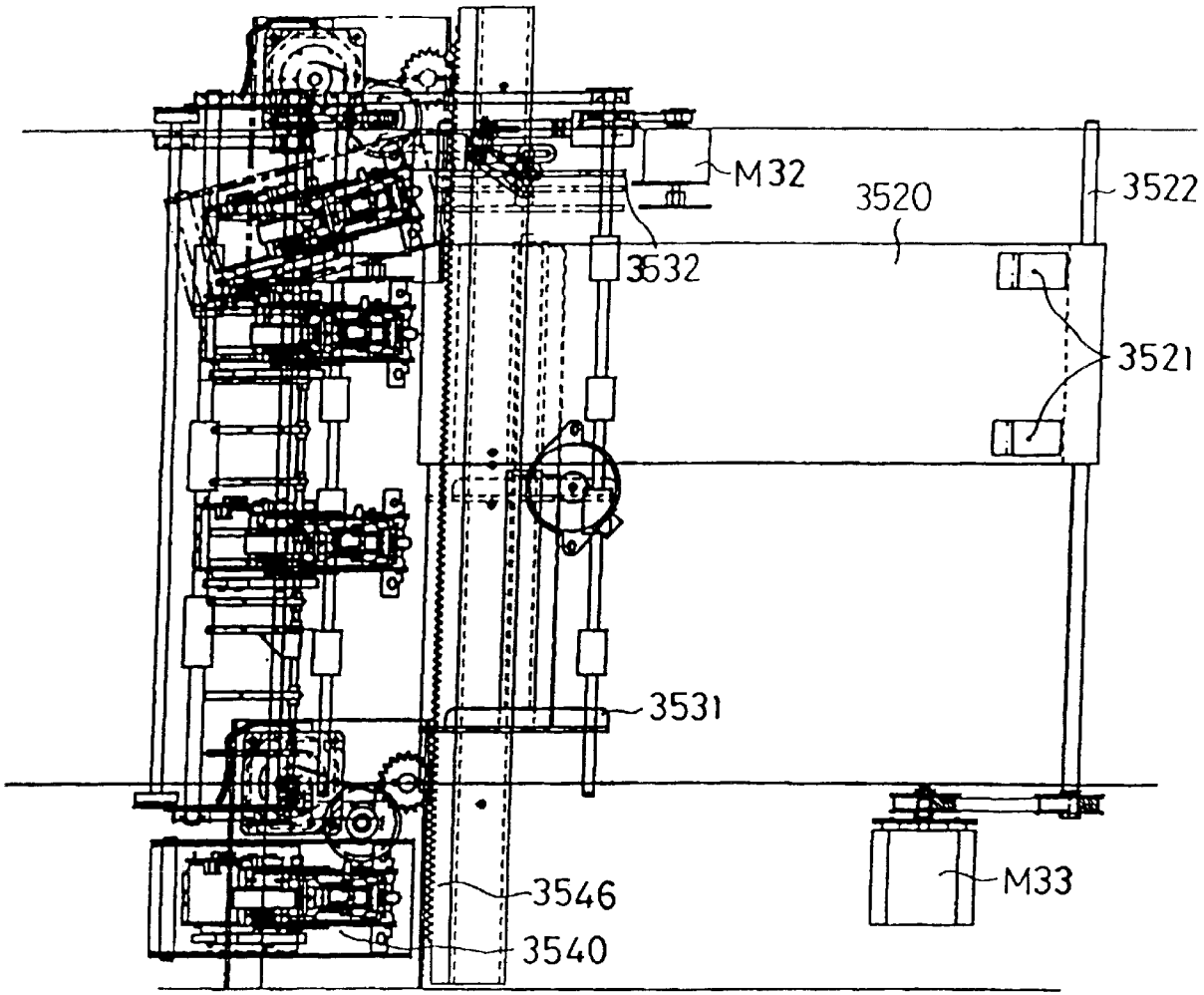
FIG. 33 is a detailed plan view showing the essential portions in FIG. 32.

FIG. 31 is a cross section showing a schematic entire structure of the sheet processing apparatus system according to the fifth embodiment; FIG. 32 is a detailed cross section showing a structure of essential portions in the above sheet processing apparatus system; and FIG. 33 is a detailed partial plan view showing the essential portions in the above sheet processing apparatus system. FIGS. 34 to 39 are illustrations showing detailed structures of respective sections in the above sheet processing apparatus system.

[Processing Tray Section 3500*a*]

In this processing tray section 3500*a*, the conveying route for sheets on which images are formed is constituted of a first conveying route in which sheet bundles are conveyed, after completion of processing at the first sheet delivery section I where the sheets conveyed through the switch back path 3150 are delivered from the first sheet delivery section I and stacked temporarily on a delivery side (left side in FIGS. 32, 33) on a sheet stacking guide 3517, again to the stacking tray section 3500*b*, and a second conveying route in which sheet bundles are conveyed, after completion of processing at the first sheet delivery section I where the sheets conveyed are delivered from a buffer path III through a second sheet delivery section II and stacked temporarily on a non-delivery side (right side in FIGS. 32, 33) on the sheet stacking guide 3517 for temporarily stacking conveyed transfer materials while the sheets are delivered and stacked at the first sheet delivery section I from the first route and the sheets are delivered as a bundle to the stacking tray section 3500*b* after processing.

In this situation, the sheet conveying means has a main delivery roller 3510, a movable delivery roller 3550 capable of contacting to the main delivery roller 3510 upon selective switching as described below in detail, which are serving as a first delivery roller pair for delivering sheets toward the first delivery section I, a first sweeping paddle 3514 for surely stacking delivered sheets on the sheet stacking guide 3517 on a side of the delivery section, and a pair of alignment plates 3531, 3532 for aligning the delivered sheets.

The means also has a switching flapper 3511 for switching the first sheet delivery section I and the buffer path section III with each other, which are conveying paths, respectively, a relay roller pair 3512 located in the buffer path section III, a second delivery roller pair 3513 for delivering sheets from the buffer path section III to the second sheet delivery section II, a second sweeping paddle 3515 for surely stacking sheets which are delivered to the second sheet delivery section II on the sheet stacking guide 3517 on a side of the non-delivery section, and a stationary stopper 3524 for limiting temporarily the edges of the sheets delivered from the second sheet delivery section II.

The means further has pushers 3521 for limiting the edges of the sheets at the first sheet delivery section I, for conveying sheet bundles that already stacked to a processing position, and for conveying sheet bundles located at the second sheet delivery section II, a bundle delivery roller 3556 constituting a bundle delivery roller pair for holding the sheet bundle in nipping the sheet bundle at the stapling processing position and delivering the sheet bundles on the stacking tray 3500*b* after the stapling processing, and the above movable delivery roller 3550, as well as the above, capable of contacting to the bundle delivery roller 3556 upon selective switching.

Meanwhile, a sheet processing section for processing the sheet bundle on the sheet stacking guide 3517 is provided around the first sheet delivery section I for processing sheet bundles on the sheet stacking guide 3517 and is constituted, in this case, of a stapler 3540 and an alignment plate pair 3531, 3532.

The operation position of the stapler 3540 is in a region for stacking sheets delivered from the first sheet delivery section I but out of a region for stacking sheets delivered from the second sheet delivery section II, and the position is located between the stacking region for sheets from the second delivery section II and the stacking tray section 3500*b*. The alignment plate pair 3531, 3532 is located at a position as to operate with sheets in the stacking region for sheets from the first sheet delivery section I and as not to operate with sheets in the stacking region for sheets from the second delivery section II and is so designed as not to raise any problem upon that the sheets delivered from the second sheet delivery section II are unnecessarily restricted during the sheet alignment in order to prevent the stacked bundles from losing their order during the staple operation.

[Detailed Structures of Essential Portions]

Figure 34:
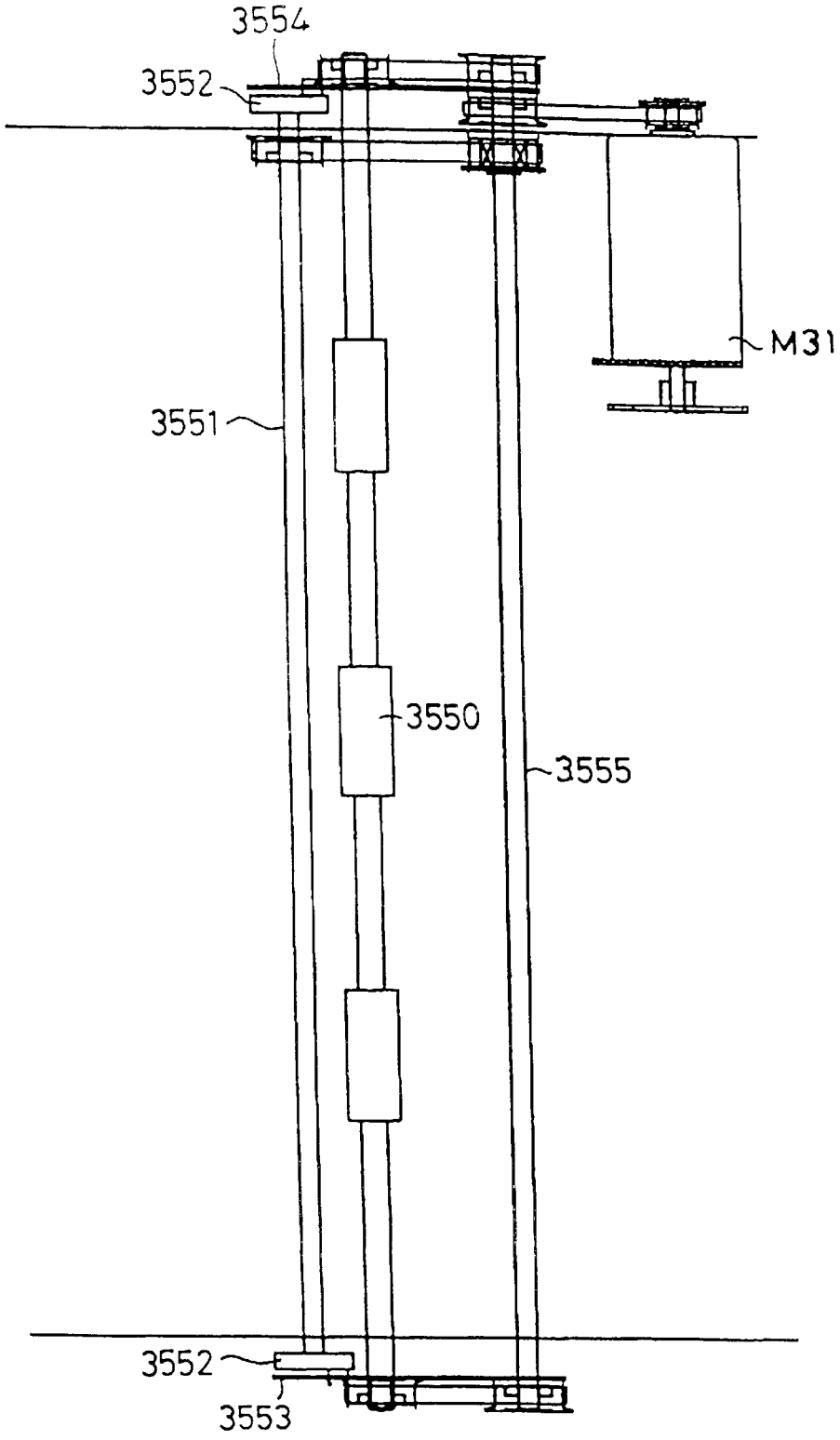
FIG. 34 is a plan view showing a switching mechanism for a movable delivery roller in the above sheet processing apparatus.
Figure 35:
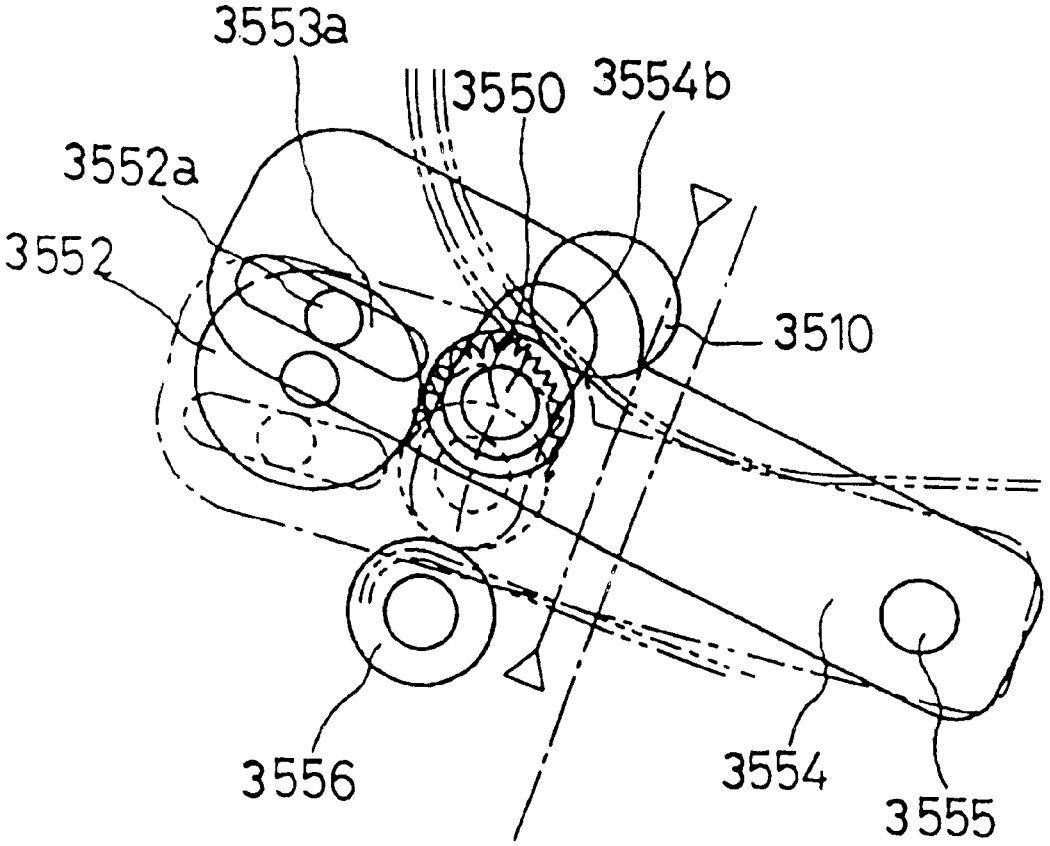
FIG. 35 is an enlarged side view showing essential portions in FIG. 34.

The movable delivery roller 3550 is located, as described above, between the main delivery roller 3510 and the bundle delivery roller 3556, makes a roller pair selectively at the rollers 3510, 3556 by switching contact to the rollers, and is constituted with a switching mechanism as shown in FIGS. 34, 35.

That is, with the structure in FIGS. 34, 35 this switching mechanism has one set of right and left rocker side plates 3553, 3554 for holding the movable delivery roller 3550. Each of the rocker side plates 3553, 3554 is formed with first long grooves 3553*a*, 3554*a* extending radially at the front end and second long grooves 3553*b*, 3554*b* extending in a circumferential direction at a midway portion, and is supported as to rock around a rocker shaft 3555 as a pendulum in operably connecting to the first drive motor M31 as a drive source. In the first long grooves 3553*a*, 3554*a*, engaged are shaft pins 3552*a*, 3552*a* of a set of rocker cams 3552, 3552 which are formed on an intermediate shaft 3551 rotatively driven by the motor M31, and a one way clutch is incorporated in a drive transmission of the first drive motor 31 where the movable delivery roller 3550 is held in the latter second long grooves 3553*b*, 3554*b*, so that drive force is made cutoff during sheet conveying period and transmitted to the cams only when rotating in the reverse direction.

In such a situation, the rocker cams 3552, 3552 are controlled to selectively stop during the sheet delivery at positions where the movable delivery roller 3550 comes in contact with the main delivery roller 3510 (solid line position in FIG. 34) and where the roller comes in contact with the bundle delivery roller 3556 (single dot chain line position in FIG. 34). Here, the movable delivery roller 3550 is urged by an elastic member or the like, not shown, toward the bundle delivery roller 3556 during delivery of sheet bundles, to make a nip distance automatically adjusted corresponding to the thickness of the bundle.

Figure 36:
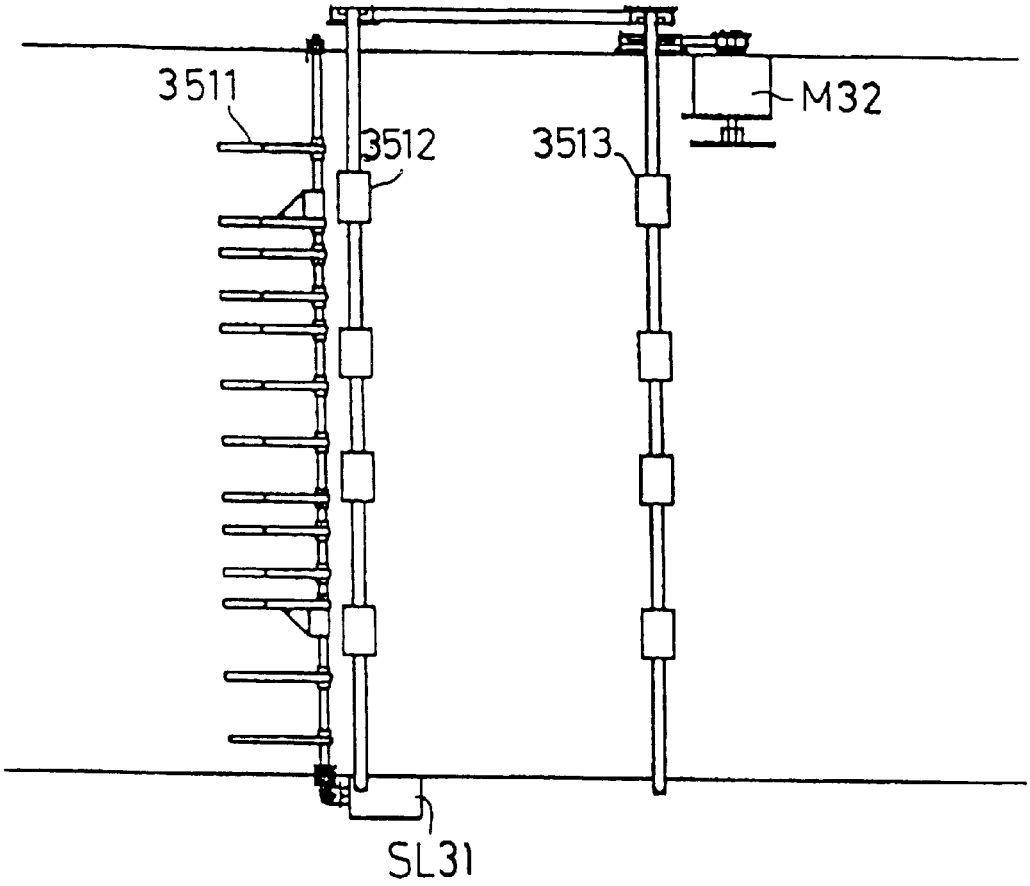
FIG. 36 is a plan illustration showing a buffer path including a switching flapper in the above sheet processing apparatus.

As shown in FIGS. 32, 36, the buffer path section III is formed with a second drive motor M32 for transmitting drive force to the relay roller pair 3512 and the second delivery roller pair 3513 and with a first drive solenoid SL31 for driving a switching flapper 3511 for selectively switching sides of the first sheet delivery section I and the buffer path Section III. The respective sweeping paddles 3614, 3615 disposed around the first and second delivery sections I, II, respectively, are driven for one turn by second and third drive solenoids SL32, SL33 not shown.

The pushers 3521 are formed as shown in FIGS. 32, 33 on a conveying belt 3520 wound with tension around a drive shaft 3522 driven by a third drive motor M33 and a driven shaft 3523, at two locations in parallel in the moving direction. The pushers have a mechanical structure, not shown, such that when the conveying belt 3520 moves in a counterclockwise direction (when the sheet bundle is conveyed to the left) the pushers are immobilized to the belt and when the belt moves in a clockwise direction (when moved to the front end of the sheet bundle temporarily stocked) the pushers can escape from the sheet stacking surface.

Figure 37:
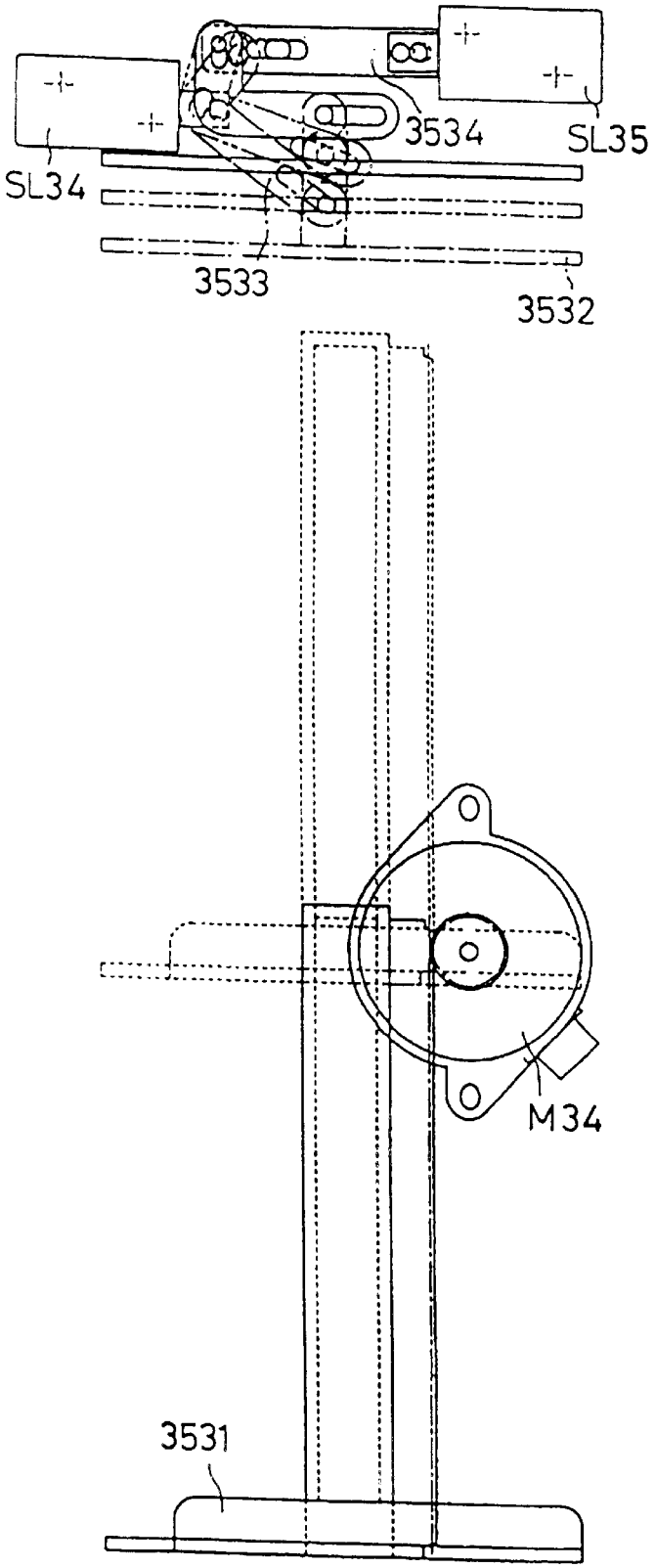
FIG. 37 is a plan illustration showing an operative situation of an aligning plate pair in the above sheet processing apparatus.

As shown in FIG. 37, the one alignment plate 3531 between the alignment plate pair 3531, 3532 can be driven by a fourth drive motor M34 so as to be linearly traveled according to the stapling mode and sheet size of the sheets delivered with the center reference, and the other alignment plate 3532 can be driven to selectively switch the position by fourth and fifth solenoids SL34, SL35 by way of respective link plates 3533, 3534 to be shifted to the three values as described below in accordance with the stapling mode and sheet size.

That is, more specifically, when stapling is made at a sheet corner and when stapling is made at two locations of A4 and A3 sheet sizes, the fourth and fifth drive solenoids SL34, SL35 are kept turned off to hold the one alignment plate 3531 and the other alignment plate 3532 at the solid line position in FIG. 37; when stapling is made at two locations of LTR and LDR size sheets, the fourth drive solenoid SL34 is turned on and the fifth drive solenoid SL35 is turned off to hold the other alignment plate 3532 upon moving the plate 3532 to a position of a double dot chain line in FIG. 37 in following movement of the one alignment plate 3531; when stapling is made at two locations of B4 and B5 size sheets, the fourth drive solenoid SL34 is turned on and the fifth drive solenoid SL35 is turned on to hold the other alignment plate 3532 upon moving the plate 3532 to a position of a single dot chain line in FIG. 37.

Figure 38:
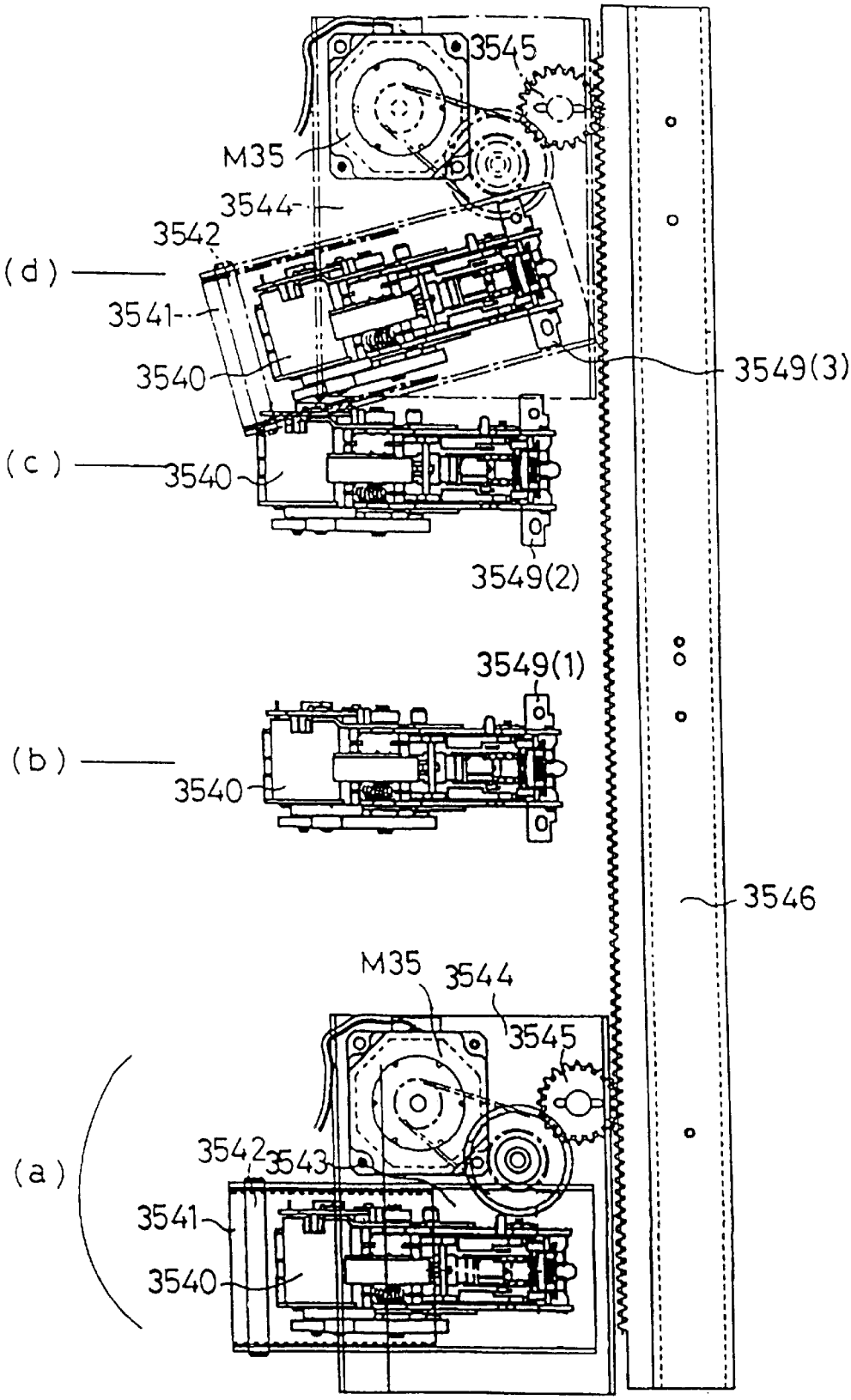
FIG. 38 is a plan illustration showing an operative situation of a stapler in the above sheet processing apparatus.
Figure 39:
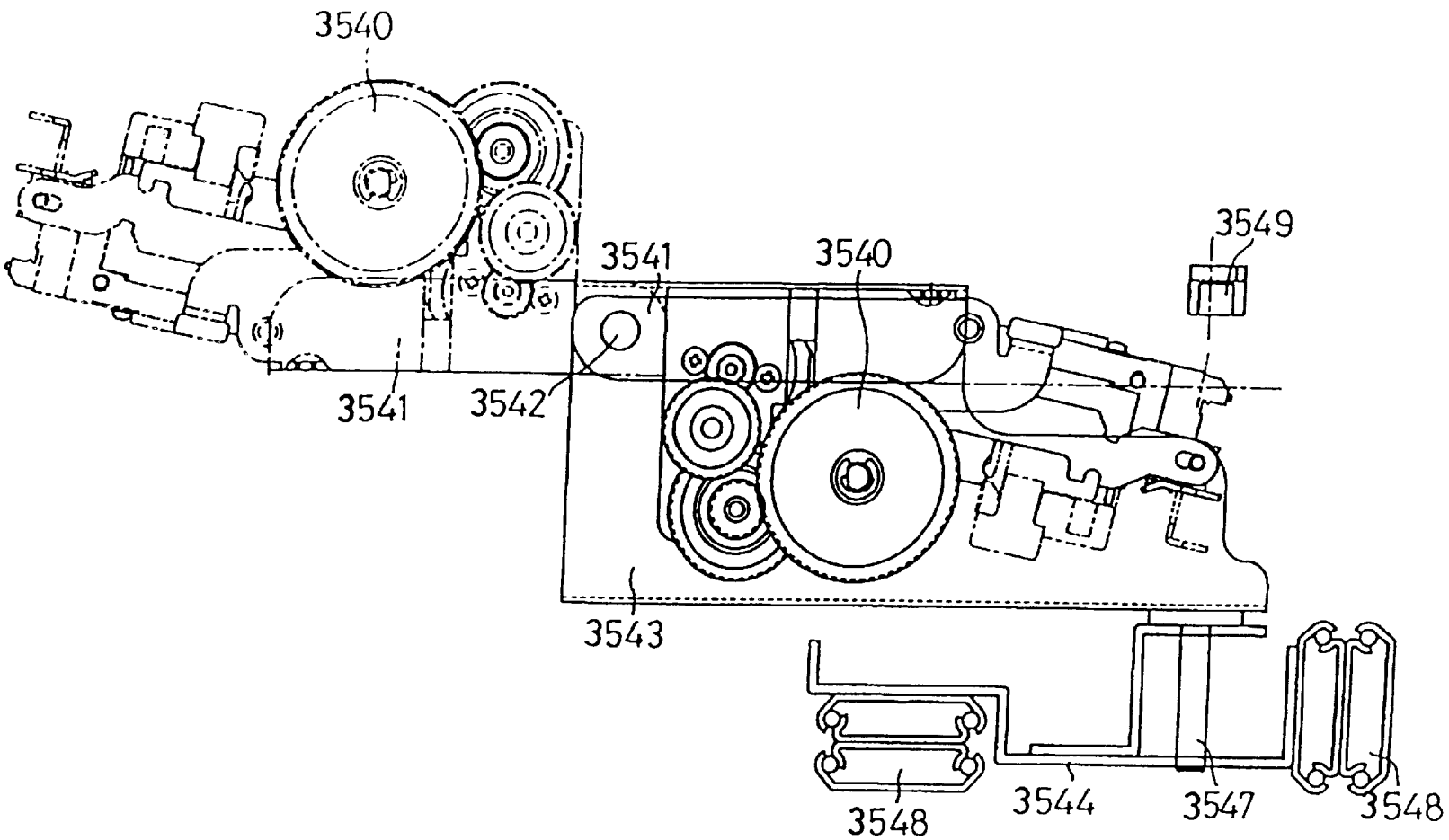
FIG. 39 is an enlarged side view showing essential portions in FIG. 38.
Figure 40:
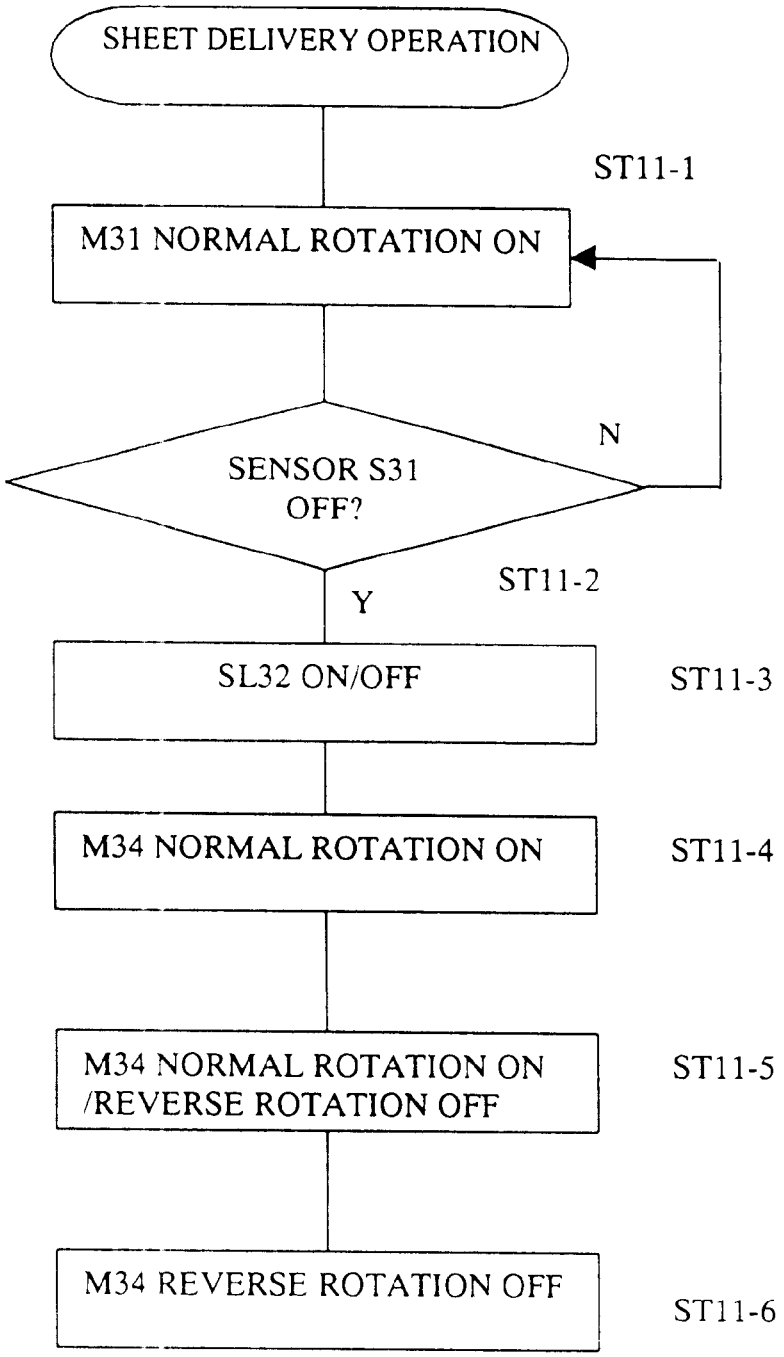
FIG. 40 is an operation flow for sheet delivery operation in the above sheet processing apparatus.
Figure 41:
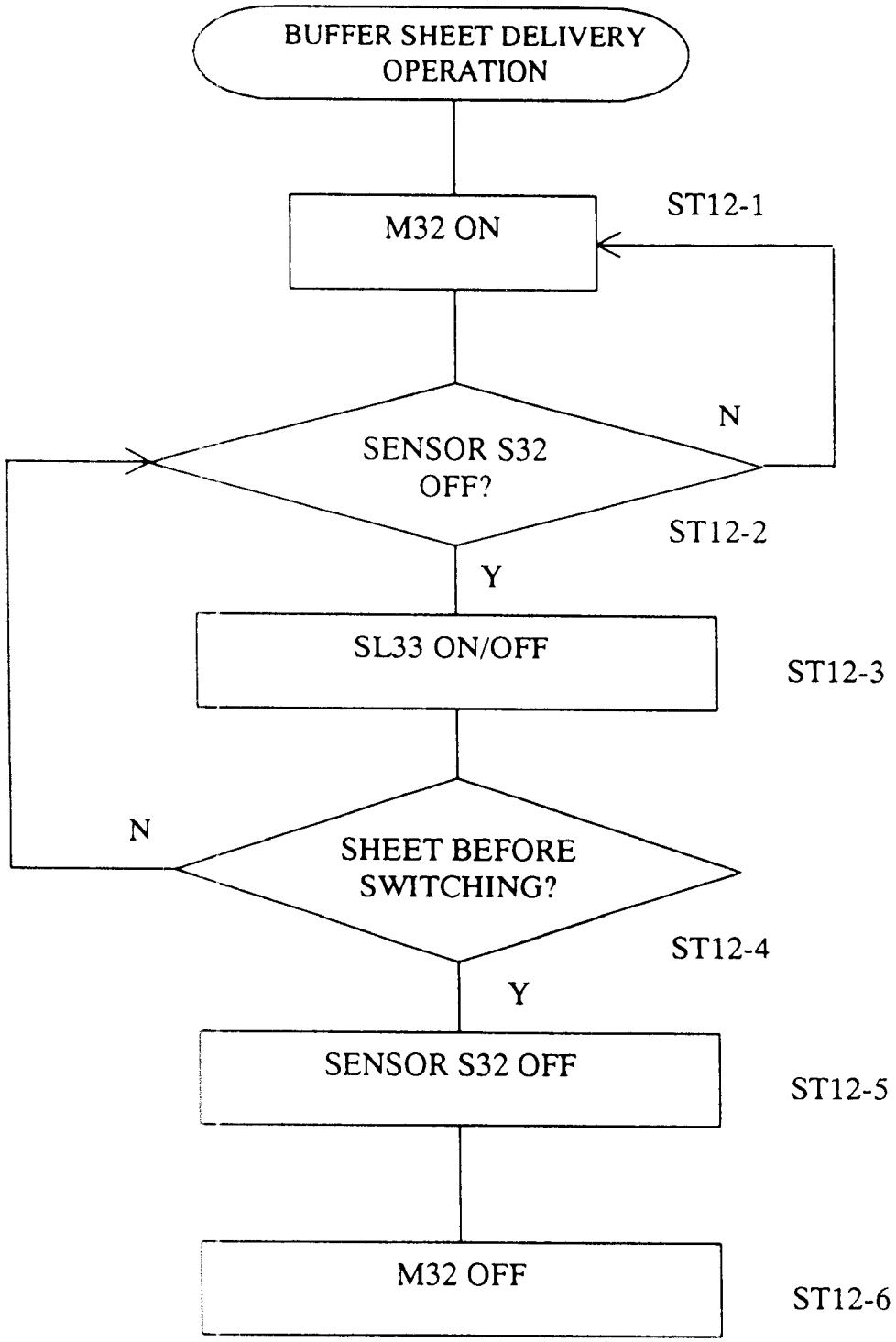
FIG. 41 is an operation flow for buffer sheet delivery operation in the above sheet processing apparatus.

The stapler 3540 is secured to a first bracket 3541 as shown in FIGS. 38, 39, and the first bracket 3541 is reversely pivotable to an up and down direction position (a single dot chain line position in FIG. 39) around a shaft 3543 extending horizontally as a pendulum fixed to a second bracket 3543. The second bracket 3542 is held pivotable to a horizontal direction position (a single dot chain line position equivalent to portion in FIG. 38) by way of a shaft 3547 extending vertically, with respect to a third bracket 3544 movable along a set of respective guide rails 3548, 3548 in a direction (front to rear direction, up and down direction on a paper surface of FIG. 38, equivalent to a direction perpendicular to a paper surface in FIG. 39) perpendicular to the sheet proceeding direction with respect to the apparatus frame not shown. A fifth drive motor M35 is arranged on the third bracket 3544, which is movable for a prescribed amount by rotating the final stage gear 3545 of the fifth drive motor M35 in meshing with a rack gear 3546 fixed to the apparatus frame.

In the case of the above stapler 3540, set position (a) in FIG. 38 is the home position, and set positions (b), (c) occupy a near position and a far position of the two location stapling with respect to set position (a), and similarly, set position (d) occupies a position during a corner stapling. Here, when it shift from get position (c) to set position (d), the second bracket 3543 is pivotally moved in a horizontal direction by a prescribed angle by means of a cam means not shown, thereby positionally changing the stapler 3540 on the second bracket 3543 as to be in an oblique position (corresponding to a position for corner stapling) with respect to the sheet bundle. When the staple cartridge in the stapler 3540 is replaced or refilled, a user manually rotates the first bracket 3541, or the stapler 3540, in the reverse direction (single dot chain line in FIG. 39) at set position (a) as the home position, thereby bringing the cartridge opening of the stapler 3540 as to face up.

Anvils 3549 for stapling in cooperation with the stapler 3540 are formed at every set position where the stapler stops, or at total three positions, two positions for stapling positions 3549(1), 3549(2) for two stapling locations, and a position for corner stapling position 3549(3), and are individually adjustable for correlative positional shifts. The respective anvil positions corresponding to stapling positions 3549(1), 3549(2) for two locations are designed to be located closer to the stapler 3540 than the anvil position 3549(3) for the corner stapling position, thereby correcting an amount equal to bending occurring when a stay not shown for securing the anvils 3549 produces during stapling.

[Stacking Tray 3500*b*]

This stacking tray 3500*b* operates to move up and down (movable up and down by a sixth drive motor M36 not shown) one by one in following the stacked sheet bundle to keep constant the stacked level at a time of delivery, and performs an offset operation (driven by the sixth drive solenoid SL36 not shown) alternatively in a direction perpendicular to a delivery direction to distinguish the respective bundles of the stacked bundles.

[Sensors for Operation Controls]

As sensors for operation controls, the apparatus has a first sensor S31 disposed on a downstream side of the first sheet delivery section I, a second sensor S32 disposed on a downstream side of the second sheet delivery section II, and a third sensor S33 disposed on a downstream side of the sheet bundle delivery section. Each drive motor has a rotation amount detection sensor disposed at each drive motor for detecting the rotation amount of each drive motor.

Now referring to FIG. 30 to FIG. 45, operations of the above apparatus structure are described.

FIGS. 40 to 45 are operation flows charts for describing outlines of operations of the apparatus system in this embodiment.

[Sheet Delivery Operation (Corresponding to Operation Flow Shown in FIG. 40)]

In this sheet delivery operation, the switching flapper 3511 is selectively switched toward the first sheet delivery section I by the first drive solenoid SL31, and the movable delivery roller 3550 is selected as to contact to the main delivery roller 3510. Under this situation, the first drive motor M31 is turned on, and the delivered sheet on which images are formed is introduced from the first sheet delivery section I to the delivery section side on the sheet stacking guide 3517, and the second drive solenoid SL32 is turned on upon detecting the sheet rear end with the first sensor S31, thereby operating the first sweeping paddle 3514. At the same time, the alignment plate pair 3531, 3532 are driven to align sheets, and then, the apparatus prepares for the subsequent sheet delivery.

[Buffer Sheet Delivery Operation (Corresponding to Operation Flow Shown in FIG. 41)]

In this buffer sheet delivery operation, the switching flapper 3511 is selectively switched toward the buffer path section III by the first drive solenoid SL31, and the movable delivery roller 3550 is selected as to contact to the main delivery roller 3510. Under this situation, the second drive motor M32 is turned on, and the delivered sheet on which images are formed is introduced from the buffer path section III to the non-delivery section side on the sheet stacking guide 3517 via the second sheet delivery section II. Upon detection of the sheet rear end with the first sensor S31, the third drive solenoid SL33 is turned on to operate the second sweeping paddle 3515, and after the sheet front end is received in hitting the stationary stopper 3524, the apparatus prepares for the subsequent sheet. When the sheet is before switching, the sweeping paddle does not operate, thereby reducing the switching period.

The respective rotation speeds of the relay roller pair 3512 and the second delivery roller pair 3513 of the buffer path section III, or namely, conveying speeds of the sheets, are designed slightly faster than the rotation speed of the receiving roller pair 3151 in the switch back path 3150, to make wider intervals of the sheets conveyed one by one. A one way clutch is incorporated in the drive transmission section of the receiving roller pair 3151 and allows the sheet in a midway of conveyance to be easily pulled away while the sheet is nipped by the receiving roller pair 3151 and the relay roller pair 3512.

[Buffer Switching Operation (Corresponding to Operation Flow Shown in FIG. 42)]

In switching operation to this buffer, when it is the last original document, the first drive solenoid SL31 is turned on, and after the switching flapper 3511 is operated from the first sheet delivery section I to the buffer path section III to switch the sheet conveying route, the above buffer sheet delivery operation is performed, and at the same time, the processing operation at the first sheet delivery section I is executed.

[Preparation Operation for Stapling Sheets by Means of a Stapler]

When the stapling mode is selected, the stapler 2540 is moved in advance by drive of the fifth drive motor M35 to the corresponding position.

Subsequently, the pushers 3521 holding the sheet bundle at the alignment position are driven by the third driven motor M33 to move the sheet bundle to the predetermined stapling position. With respect to the alignment position of the pushers 3521, they are made different according to the sheet size as to keep constant the rear end of the sheets when delivered, but with respect to the stapling position, they are constant notwithstanding the sheet size and can be changed according to the stapling mode. More specifically, because the distance between the staple end surface and sheet end surface is different between in a case of the corner stapling and in a case of the two location stapling, the entry amount of the sheet bundle to the stapler 3540 is made different to equalize the above distances.

After the pusher 3521 is moved, the movable delivery roller 3550 is rocked toward the bundle delivery position by reversing rotation of the first drive motor M1, thereby nipping the sheet bundle in contacting to the bundle delivery roller 3556. The sheet bundle is transferred between the pushers 3521 to the bundle delivery section before the sheet bundle is stapled, so that the processing time is reduced.

After transfer of the sheet bundle, the pushers 3521, instead of the stationary stopper 3524, limit the sheet front ends delivered at the second sheet delivery section II after escaped to the position of the stationary stopper 3524 to move the sheet bundle stacked on the second sheet delivery section II.

On the other hand, the sheet bundle delivered at the first sheet delivery section I is delivered as a bundle by rotating the first drive motor M31 in the normal direction (operation flow in FIG. 45) after the staple operation, and after completion of the delivery operation, the motor is reversed again to rock the movable delivery roller 3550 temporarily toward the delivery position. After immediately rotated in the normal direction, the first drive solenoid SL31 is turned off to back the switching flapper 3511 toward the first sheet delivery section I, thereby allowing the sheet to be delivered to the first sheet delivery section I.

After completion of delivery through the second sheet delivery section II, the pushers 3521 makes the sheet bundle in the second sheet delivery section II move to the sheet stacking position at the first sheet delivery section I, and prepares the next sheet bundle delivery operation from the first sheet delivery section I.

[Staple Operation (Corresponding to Operation Flow in FIG. 43)]

During this staple operation, disorder of the sheet bundle due to impacts from stapling is prevented by operation of the alignment plate pair 3531, 3532, and the alignment plate pair 3531, 3532 are moved to the alignment position during operation of the clinch motor in the stapler 3540.

[Up and Down Operation of the Stacking Tray (Corresponding to Operation Flow in FIG. 44)]

To make the delivery level of the sheet bundle constant, the tray level of the stacking tray 3500*b* is moved down for a prescribed amount by the sixth drive motor M36 not shown after bundle delivery completion and is moved up to a position where the paper surface detection sensor S34 not shown is turned on again. The position of the stacking tray 3500*b* is switched between the home position and the offset position depending on whether the next sheet bundle is even number bundle or not.

[Respective Operation Flows According to Sheet Size]

(A4 and LTR and the like, in a case of half size sheets)

Figure 42:
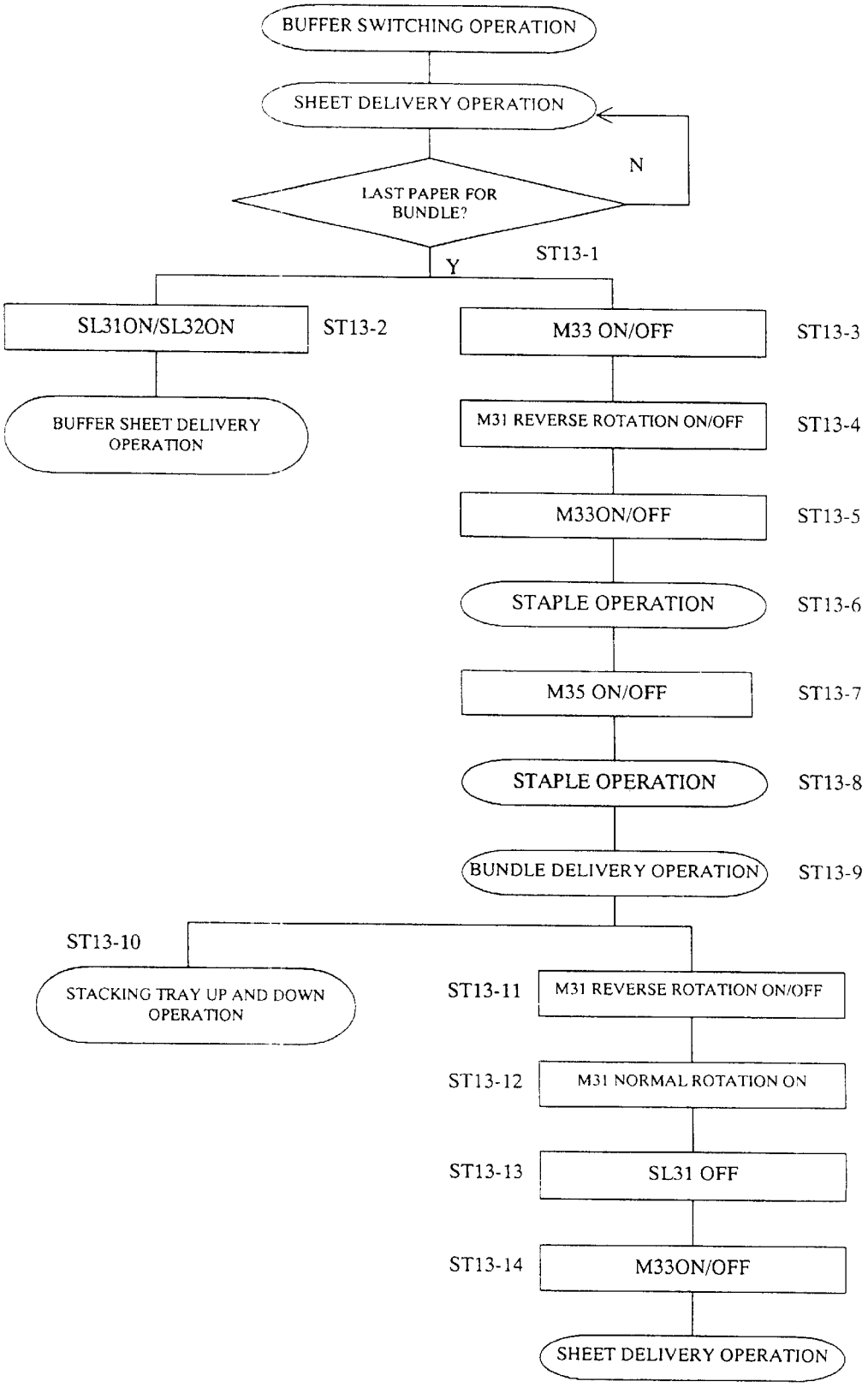
FIG. 42 is an operation flow for buffer switching operation in the above sheet processing apparatus.
Figure 43:
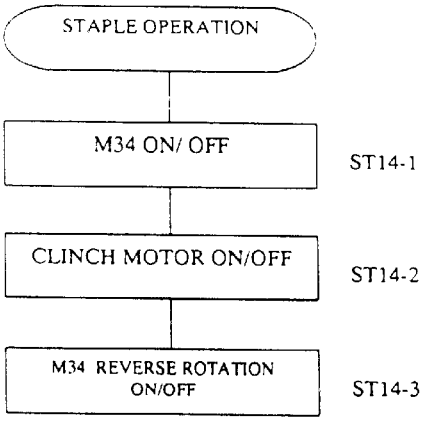
FIG. 43 is an operation flow for staple operation in the above sheet processing apparatus.
Figure 44:
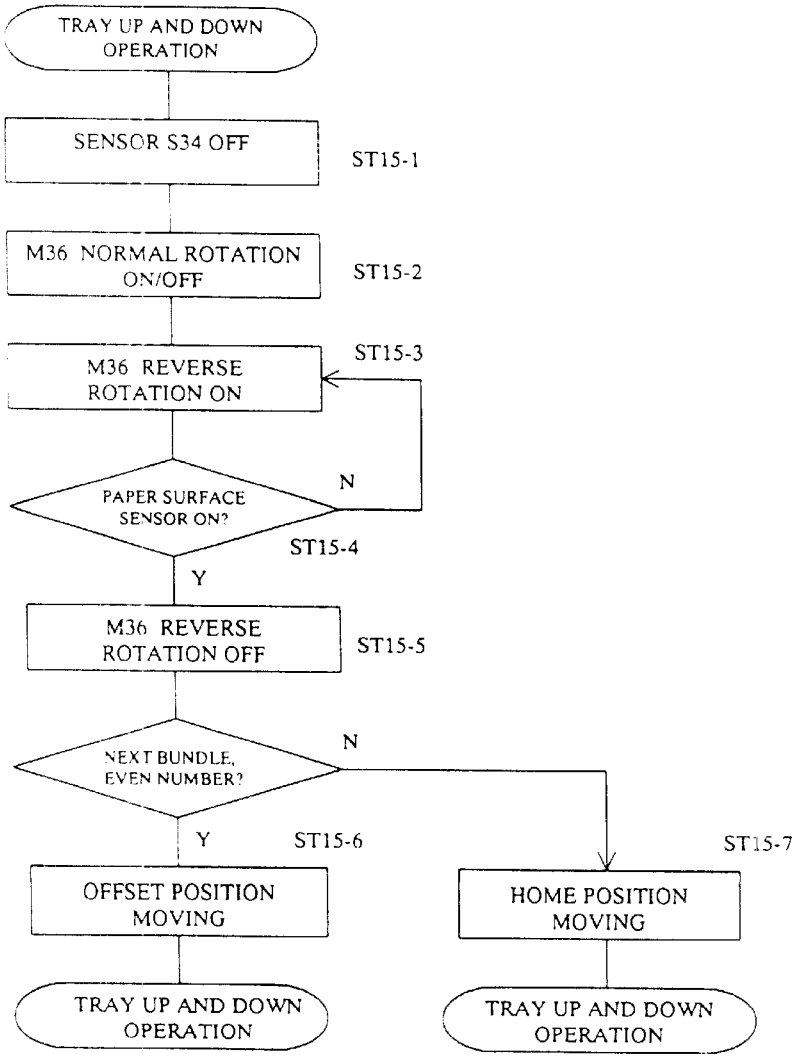
FIG. 44 is an operation flow for stacking tray up and down operation in the above sheet processing apparatus.
Figure 45:
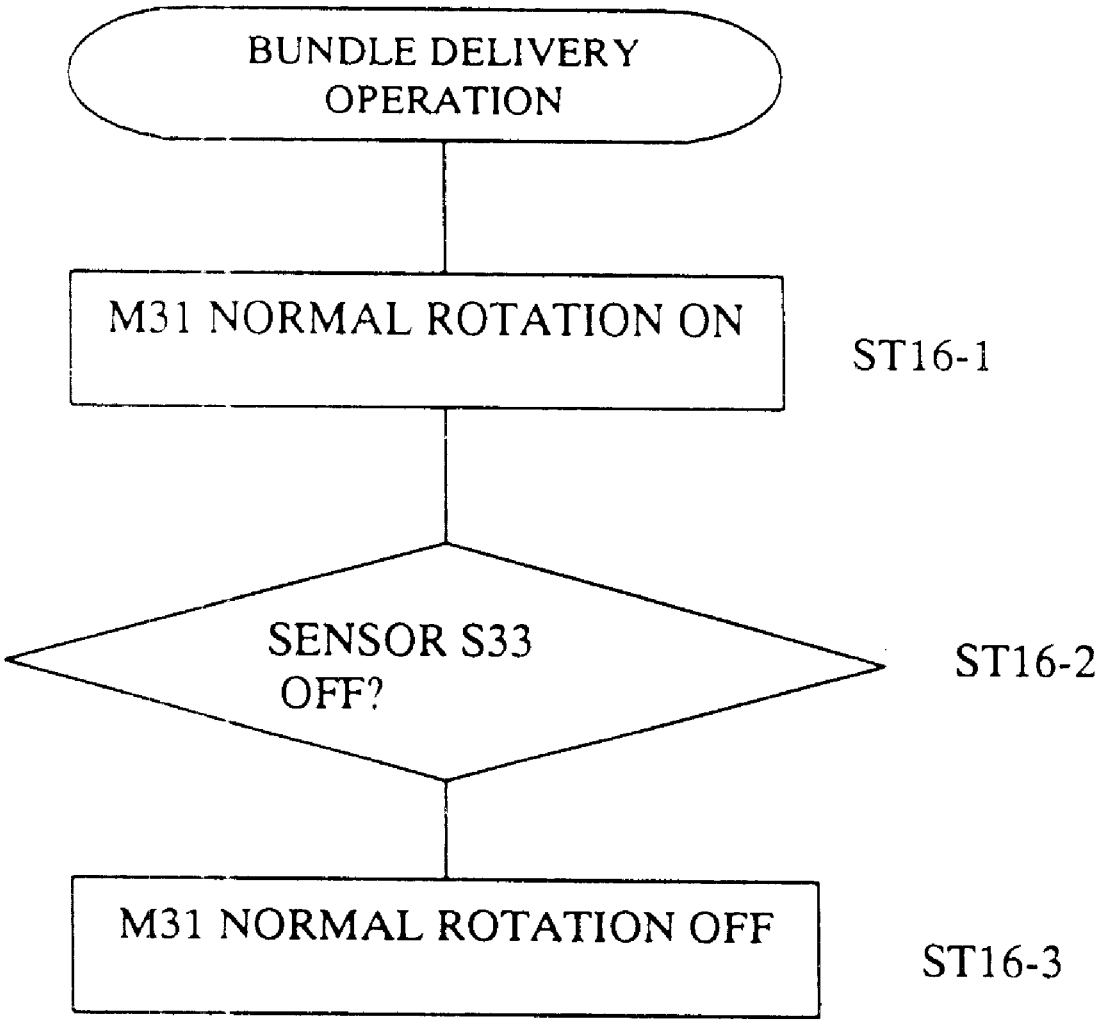
FIG. 45 is an operation flow for bundle delivery operation in the above sheet processing apparatus.

In this embodiment, the above buffer switching operation is executed only for half size sheets. As the operation flow, as shown in FIG. 42, after completion of delivery to and stacking on the first sheet delivery section I, the apparatus implements the processing operation such as stapling or the like to the sheet bundle, and the sheet from the image forming section main portion is temporarily delivered to and stacked on the second sheet delivery section II. After completion of the processing operation and the bundle delivery to the tray, the sheet bundle from the second sheet delivery section II is conveyed as a bundle to the first sheet delivery section I, and the remaining sheets are delivery and stacked at the first sheet delivery section I. The above operations are repeated until delivery of the final sheet, and then jobs ends.

(A3 and LDR and the like, in a case of large size sheet)

After completion of the above sheet delivery operation, an "image formation temporarily stop signal" is outputted from a controller, not shown, in the sheet processing apparatus to a controller, not shown, of the image forming apparatus, thereby temporarily stopping the sheet conveyance from the image forming apparatus main body, and the above staple operation and bundle delivery operation are executed for the sheet bundle.

After completion of the processing operation and the bundle delivery operation to the stacking tray, an "image forming restart signal" is outputted, and the above sheet delivery operation is executed to deliver and stack sheets on the first delivery section I.

[Respective Operation Flow According to Copying Modes]

(In a case of a single side copying)

The description would be the same as the above respective flows according to the sheet size, and therefore, is omitted.

(In a case of a double side copying)

As described above, with respect to image formation for double sides of a sheet in an image forming section, the images are formed on the other side upon that images are formed on the one side by way of the switch back path, and the reverse path, and then, since the sheet on both sides of which images are formed is conveyed to the processing tray, the distance between the sheets becomes longer. Therefore, because the above buffer switching operation is not necessary to be executed again (processing operation can be done between a forgoing sheet and a following sheet), the sheet size does not matter, and the sheets are delivered by the same operation flow as in a case of the large size sheet, A3 and LDR and the like.

Figure 49:
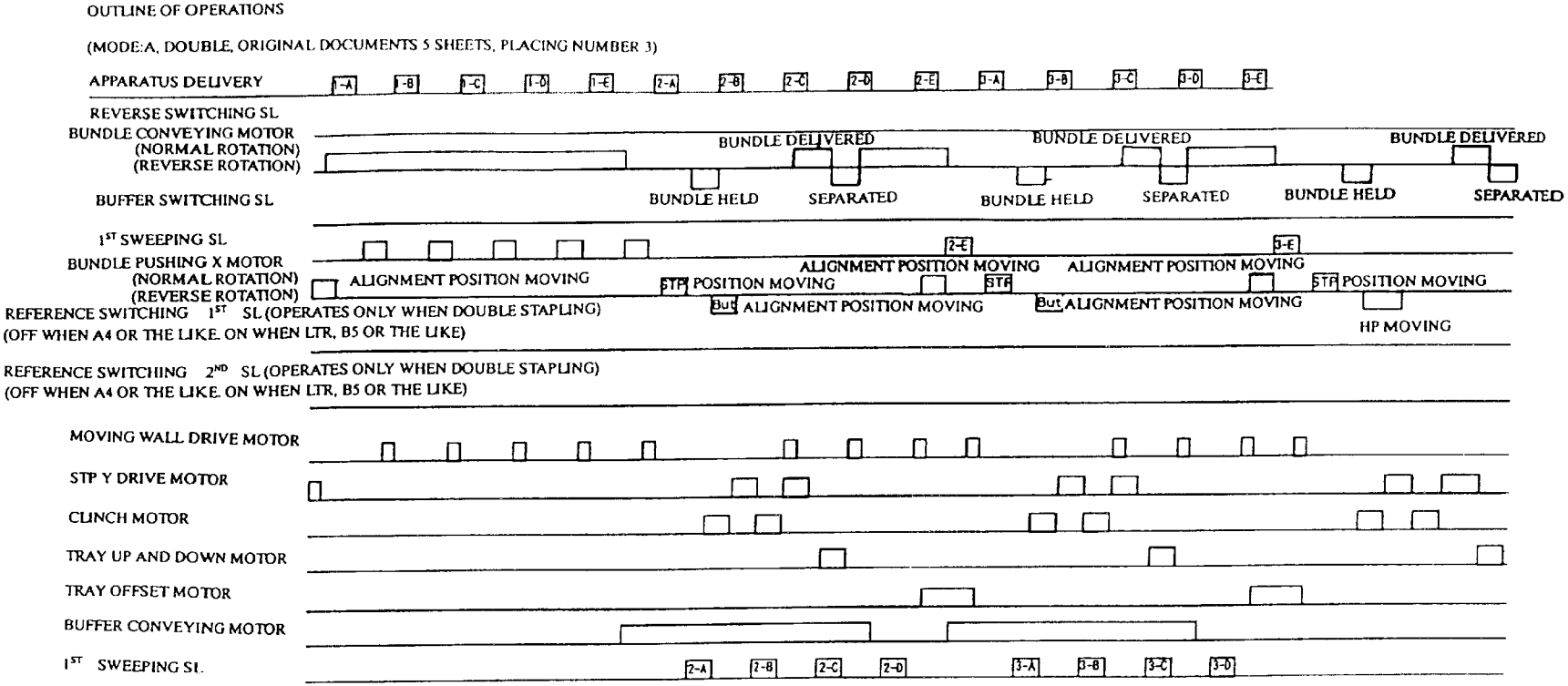
FIG. 49 is a timing chart for describing operation timings of the above image forming apparatus system.

FIG. 49 shows an outline of a timing chart where the processing is made under [sheet size: A4, stapling mode: two locations, original document number: five sheets, placing number: 3], as a series of timings for respective above operations.

Sixth Embodiment

The sixth embodiment is described next in comparison with the fifth embodiment.

Figure 46:
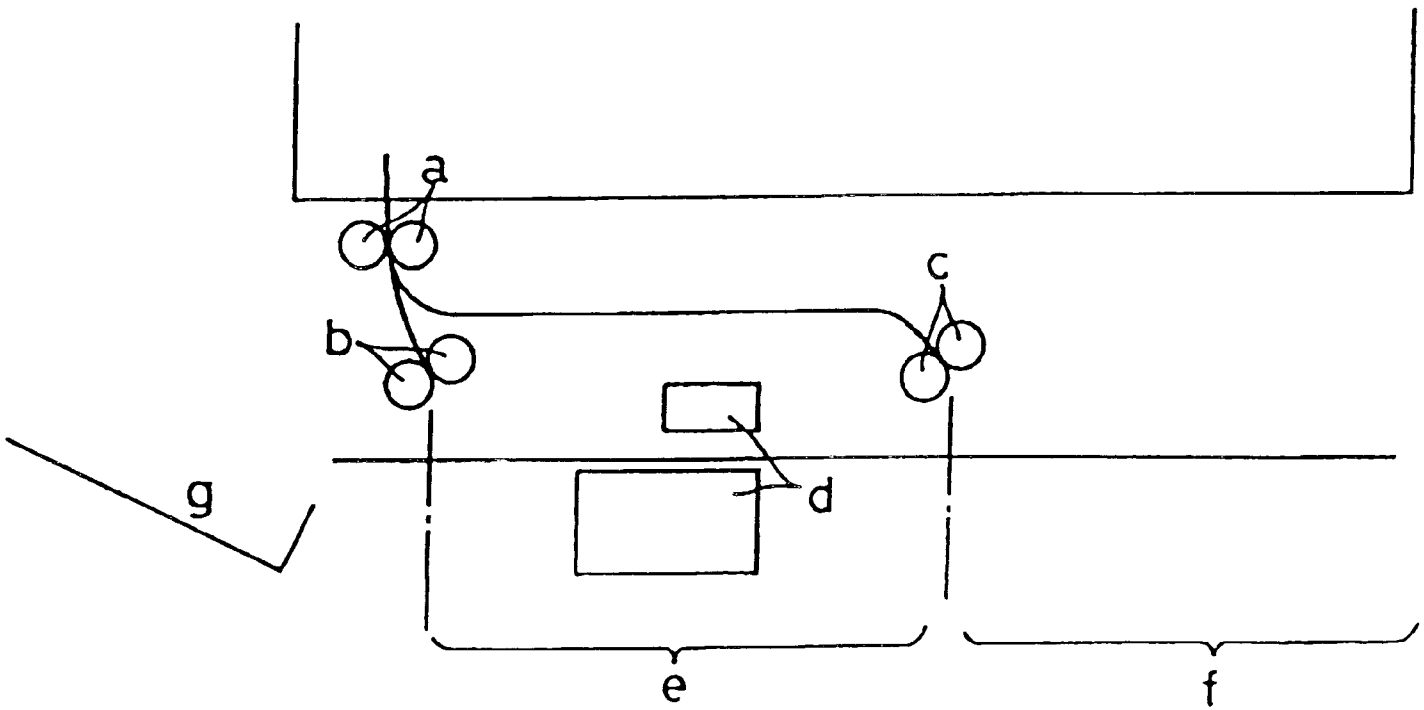
FIG. 46 is an illustration showing an outline of the essential structure of the fifth embodiment.
Figure 47:
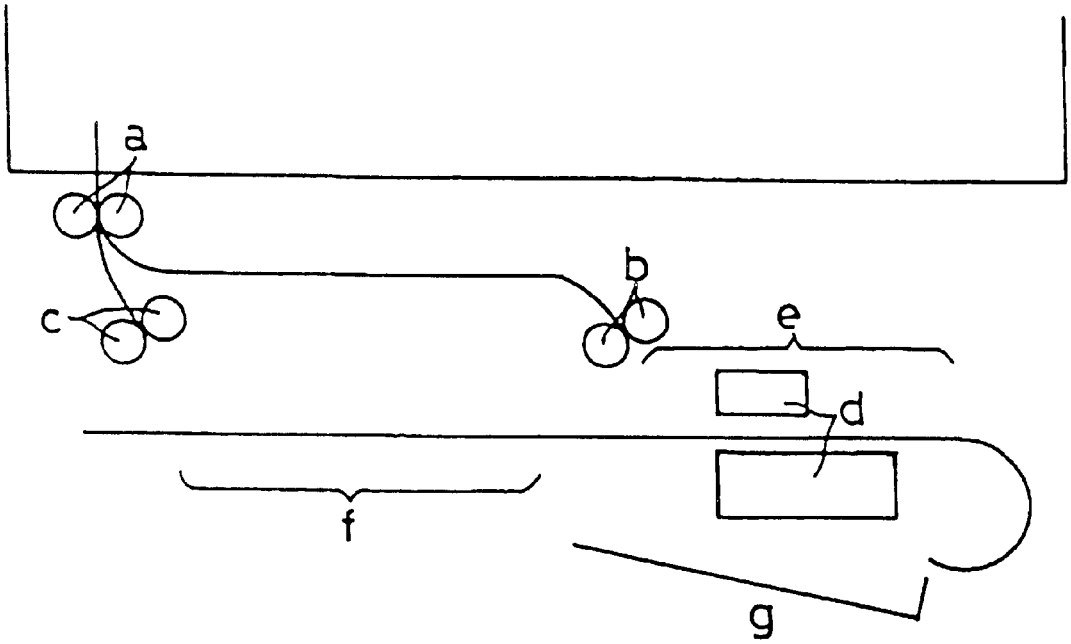
FIG. 47 is an illustration showing, corresponding to the first embodiment, an outline of the essential structure of the fifth embodiment.

FIG. 46 is an illustration showing an outline of the essential structure of the fifth embodiment; FIG. 47 is an illustration showing, corresponding to the fifth embodiment, an outline of the essential structure of the sixth embodiment.

In FIGS. 46, 47, numeral a represents a sheet introduction section; numeral b represents a first sheet delivery section (corresponding to the first sheet delivery section I); numeral c represents a second sheet delivery section (corresponding to the second sheet delivery section II); numeral d represents a stapler; numeral e represents a first sheet stacking area; numeral f represents a second sheet stacking area; and numeral g represents a stackling section for sheet bundles.

A sheet on which images have already been formed introduced from the sheet introduction section a is processed by the stapler d after stacked on the first sheet stacking area e by way of the first sheet delivery section b, and the processed bundles are delivered as a bundle basis onto the stacking section g for sheet bundles. Meanwhile, the sheet bundle stacked in the second sheet stacking area f by way of the second sheet delivery section c during this processing is moved as a bundle basis to the first sheet stacking area e after processing the first sheet stacking area e and is aligned in meeting with the sheet from the first sheet delivery section b.

In this apparatus structure according to this sixth embodiment, differences in apparatus structures in comparison with the fifth embodiment exists in the fending direction of sheet bundle with respect to sheet delivery directions at the first and second sheet delivery sections b, c. That is, the apparatus structure of the sixth embodiment is formed as to move as a bundle basis in the same direction, and the stacking section g for sheet bundles is disposed below the image forming section, thereby making the entire apparatus more compact.

Furthermore, the apparatus structure of this sixth embodiment also can have the same advantages as the apparatus structure of the fifth embodiment.

Seventh Embodiment

Figure 48:
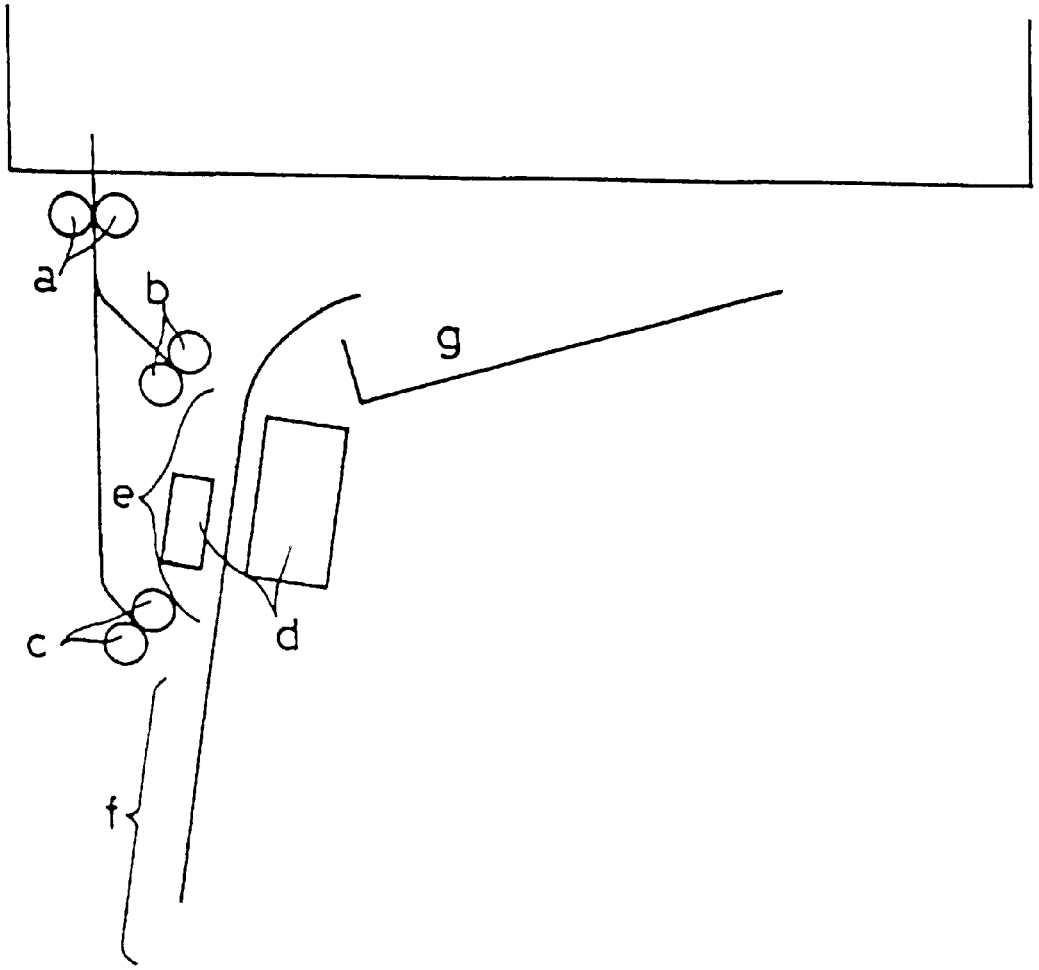
FIG. 48 is an illustration showing, corresponding to the first embodiment, an outline of the essential structure of the fifth embodiment.

The seventh embodiment is also described in comparison with the fifth and sixth embodiments. FIG. 48 is an illustration showing an outline of the essential structure of the seventh embodiment, and respective reference numbers are the same as those in the fifth and sixth embodiments.

In the case of the apparatus structure of the seventh embodiment, in totally the same way, a sheet on which images have already been formed introduced from the sheet introduction section a is processed by the stapler d after stacked on the first sheet stacking area e by way of the first sheet delivery section b, and the processed bundles are delivered as a bundle basis onto the stacking section g for sheet bundles. Meanwhile, the sheet bundle stacked in the second sheet stacking area f by way of the second sheet delivery section c during this processing is moved as a bundle basis to the first sheet stacking area e after processing the first sheet stacking area e and is aligned in meeting with the sheet from the first sheet delivery section b.

Differences in apparatus structures between the seventh embodiment and the fifth and sixth embodiments are that the entire apparatus is made compact by providing the sheet stacking section g in a space opened vertically where the processing tray section had occupied, by disposing the first and second sheet stacking area e, f substantially vertically and disposing the first and second sheet delivery sections b, c at upper and lower areas thereof.

Furthermore, the apparatus structure of this seventh embodiment also can clearly have the same advantages as the apparatus structure of the fifth embodiment.

Eighth Embodiment

Figure 50:
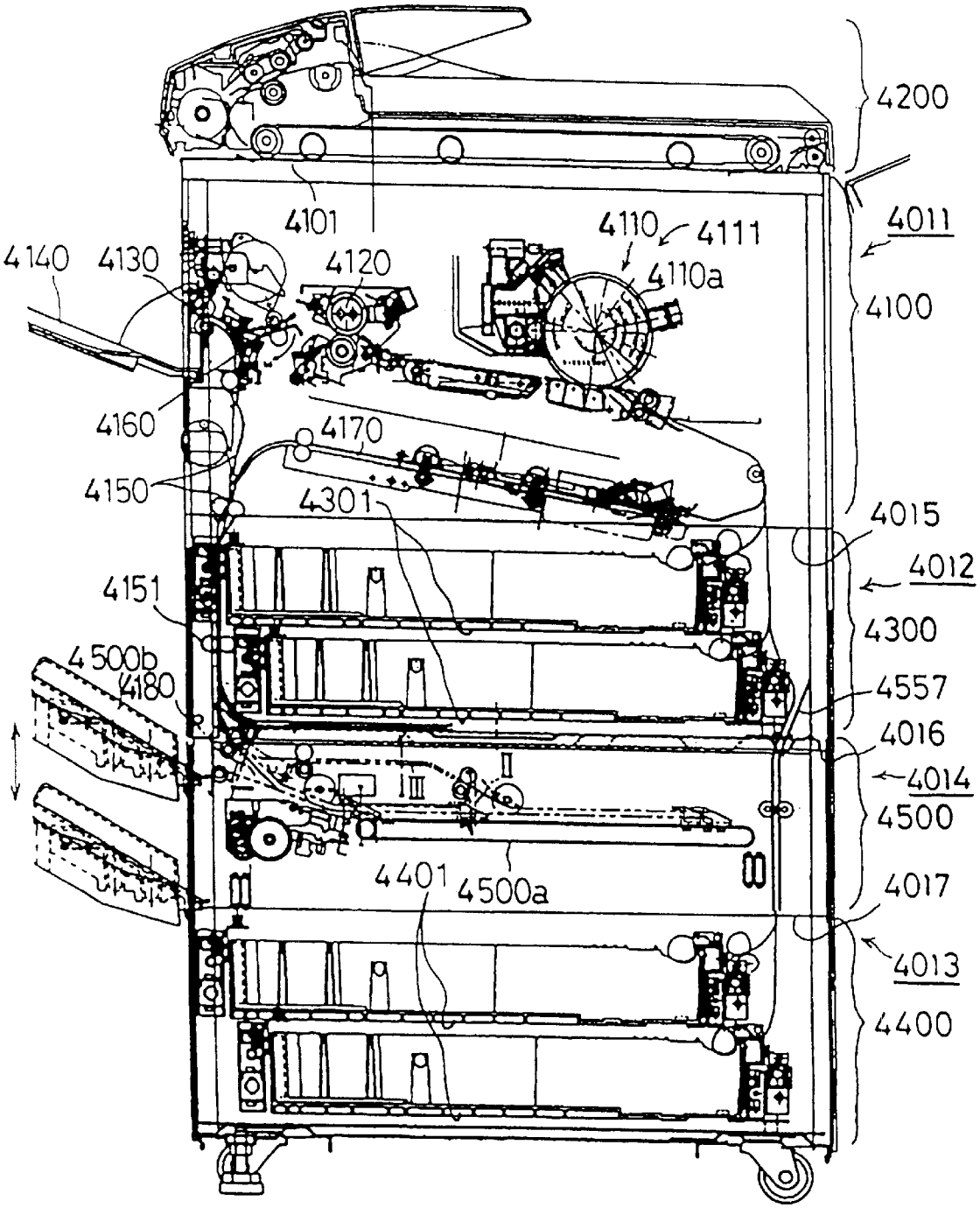
FIG. 50 is a cross section showing a schematic entire structure of an image forming apparatus of the eighth embodiment.

FIG. 50 is a cross section showing a schematic entire structure of an image forming apparatus according to the eighth embodiment.

The image forming apparatus includes an image forming apparatus main unit 4100 incorporating an image forming section 4111, an original document conveying apparatus 4200 placed above the image forming section 4111, a sheet feeding unit 4300 detachably attached below the image forming apparatus main unit 4100, a sheet processing unit 4500 detachably attached below the sheet feeding unit 4300, and a sheet feeding unit 4400 detachably attached below the sheet processing unit 4500.

The image forming apparatus main unit 4100 has a photosensitive drum 4110*a*, an image transfer section 4110, and so on, which are serving as the image forming section 4111, within a first apparatus housing 4011. The image transfer section 4110 transfers images in a well known manner to a sheet surface of a recording sheet as a transfer material, which is selectively supplied from the first or second sheet feeding unit 4300, 4400.

The original document conveying apparatus 4200 separates one sheet from the original document bundle stacked on a original document tray and feeds the separated original document to an image reading section 4101 arranged at a ceiling of the image forming apparatus main unit 4100.

On the other hand, the first and second feeding units 4300, 4400 in second and third apparatus housings 4012, 4013 separate one sheet from respective recording sheet bundles on the respective sheet cassettes set inside the units and convey the separated recording sheet to the photosensitive drum 4110*a* of the image forming apparatus main unit 4100 by a conveying roller pair 4516 (see, FIG. 8 as described below) constituting a sheet feeding path 4557, via a right side portion in the drawing of the image forming apparatus main unit 4100.

The recording sheet on which images are formed at the image transfer section 4110 is further delivered on a delivery tray 4140 as a delivery tray disposed outside an apparatus delivery section, or namely, a first apparatus delivery section 4130, after the transferred images are fixed at an image fixing section 4120 located on a downstream side, and is stacked thereon.

When images are to be formed on double sides of a recording sheet, a recording sheet on one side of which images are formed is reversed in a switch back manner by a switch back path 4150 branching at a sheet deflecting section 4160 formed on a downstream side of the image fixing section 4120 and by a transferring roller pair 4151 located in the switch back path 4150, and the recording sheet is fed again to the image transfer section 4110 from the right side of the apparatus by way of a reversing path 4170 serving as a double side conveying route. The same processes are repeated thereafter to form images on the other side of the sheet, and the sheet is delivered finally on the delivery tray 4140.

The downstream portion of the switch back path 4150 serves as a coupling portion for the sheet processing unit 4500 which is a featured portion of the invention, and constitutes the second apparatus delivery section for delivery to the outside. The sheet processing unit 4500 is constituted from a combination of a processing tray section 4500*a* and a stacking tray section 4500*b*, and the processing tray section 4500*a* is disposed below the image forming section 4100 between the first sheet feeding unit 4300 and the second sheet feeding unit 4400. The sheet processing unit 4600 is contained in a fourth apparatus housing 4014.

The respective structures, particularly, the apparatus housings 4011, 4012, 4014, 4013 are overlapped by respective units 4100, 4300, 4500, 4400 where separable at parting lines 4015, 4016, 4017.

The apparatus according to this invention can make the apparatus smaller by this structure, and the installation area can be reduced.

Referring to FIGS. 51 to 59, the sheet processing unit 4500 will be described in detail next.

First, structures of the essential portions are described.

Figure 51:
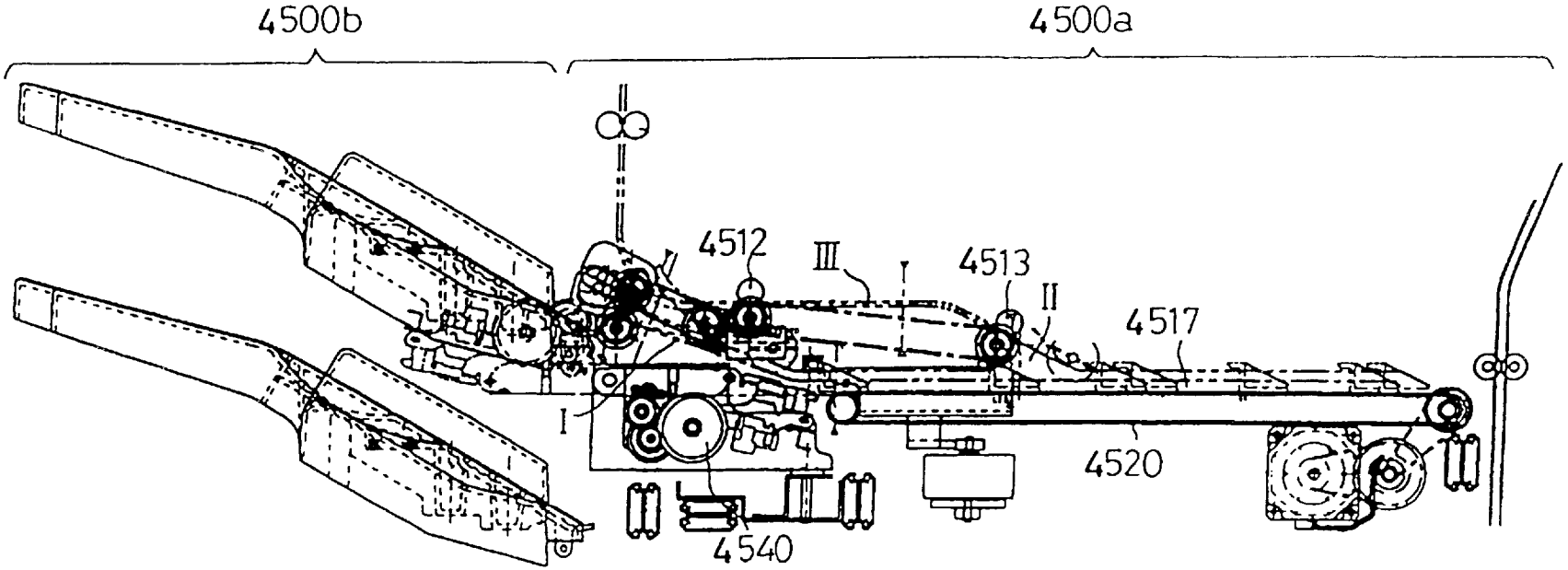
FIG. 51 is a cross section showing a schematic entire structure of the sheet processing unit of the above embodiment.
Figure 52:
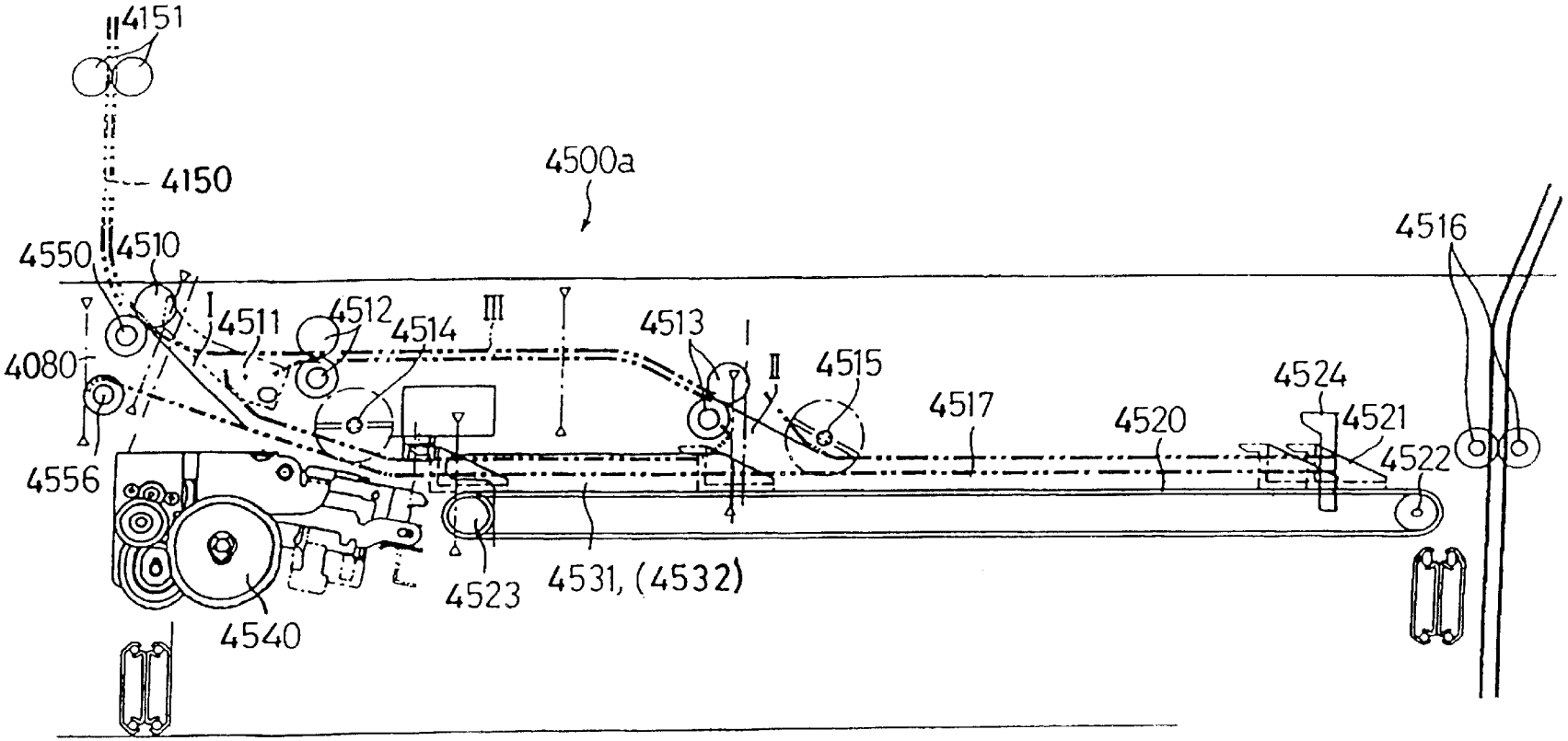
FIG. 52 is a detailed cross section showing a structure of essential portions in the sheet processing unit in FIG. 51.
Figure 53:
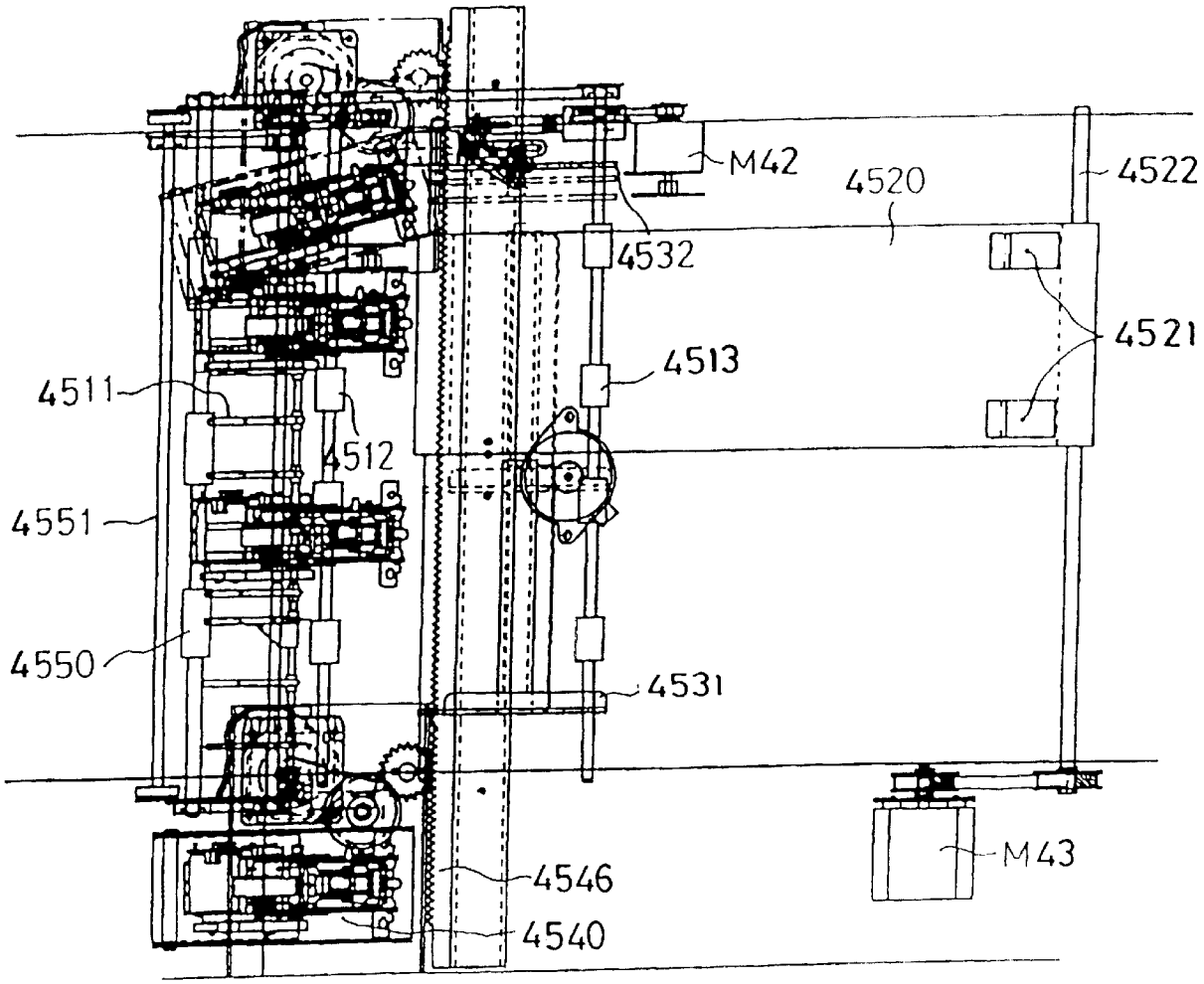
FIG. 53 is a plan view showing the essential portions in FIG. 52.

FIG. 51 is a cross section showing a schematic entire structure of the sheet processing unit disposed on a side of the second apparatus housing, to which this embodiment applies; FIG. 52 is a detailed cross section showing a structure of essential portions in the above sheet processing unit; and FIG. 53 is a detailed partial plan view showing the essential portions in the above sheet processing unit.

FIGS. 54 to 59 are illustrations showing detailed structures of respective sections in the above sheet processing unit.

[Processing Tray Section 4500*a*]

In this processing tray section 4500*a*, the conveying route for recording sheets on which images are formed is constituted of a first conveying route in which sheet bundles are conveyed, after completion of processing at the first sheet delivery section I where the recording sheets conveyed through the switch back path 4150 are delivered from the first sheet delivery section I and stacked temporarily on a delivery side (left side in FIGS. 52, 53) on a sheet stacking guide 4517, again to the stacking tray section 4500*b*, and a second conveying route in which sheet bundles are conveyed, after completion of processing at the first sheet delivery section I where the recording sheets conveyed are delivered from a buffer path III through a second sheet delivery section II and stacked temporarily on a non-delivery side (right side in FIGS. 52, 53) on the sheet stacking guide 4517 for temporarily stacking conveyed recording sheets while the recording sheets are delivered and stacked at the first sheet delivery section I from the first route and the recording sheets are delivered Pa a bundle to the stacking tray section 4500*b* after processing.

In this situation, the conveying means for recording sheets has a main delivery roller 4510, a movable delivery roller 4550 capable of contacting to the main delivery roller 4510 upon selective switching as described below in detail, which are serving as a first delivery roller pair for delivering recording sheets toward the first delivery necton I, a first sweeping paddle 4514 for surely stacking delivered recording sheets on the sheet stacking guide 4517 on a side of the delivery section, a pair of alignment plates (aligning means) 4531, 4532 for aligning the delivered recording sheets, a switching flapper 4511 for switching the first sheet delivery section I and the buffer path section III with each other, which are conveying paths, respectively, a relay roller pair 4512 located in the buffer path section III, and a second delivery roller pair 4513 for delivering recording sheets from the buffer path section III to the second sheet delivery section II.

The conveying means for recording sheets also has a second sweeping paddle 4515 for surely stacking recording sheets which are delivered to the second sheet delivery section II on the sheet stacking guide 4517 on a side of the non-delivery section, a stationary stopper 4524 for limiting temporarily the edges of the recording sheets delivered from the second sheet delivery section II, pushers 4521 for limiting the edges of the sheets at the first sheet delivery section I, for conveying sheet bundles that already stacked to a processing position and for conveying recording sheet bundles located at the second sheet delivery section II, a bundle delivery roller 4556 constituting a bundle delivery roller pair for holding the sheet bundle in nipping the sheet bundle at the stapling processing position and delivering the sheet bundles on the stacking tray 4500*b* after the stapling processing, and the above movable delivery roller 4550, as well as the above, capable of contacting to the bundle delivery roller 4556 upon selective switching.

Meanwhile, a sheet processing section for processing the recording sheet bundle on the sheet stacking guide 4517 is provided around the first sheet delivery section I for processing sheet bundles on the sheet stacking guide 4517 and is constituted, in this case, of a stapler 4540 and an alignment plate pair (aligning means) 4531, 4532.

The operation position of the stapler 4540 is in a region for stacking recording sheets delivered from the first sheet delivery section I but out of a region for stacking recording sheets delivered from the second sheet delivery section II, and the stapler 4540 is located between the stacking region for sheets from the second delivery section II and the stacking tray section 4500*b*. The alignment plate pair 4531, 4532 is located at a position as to operate with sheets in the stacking region for sheets from the first sheet delivery section I and as not to operate with recording sheets in the stacking region for sheets from the second delivery section II and is so designed as not to raise any problem upon that the recording sheets delivered from the second sheet delivery section II are unnecessarily restricted during the sheet alignment in order to prevent the stacked bundles from losing their order during the staple operation,

[Detailed Structures of Essential Portions]

Figure 54:
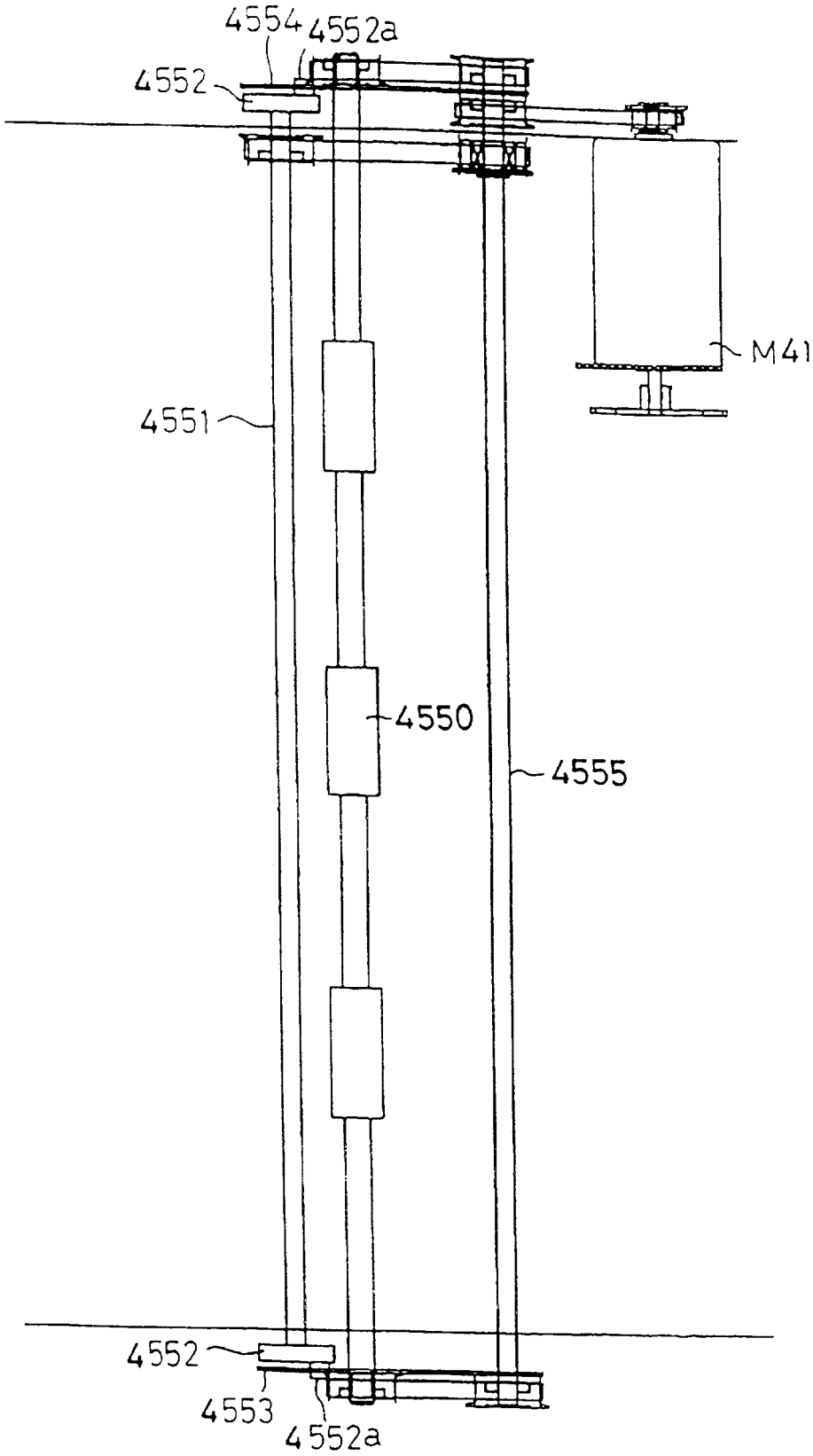
FIG. 54 is a plan view showing a switching mechanism for a movable delivery roller in a sheet post-processing apparatus shown in FIG. 52.
Figure 55:
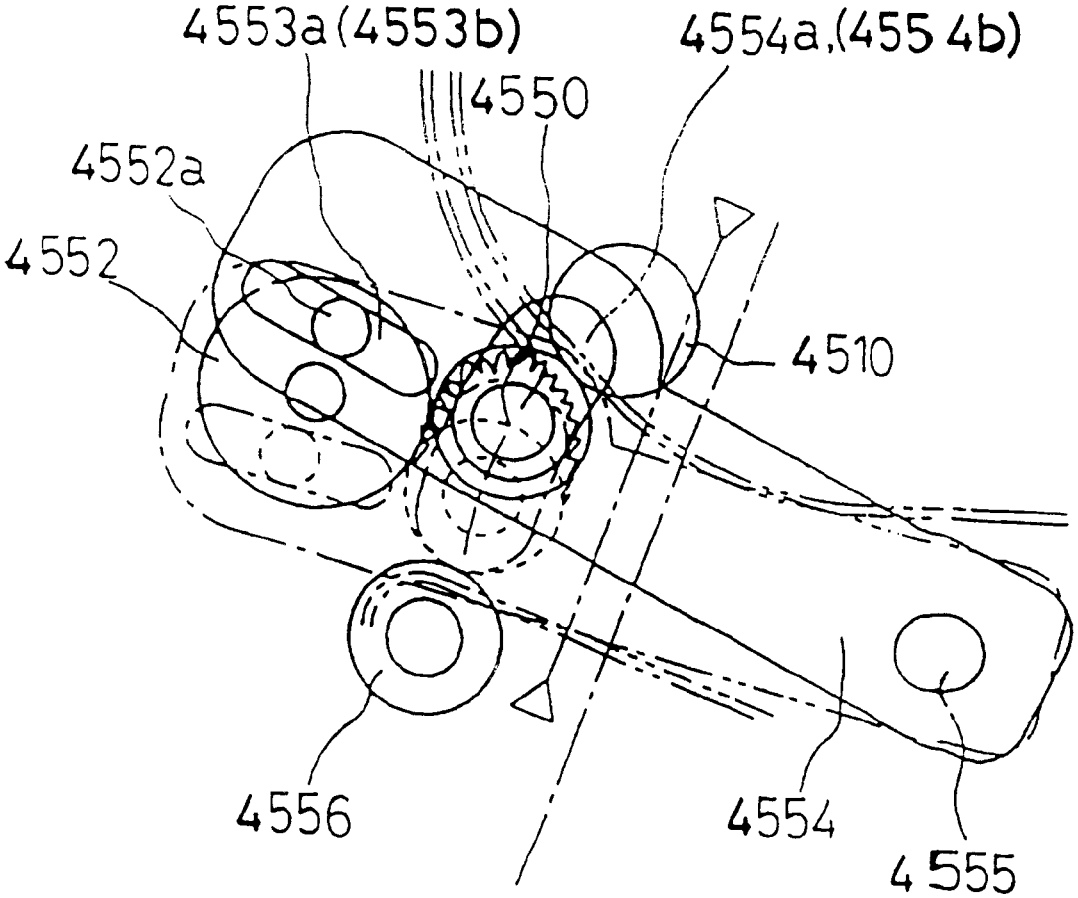
FIG. 55 is an enlarged side view showing essential portions in FIG. 54.

The movable delivery roller 4550 is located, as described above, between the main delivery roller 4510 and the bundle delivery roller 4556, makes a roller pair selectively at the rollers 4510, 4556 by switching contact to the rollers, and is constituted with a switching mechanism as shown in FIGS. 54, 55.

That is, with the structure in FIGS. 54, 55, this switching mechanism has one set of right and left rocker side plates 4553, 4554 for holding the movable delivery roller 4550. Each of the rocker side plates 4553, 4554 is formed with first long grooves 4553*a*, 4554*a* extending radially at the front end and second long grooves 4553*b*, 4554*b* extending in a circumferential direction at a midway portion, and is supported as to rock around a rocker shaft 4555 as a pendulum in operably connecting to the first drive motor M41 as a drive source.

In the first long grooves 4553*a*, 4554*a*, engaged are shaft pins 4552*a*, 4552*a* of a set of rocker cams 4552, 4552 which are formed on an intermediate shaft 4551 rotatively driven by the motor M41, and a oneway clutch is incorporated in a drive transmission of the first drive motor M41 where the movable delivery roller 4550 is held in the latter second long grooves 4553*b*, 4554*b*, so that drive force is made cutoff during sheet conveying period and transmitted to the cams only when rotating in the reverse direction.

In such a situation, the rocker cams 4552, 4552 are controlled to selectively stop during the sheet delivery at positions where the movable delivery roller 4550 comes in contact with the main delivery roller 4510 (solid line position in FIG. 55) and where the roller comes in contact with the bundle delivery roller 4556 (single dot chain line position in FIG. 55). Here, the movable delivery roller 4550 is urged by an elastic member or the like, not shown, toward the bundle delivery roller 4556 during delivery of recording sheet bundles, to make a nip distance automatically adjusted corresponding to the thickness of the bundle.

Figure 56:
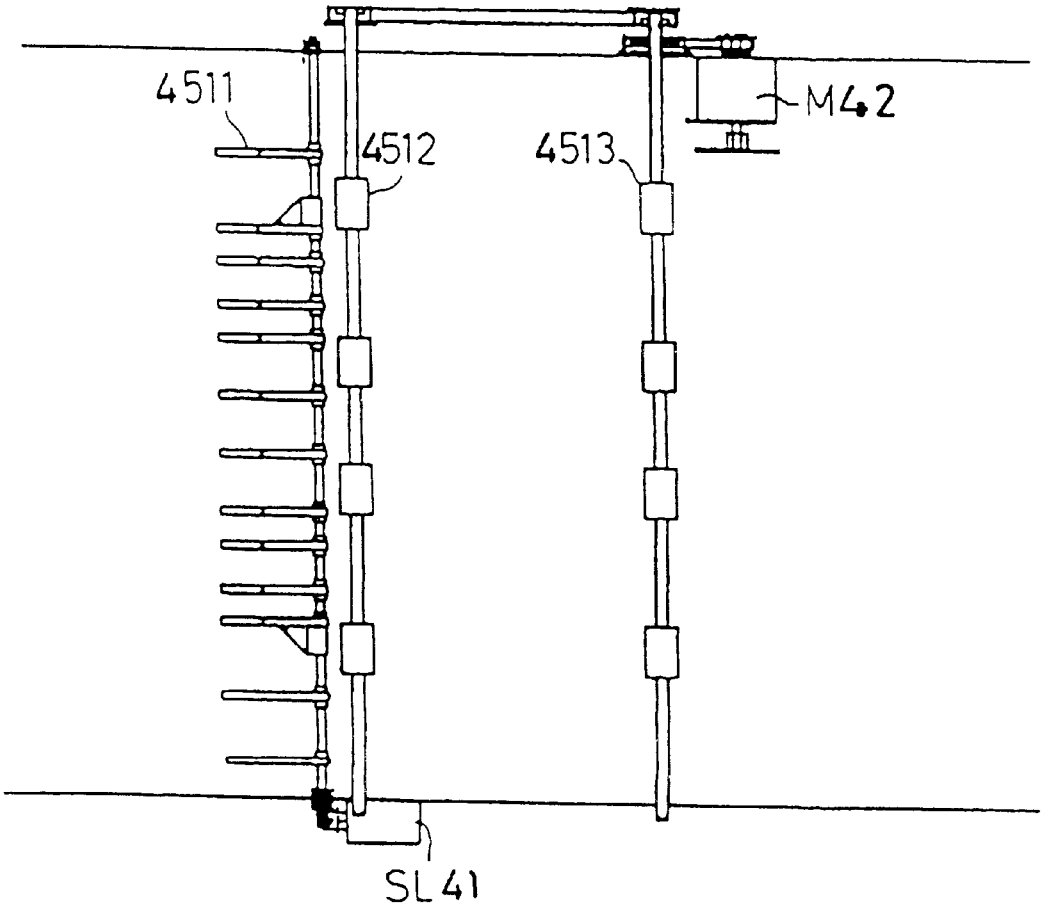
FIG. 56 is a plan illustration showing a buffer path including a switching flapper in the above sheet post-processing apparatus in the sheet processing unit.

As shown in FIGS. 52, 56, the buffer path section III is formed with a second drive motor M42 for transmitting drive force to the relay roller pair 4512 and the second delivery roller pair 4513 and with a first drive solenoid SL41 for driving a switching flapper 4511 for selectively switching sides of the first sheet delivery section I and the buffer path section III. The respective sweeping paddles 4514, 4515 disposed around the first and second delivery sections I, II, respectively, are driven for one turn by second and third drive solenoids SL42, SL43 not shown.

The pushers 4521 are formed as shown in FIGS. 52, 53 on a conveying belt 4520 wound with tension around a drive shaft 4522 driven by a third drive motor M43 and a driven shaft 4523, at two locations in parallel in the moving direction. The pushers have a mechanical structure, not shown, such that when the conveying belt 4520 moves in a counterclockwise direction (when the sheet bundle is conveyed to the left) the pushers are immobilized to the belt and when the belt moves in a clockwise direction (when moved to the front end of the sheet bundle temporarily stocked) the pushers can escape from the sheet stacking surface.

Figure 57:
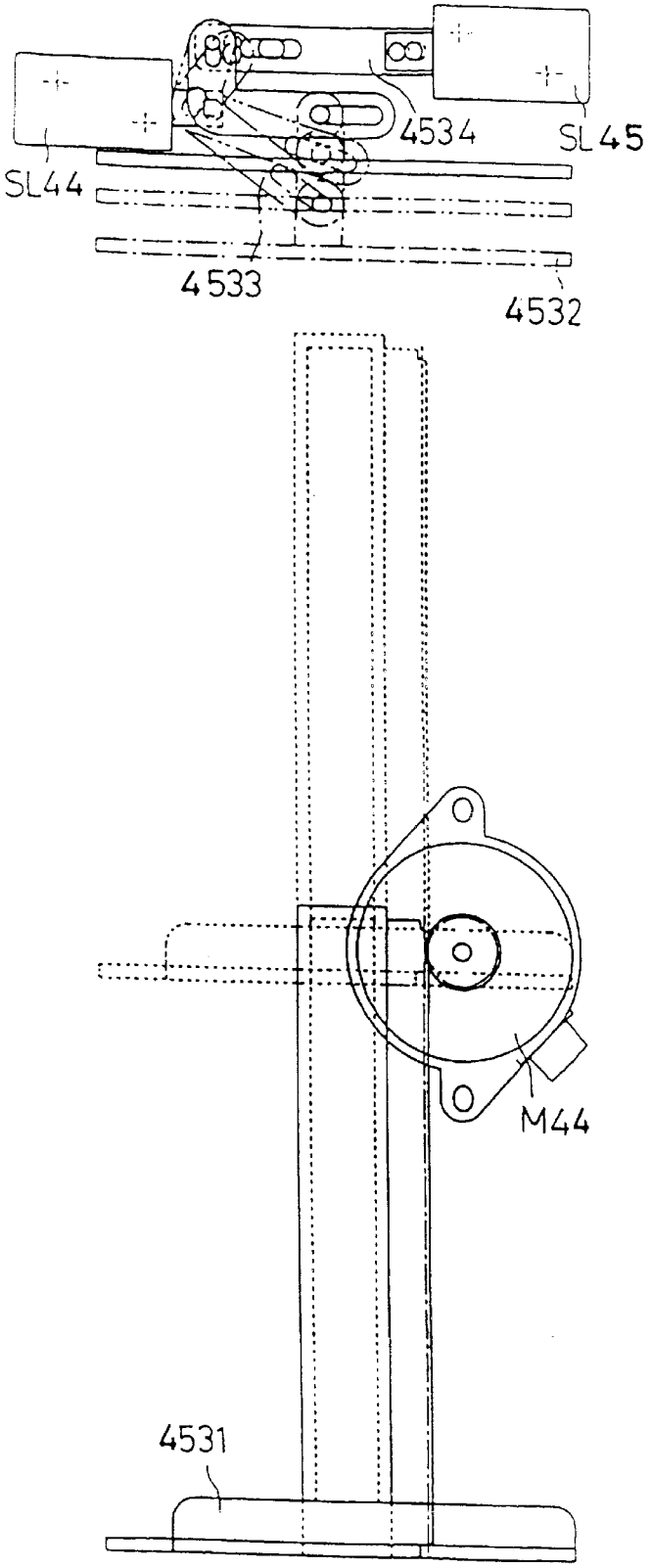
FIG. 57 is a plan illustration showing an operative situation of an aligning plate pair in the sheet post processing apparatus in the sheet processing unit.

As shown in FIG. 57, the one alignment plate 4531 between the alignment plate pair 4531, 4532 can be driven by a fourth drive motor M44 so as to be linearly traveled according to the stapling mode and sheet size of the recording sheets delivered with the center reference, and the other alignment plate 4532 can be driven to selectively switch the position by fourth and fifth solenoids SL44, SL45 by way of respective link plates 4533, 4534 to be shifted to the three values as described below in accordance with the stapling mode and sheet size.

That is, more specifically, when stapling is made at a sheet corner and when stapling is made at two locations of A4 and A3 sheet sizes, the fourth and fifth drive solenoids SL44, SL45 are kept turned off to hold the one alignment plate 4531 and the other alignment plate 4532 at the solid line position in FIG. 57; when stapling is made at two locations of LTR and LDR size sheets, the fourth drive solenoid SL44 is turned on and the fifth drive solenoid SL45 is turned off to hold the other alignment plate 4532 upon moving the plate 4532 to a position of a double dot chain line in FIG. 57 in following movement of the one alignment plate 4531; when stapling is made at two locations of B4 and B5 size sheets, the fourth drive solenoid SL44 is turned on and the fifth drive solenoid SL45 is turned on to hold the other alignment plate 4532 upon moving the plate 4532 to a position of a single dot chain line in FIG. 57.

Figure 58:
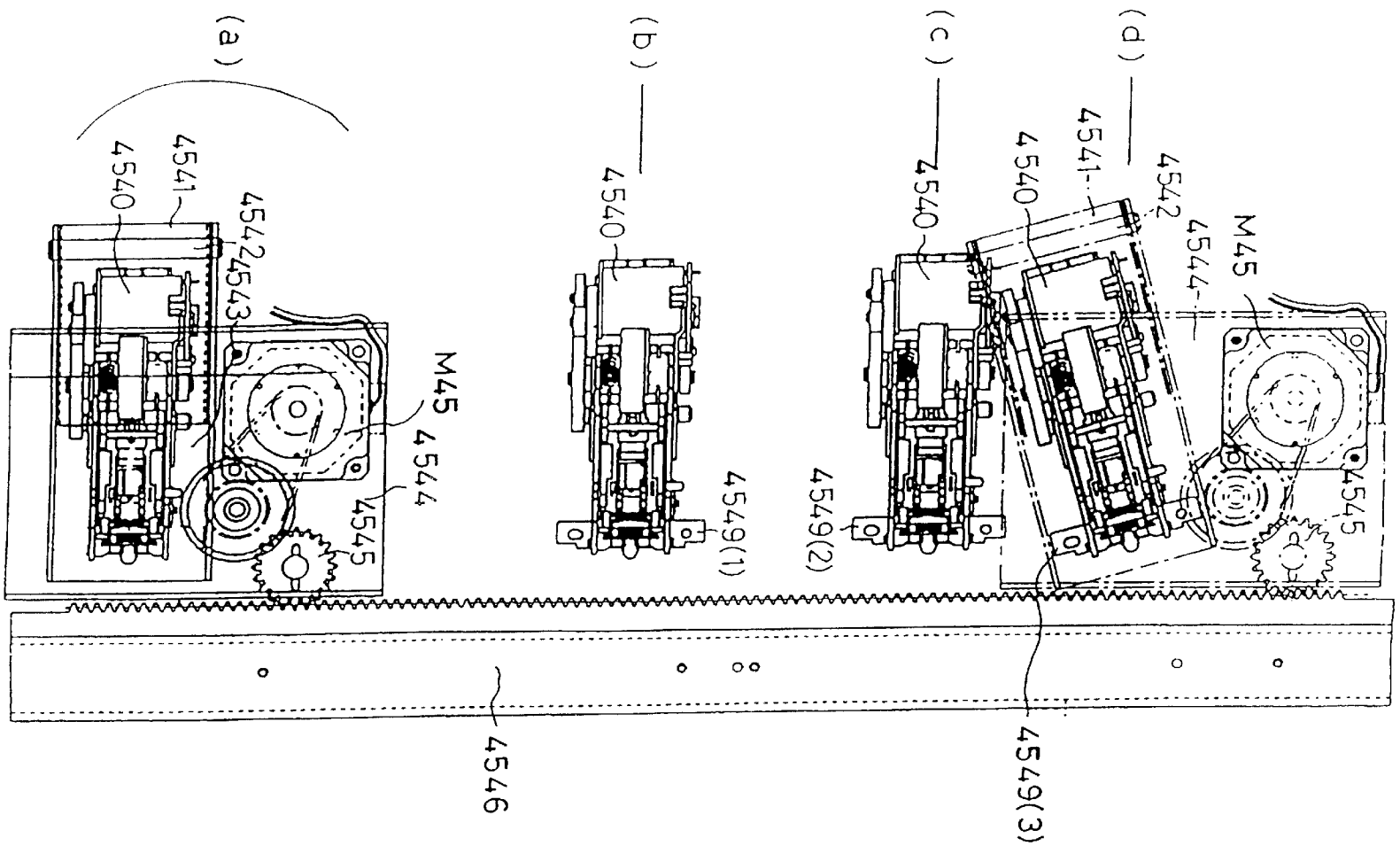
FIG. 58 is a plan illustration showing an operative situation of a stapler in the sheet post processing apparatus in the sheet processing unit.
Figure 59:
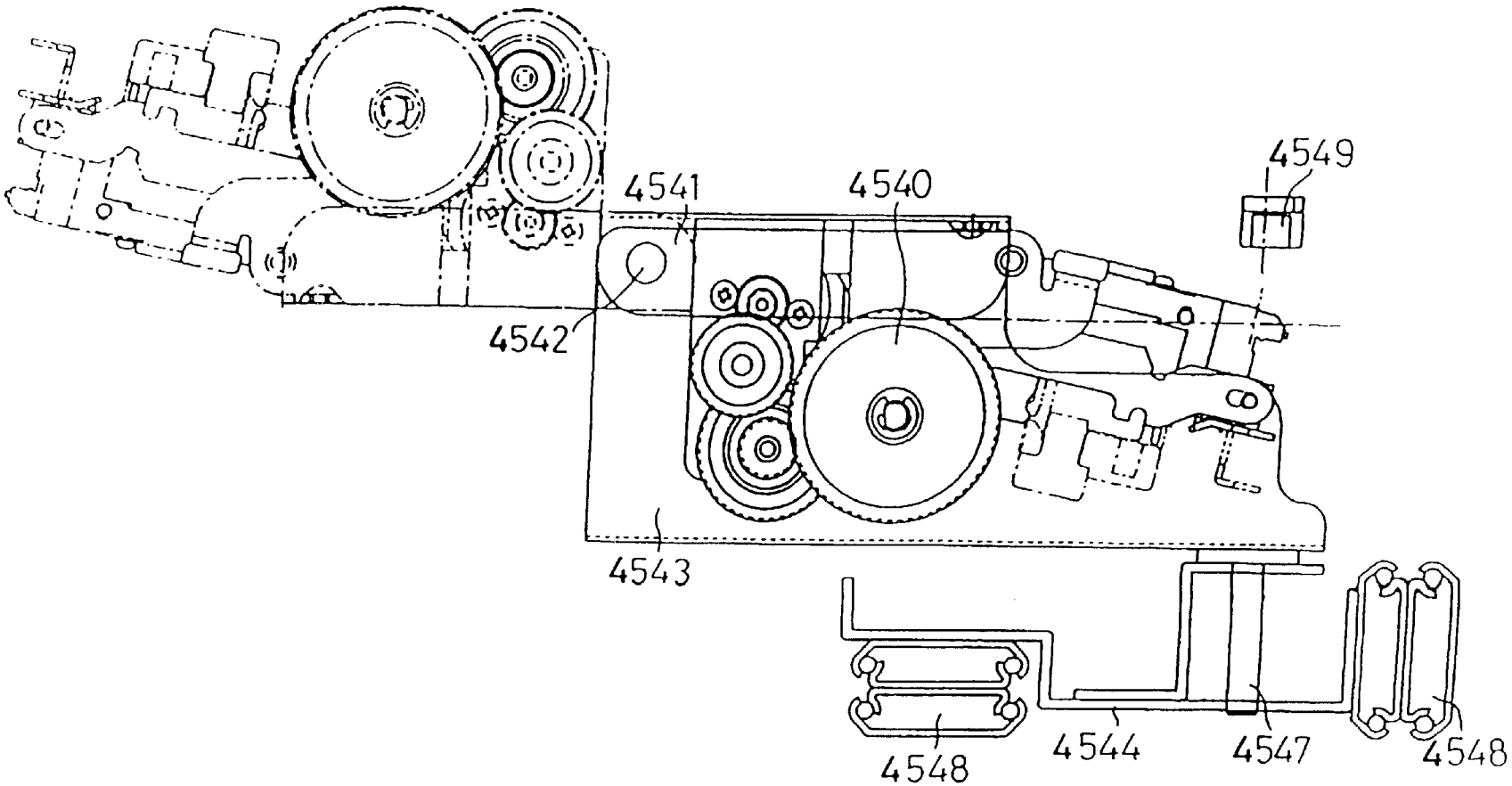
FIG. 59 is an enlarged side view showing essential portions in FIG. 58.
Figure 60:
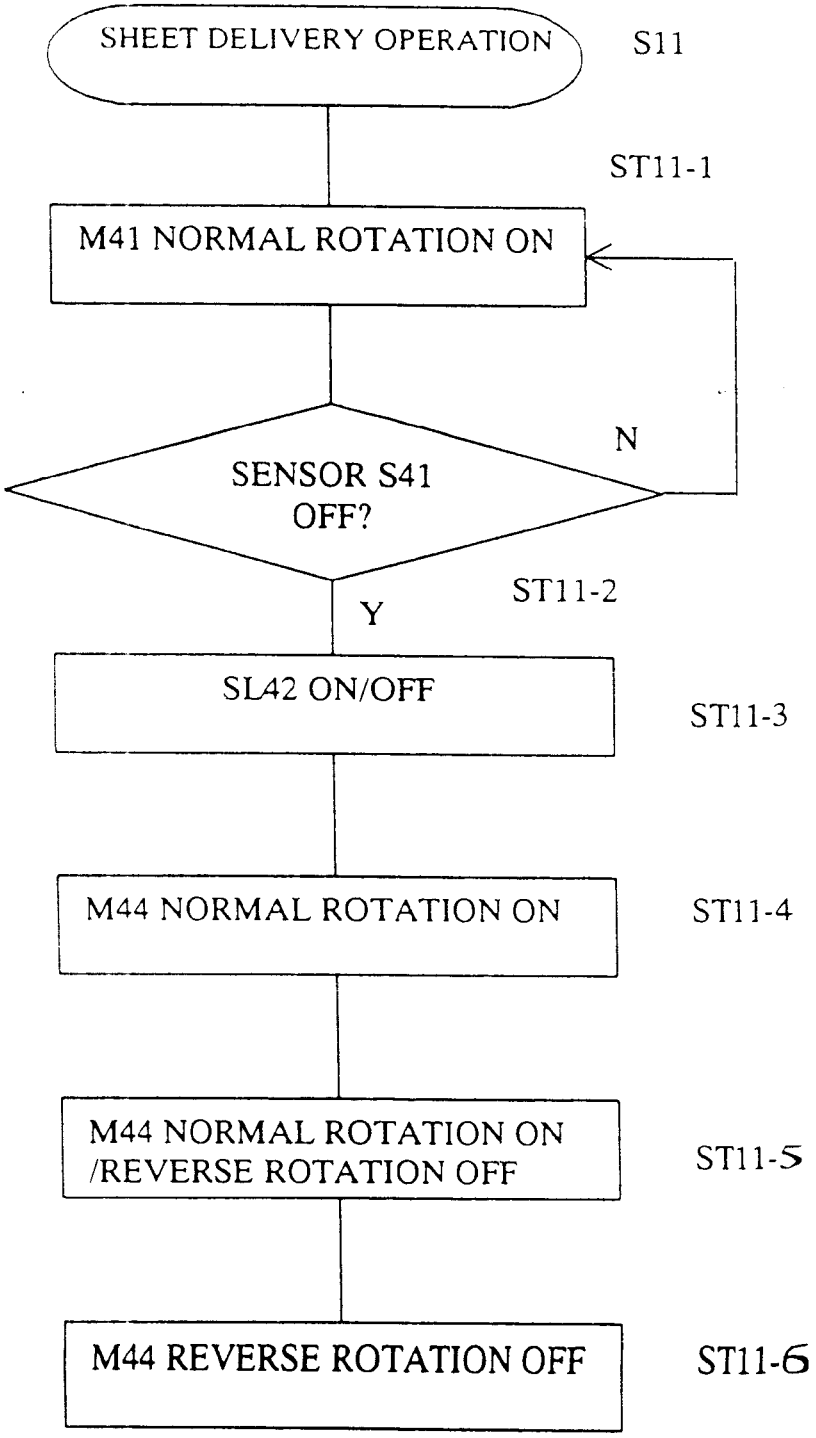
FIG. 60 is an operation flow for sheet delivery operation.
Figure 61:
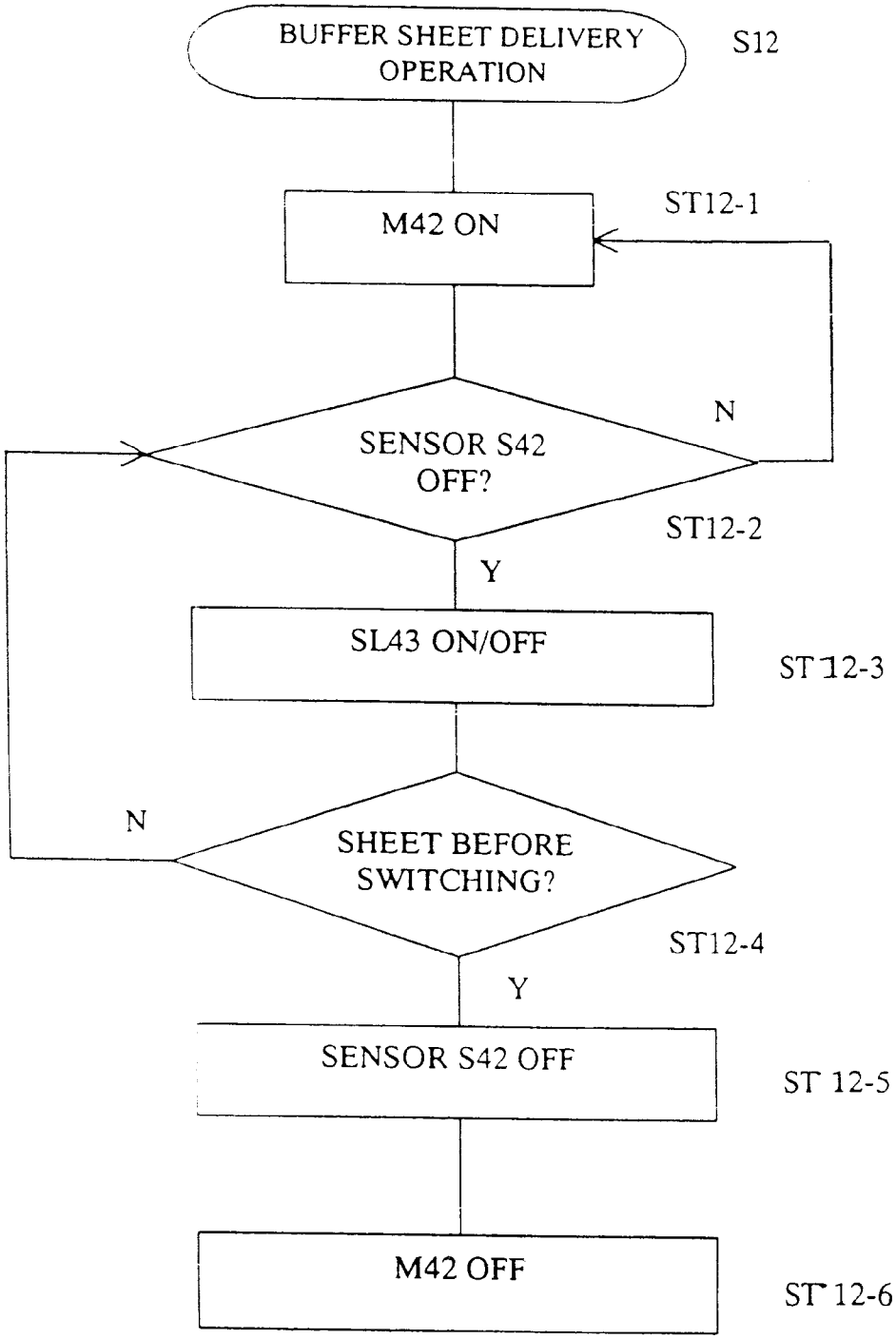
FIG. 61 is an operation flow for buffer sheet delivery operation.

The stapler 4540 is secured to a first bracket 4541 as shown in FIGS. 58, 59, and the first bracket 4541 is reversely pivotable to an up and down direction position (a single dot chain line position in FIG. 42) around a shaft 4542 extending horizontally as a pendulum fixed to a second bracket 4543.

The second bracket 4543 is held pivotable to a horizontal direction position (a single dot chain line position equivalent to portion in FIG. 59) by way of a shaft 4547 extending vertically, with respect to a third bracket 4544 movable along a set of respective guide rails 4548, 4548 in a direction (front to rear direction, up and down direction on a paper surface of FIG. 58, equivalent to a direction perpendicular to a paper surface in FIG. 59) perpendicular to the sheet proceeding direction with respect to the apparatus frame not shown. A fifth drive motor M45 is arranged on the third bracket 4544, which is movable for a prescribed amount by rotating the final stage gear 4545 of the fifth drive motor M45 in meshing with a rack gear 4546 fixed to the apparatus frame.

In the case of the above stapler 4540, set position (a) in FIG. 58 is the home position, and set positions (b), (c) occupy a near position and a far position of the two location stapling with respect to set position (a), and similarly, set position (d) occupies a position during a corner stapling. Here, when it shifts from set position (c) to set position (d), the second bracket 4543 is pivotally moved in a horizontal direction by a prescribed angle by means of a cam means not shown, thereby positionally changing the stapler 4540 on the second bracket 4543 as to be in an oblique position (corresponding to a position for corner stapling) with respect to the recording sheet bundle. When the staple cartridge in the stapler 4540 is replaced or refilled, a user manually rotates the first bracket 4541, or the stapler 4540, in the reverse direction (single dot chain line in FIG. 59) at set position (a) as the home position, thereby bringing the cartridge opening of the stapler 4540 as to face up.

Anvils 4549 for stapling in cooperation with the stapler 4540 are formed at every set position where the stapler stops, or at total three positions, two positions for stapling positions 4549(1), 4549(2) for two stapling locations, and a position for corner stapling position 4549(3), and are individually adjustable for correlative positional shifts. The respective anvil positions corresponding to stapling positions 4549(1), 4549(2) for two locations are designed to be located closer to the stapler 4540 than the anvil position 4549(3) for the corner stapling position, thereby correcting an amount equal to bending occurring when a stay not shown for securing the anvils 4549 produces during stapling.

[Stacking Tray 4500*b*]

This stacking tray 4500*b* operates to move up and down (movable up and down by a sixth drive motor M46 not shown) one by one in following the stacked recording sheet bundle to keep constant the stacked level at a time of delivery, and performs an offset operation (driven by the sixth drive solenoid SL46 not shown) alternatively in a direction perpendicular to a delivery direction to distinguish the respective bundles of the stacked bundles.

[Sensors for Operation Controls]

As sensors for operation controls, the apparatus has a first sensor S41 disposed on a downstream side of the first sheet delivery section I, a second sensor S42 disposed on a downstream side of the second sheet delivery section II, and a third sensor S43 disposed on a downstream side of the shoot bundle delivery section. Each drive motor has a rotation amount detection sensor disposed at each drive motor for detecting the rotation amount of each drive motor.

Now referring to FIG. 60 to FIG. 65, operations of the above apparatus structure are described.

FIGS. 60 to 65 are operation flows charts for describing outlines of operations of the apparatus system in this embodiment.

[Sheet Delivery Operation (Corresponding to Operation Flow Shown in FIG. 60)]

In this sheet delivery operation (S11), the switching flapper 4511 is selectively switched toward the first sheet delivery section I by the first drive solenoid SL41, and the movable delivery roller 4550 is selected as to contact to the main delivery roller 4510. Under this situation, the first drive motor M41 is turned on (ST11-1), and the delivered sheet on which images are formed is introduced from the first sheet delivery section I to the delivery section side on the sheet stacking guide 4517, and the second drive solenoid SL42 is turned on upon detecting the sheet rear end with the first sensor S41 (ST11-2), thereby operating the first sweeping paddle 4514 (ST11-3). At the same time, the alignment plate pair 4531, 4532 are driven to align sheets (ST11-4, 5), and then, the apparatus prepares for the subsequent sheet delivery upon reversely rotating the fourth drive motor M4 (ST11-6).

[Buffer Sheet Delivery Operation (Corresponding to Operation Flow Shown in FIG. 61)]

In this buffer sheet delivery operation (S12), the switching flapper 4511 is selectively switched toward the buffer path section III by the first drive solenoid SL41, and the movable delivery roller 4550 is selected as to contact to the main delivery roller 4510. Under this situation, the second drive motor M42 is turned on (ST12-1), and the delivered sheet on which images are formed is introduced from the buffer path section III to the non-delivery section side on the sheet stacking guide 4517 via the second sheet delivery section II. Upon detection of the sheet rear end with the first sensor S41 (ST12-2), the third drive solenoid SL43 is turned on to operate the second sweeping paddle 4515 (ST12-3), and the front end of the recording sheet is received in hitting the stationary stopper 4524. At that time, if the recording sheet is before switching, the sweeping paddle does not operate, thereby reducing the switching period, and then, the second sensor S42 and the second drive motor M42 are turned off one by one (ST12-5,6).

The respective rotation speeds of the relay roller pair 4512 and the second delivery roller pair 4513 of the buffer path section III, or namely, conveying speeds of the sheets, are designed slightly faster than the rotation speed of the transfer roller pair 4151 in the switch back path 4150, to make wider intervals of the sheets conveyed one by one. A one-way clutch is incorporated in the drive transmission section of the transfer roller pair 4151 and allows the sheet in a midway of conveyance to be easily pulled away while the sheet is nipped by the transfer roller pair 4151 and the relay roller pair 4512.

[Buffer Switching Operation (Corresponding to Operation Flow Shown in FIG. 62)]

In switching operation to this buffer (S13), in accordance with the above sheet delivery operation (ST11), when it is the recording sheet corresponding to the last original document, the first drive solenoid SL41 and the second drive motor M42 are turned on respectively, the buffer sheet delivery operation (ST12) is performed, and at the same time, according to this, a post-processing operation is made at the first sheet delivery section I as follows;

That is, when the stapling mode is selected, the stapler 4540 is moved in advance by drive of the fifth drive motor M45 to the corresponding position. Subsequently, the pushers 4521 holding the recording sheet bundle at the alignment position are driven by the third driven motor M43 to move the sheet bundle to the predetermined stapling position.

With respect to the alignment position of the pushers 4521, they are made different according to the sheet size as to keep constant the rear end of the recording sheets when delivered, but with respect to the stapling position, they are constant notwithstanding the sheet size and can be changed according to the stapling mode. More specifically, because the distance between the staple end surface and sheet end surface is different between in a case of the corner stapling and in a case of the two location stapling, the entry amount of the sheet bundle to the stapler 4540 is made different to equalize the above distances.

After the pushers 4521 are moved, the movable delivery roller 4550 is rocked toward the bundle delivery position by reversing rotation of the first drive motor M41, thereby nipping the recording sheet bundle in contacting to the bundle delivery roller 4556.

The recording sheet bundle is transferred between the pushers 4521 to the bundle delivery section before the recording sheet bundle is stapled, so that the processing time is reduced.

After transfer of the recording sheet bundle, the pushers 4521, instead of the stationary stopper 4524, limit the sheet front ends delivered at the second sheet delivery section II after escaped to the position of the stationary stopper 4524 by means of drive of the third drive motor M43 (ST13-5) to move the recording sheet bundle stacked on the second sheet delivery section II, and it proceeds to the subsequent staple operation (ST14).

On the other hand, the recording sheet bundle delivered at the first sheet delivery section I is delivered as a bundle by rotating the first drive motor M41 in the normal direction (ST13-7, 8), along with stacking tray up and down operation (ST15) where going to bundle delivery operation (ST16) after the staple operation (ST14) after drive (ST13-6) of the fifth drive motor M45 (which is skipped when it is not the staple operation), and after completion of the delivery operation, the motor is reversed again to rock the movable delivery roller 4550 temporarily toward the delivery position. After immediately rotated in the normal direction, the first drive solenoid SL41 is turned off to back the switching flapper 4511 toward the first sheet delivery section I, thereby allowing the sheet to be delivered to the first sheet delivery section I (ST13-9). Furthermore, after completion of delivery through the second sheet delivery section II, the pushers 4521 make the recording sheet bundle in the second sheet delivery section II move to the sheet stacking position at the first sheet delivery section I, and prepares the next sheet bundle delivery operation from the first sheet delivery section I (ST13-10).

[Staple Operation (Corresponding to Operation Flow in FIG. 63)]

During this staple operation (S14), disorder of the sheet bundle due to impacts from stapling is prevented by operation of the alignment plate pair 4531, 4532 (ST14-1), and the alignment plate pair 4531, 4532 is moved to the alignment position during operation of the clinch motor in the stapler 4540, or namely during the staple operation (ST14-2). After this movement, the alignment plate pair 4531, 4532 is moved back (S14-3).

[Up and Down Operation of the Stacking Tray (Corresponding to Operation Flow in FIG. 64)]

During the stacking tray up and down operation (S15), to make the delivery level of the recording sheet bundle constant, the tray level of the stacking tray 4500*b* is moved down for a prescribed amount by the sixth drive motor M46 not shown after bundle delivery completion and is moved up to a position where the paper surface detection sensor S44 not shown is turned on again (ST15-1 to 5). The position of the stacking tray 4500*b* is switched between the home position (ST15-8) and the offset position (ST15-7) depending on whether the next recording sheet bundle is even number bundle or not (ST15-6).

[Description of Bundle Delivery Operation (Corresponding to the Operation Flow in FIG. 65)]

With respect to the bundle delivery operation, as described above, respective operations, bundle delivery (ST16-1) upon turning on of the first drive motor M41 and completion of operation upon turning off of the first drive motor M41 based on a detection result (ST16-2) of the third sensor S43, are performed (ST16-3).

[Respective Operation Flows According to Sheet Size]

(A4 and LTR and the like, in a case of half size sheets)

Figure 62:
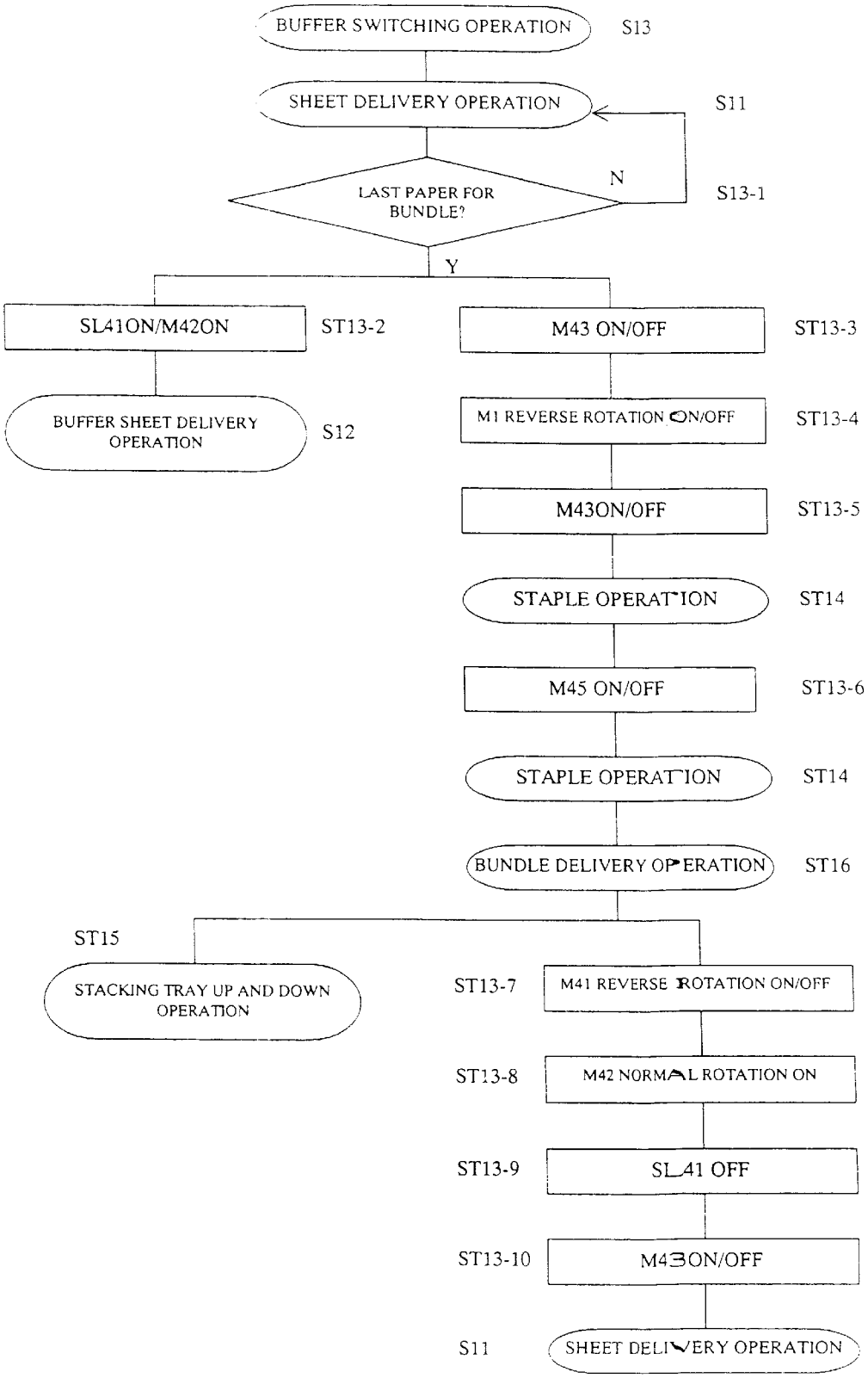
FIG. 62 is an operation flow for buffer switching operation.
Figure 63:
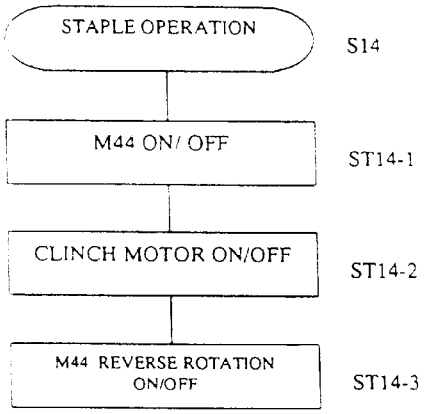
FIG. 63 is an operation flow for staple operation.
Figure 64:
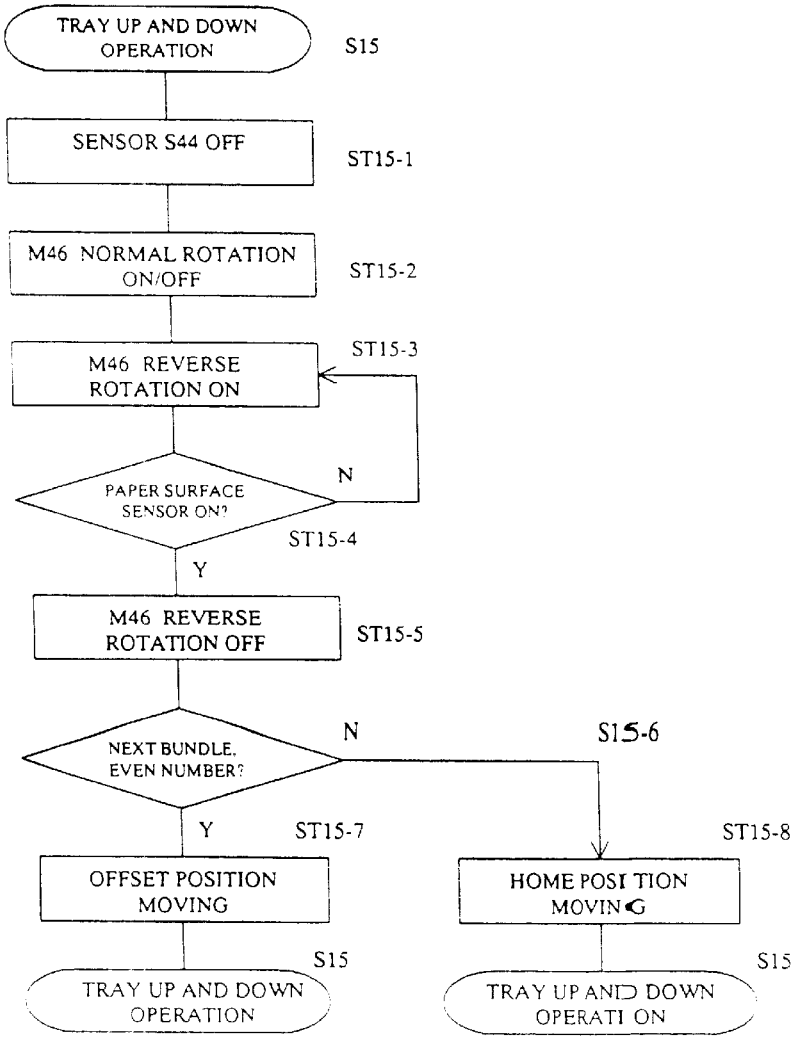
FIG. 64 is an operation flow for stacking tray up and down operation.
Figure 65:
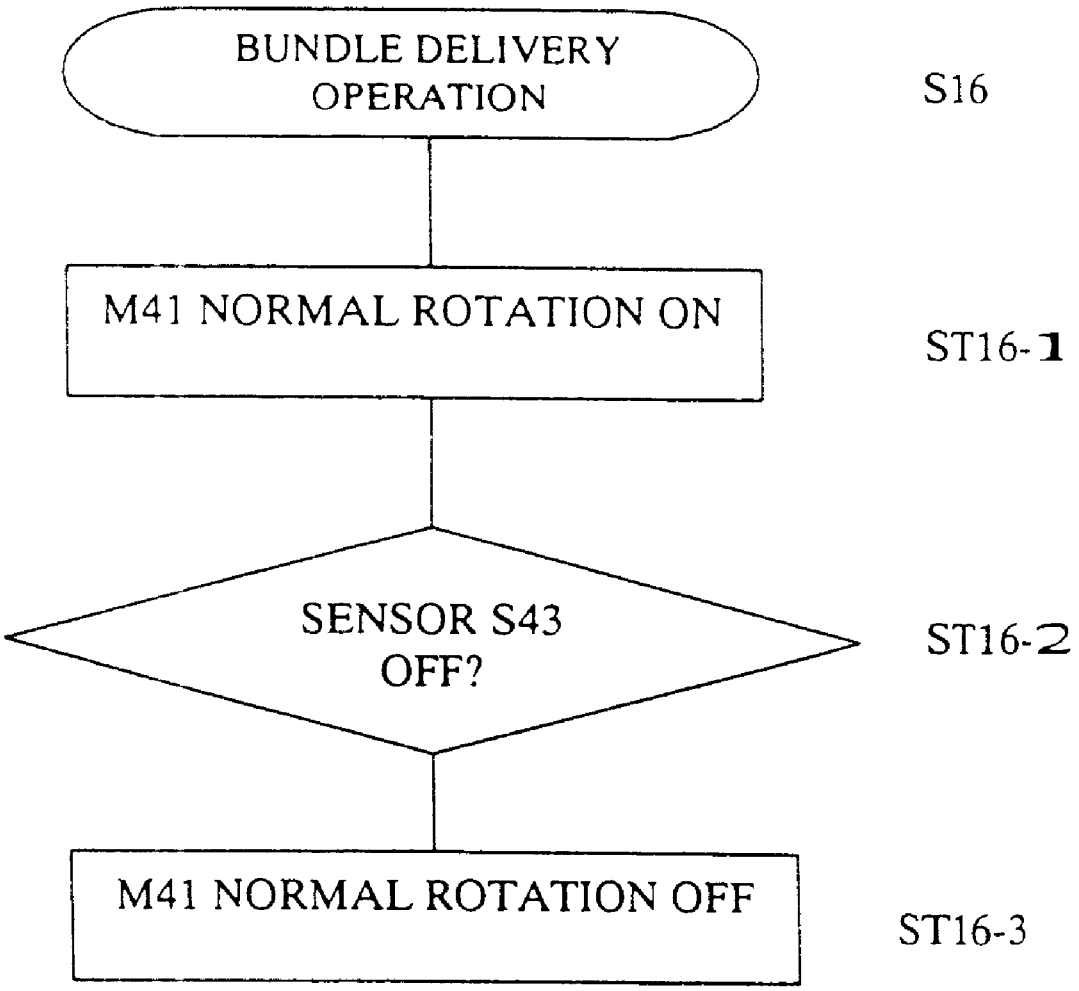
FIG. 65 is an operation flow for bundle delivery operation.

In this embodiment, the above buffer switching operation (ST13) is executed only for half size recording sheets. As the operation flow, as shown in FIG. 62, after completion of delivery to and stacking on the first sheet delivery section I, the apparatus implements the processing operation such as stapling or the like to the recording sheet bundle, and the recording sheet from the image forming section 4111 is temporarily delivered to and stacked on the second sheet delivery section II. After completion of the processing operation and the bundle delivery to the stacking tray 45O0*b*, the recording sheet bundle from the second sheet delivery section II is conveyed as a bundle to the first sheet delivery section I, and the remaining sheets are delivery and stacked at the first sheet delivery section I. The above operations are repeated until delivery of the final sheet, and then jobs ends.

(A3 and LDR and the like, in a case of large size sheet)

After completion of the above sheet delivery operation (S11), an "image formation temporarily stop signal" is outputted from a controller, not shown, in the sheet processing unit 4500 to a controller, not shown, of the image forming apparatus main unit 4100, thereby temporarily stopping the sheet conveyance from the image forming apparatus main unit 4100, and the above staple operation (S14) and bundle delivery operation (S16) are executed for the recording sheet bundle.

After completion of the post-processing operation and the bundle delivery operation to the stacking tray 4500*b*, an "image forming restart signal" is outputted, and the above sheet delivery operation (S11) is executed to deliver and stack the recording sheets on the first delivery section I.

[Respective Operation Flow According to Copying Modes]

(In a case of a single side copying)

The description would be the same as the above respective flows according to the sheet size, and therefore, is omitted.

(In a case of a double side copying)

As described above, with respect to image formation for double sides of a recording sheet in an image forming apparatus main unit 4100, the images are formed on the other side upon that images are formed on the one side by way of the switch back path 4150, and the reverse path 4180, and then, since the recording sheet on both sides of which images are formed is conveyed to the processing tray 4500*a*, the distance between the recording sheets becomes longer. Therefore, because the above buffer switching operation (S13) is not necessary to be executed again (post-processing operation can be done between a forgoing sheet and a following sheet), the sheet size does not matter, and the sheets are delivered by the same operation flow as in a case of the large size sheet, A3 and LDR and the like.

Figure 66:
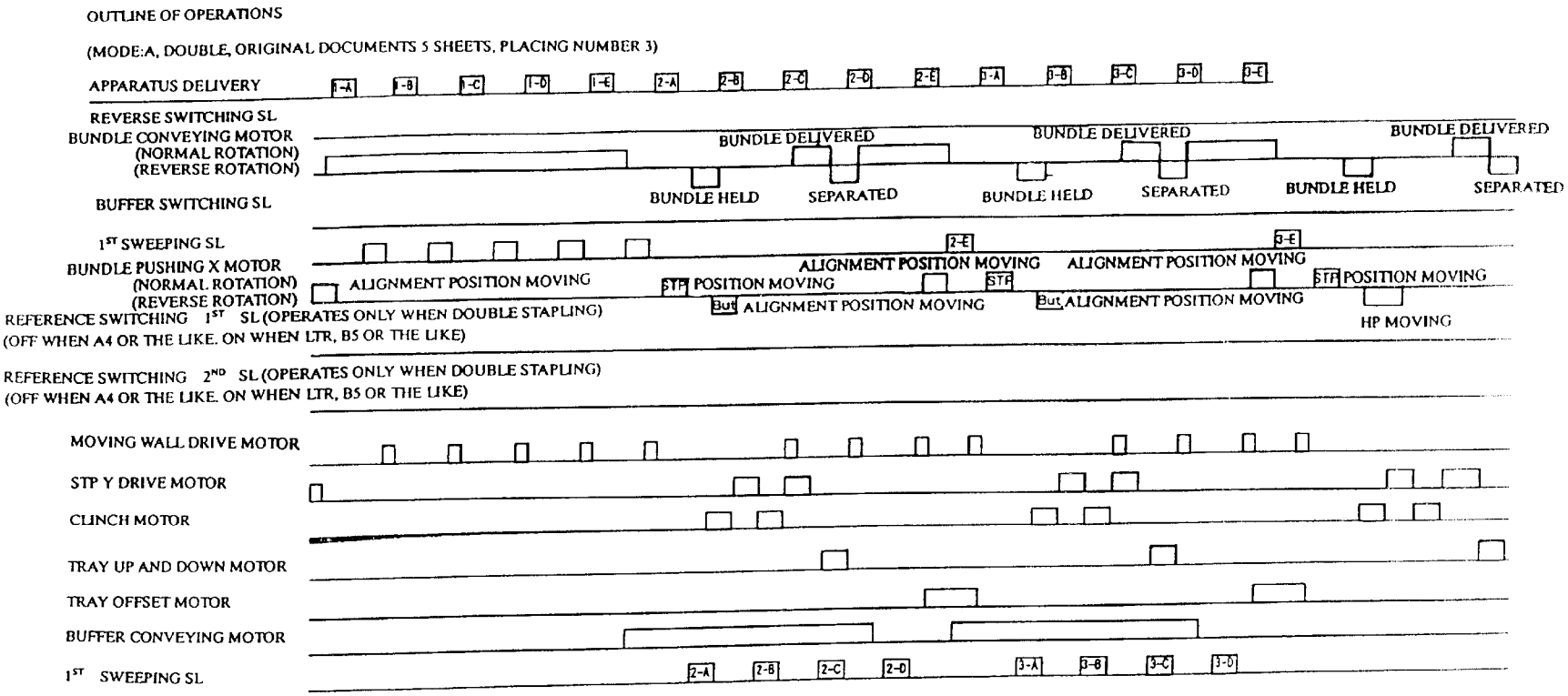
FIG. 66 is a timing chart for describing operation timings of the entire sheet processing system.

FIG. 66 shows an outline of a timing chart where the processing is made under [sheet size: A4, stapling mode: two locations, original document number: five sheets, placing number: 3], as a series of timings for respective above operations.

Ninth Embodiment

The ninth embodiment is also described in comparison with the eighth embodiment.

Figure 67:
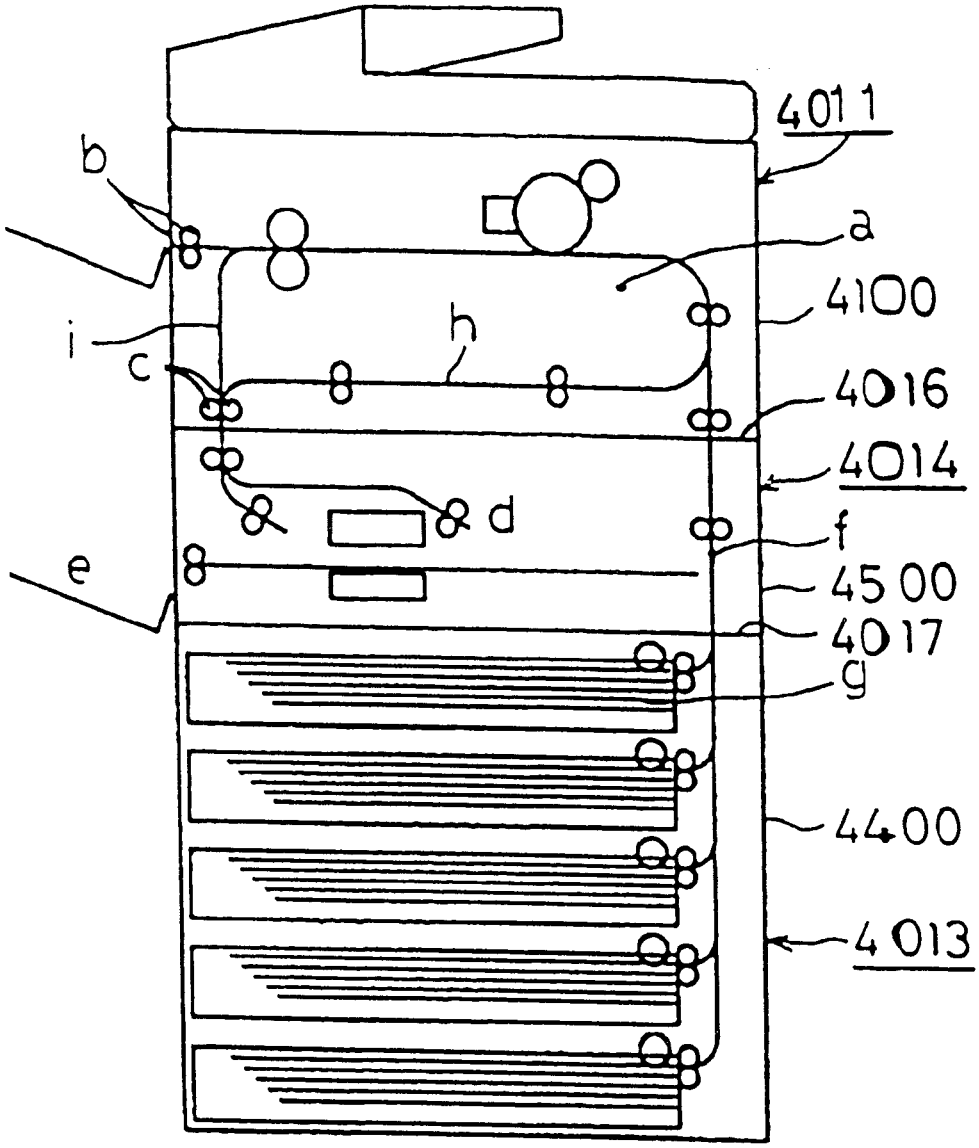
FIG. 67 is an illustration schematically showing an arrangement of the structure of essential portions of the ninth embodiment.
Figure 68:
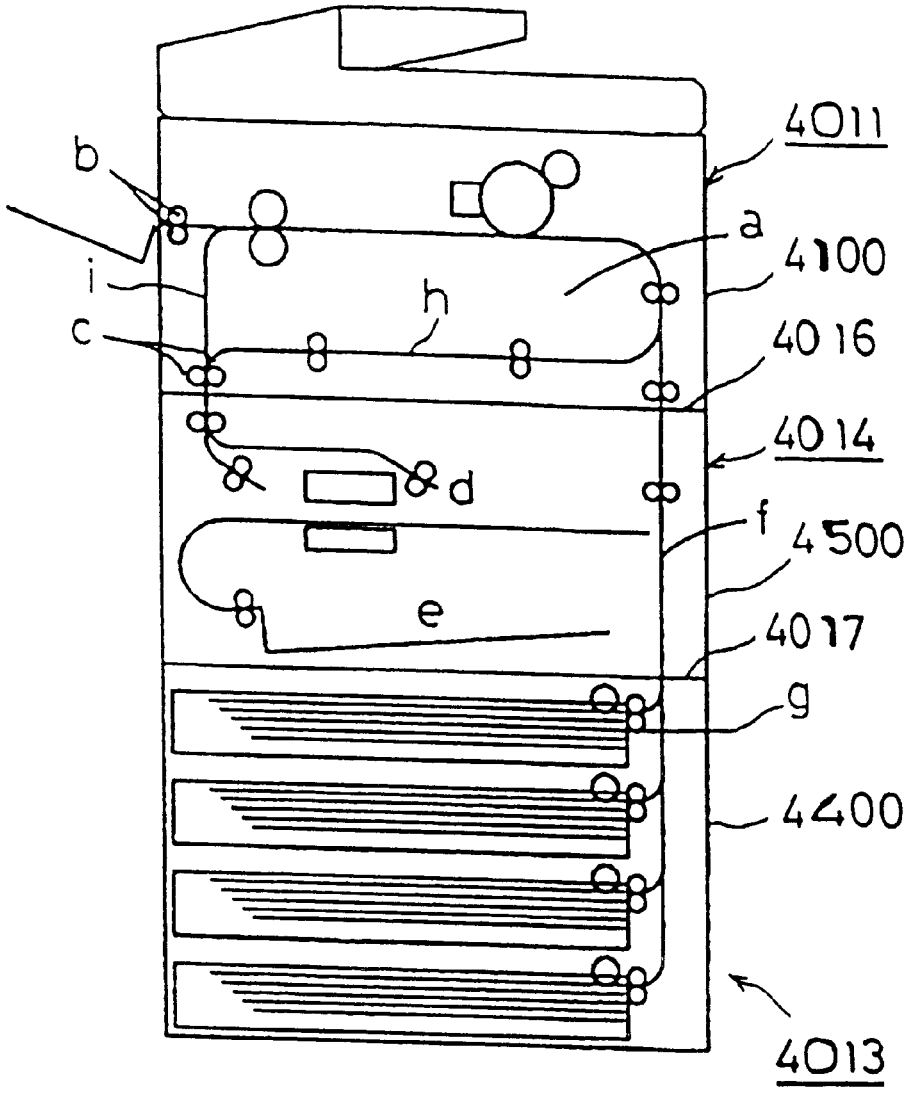
FIG. 68 is an illustration schematically showing an arrangement of the structure of essential portions of the ninth embodiment.

FIG. 67 is an illustration schematically showing an outline of essential structures as for an image forming apparatus according to the embodiment; FIG. 68 is an illustration schematically showing the structure of essential portions of the embodiment. The image forming apparatus according to the eighth embodiment is shown in FIG. 50, and the image forming apparatus corresponds to one claim.

In FIGS. 67, 68, numeral a represents an image forming section (corresponding to the image forming section 4111); numeral b represents a first sheet delivery section (corresponding to the first sheet delivery section I); numeral c represents a second sheet delivery section (corresponding to the second sheet delivery section II); and those essential structural portions are placed within the first apparatus housing 4011. Numeral d represents a sheet post processing section; numeral e represents a bundle sheet delivery tray; numeral f represents a sheet feeding route; and numeral g represents a sheet stacking means; h represents a conveying route for double sides; i represents a sheet feeding path; those essential structural portions are contained in the image forming apparatus main unit 4100 separably connected, the sheet processing unit 4500, and the sheet feeding unit 4400.

Differences between the image forming apparatus according to the ninth embodiment shown in FIG. 67, which corresponds to a claim relating to FIG. 67 and the image forming apparatus according to the eighth embodiment are that the sheet bundle containing section e is provided in the fourth apparatus housing 4014. The image forming apparatus according to the ninth embodiment, as well as the image forming apparatus according to the eighth embodiment, can make the entire apparatus relatively compact, reduce the occupying area at a time of installation, improve productivity of the apparatus and property for maintenance, and so on.

Tenth Embodiment

An image forming apparatus according to the tenth embodiment of the invention is described in comparison with the eighth and ninth embodiments.

Figure 69:
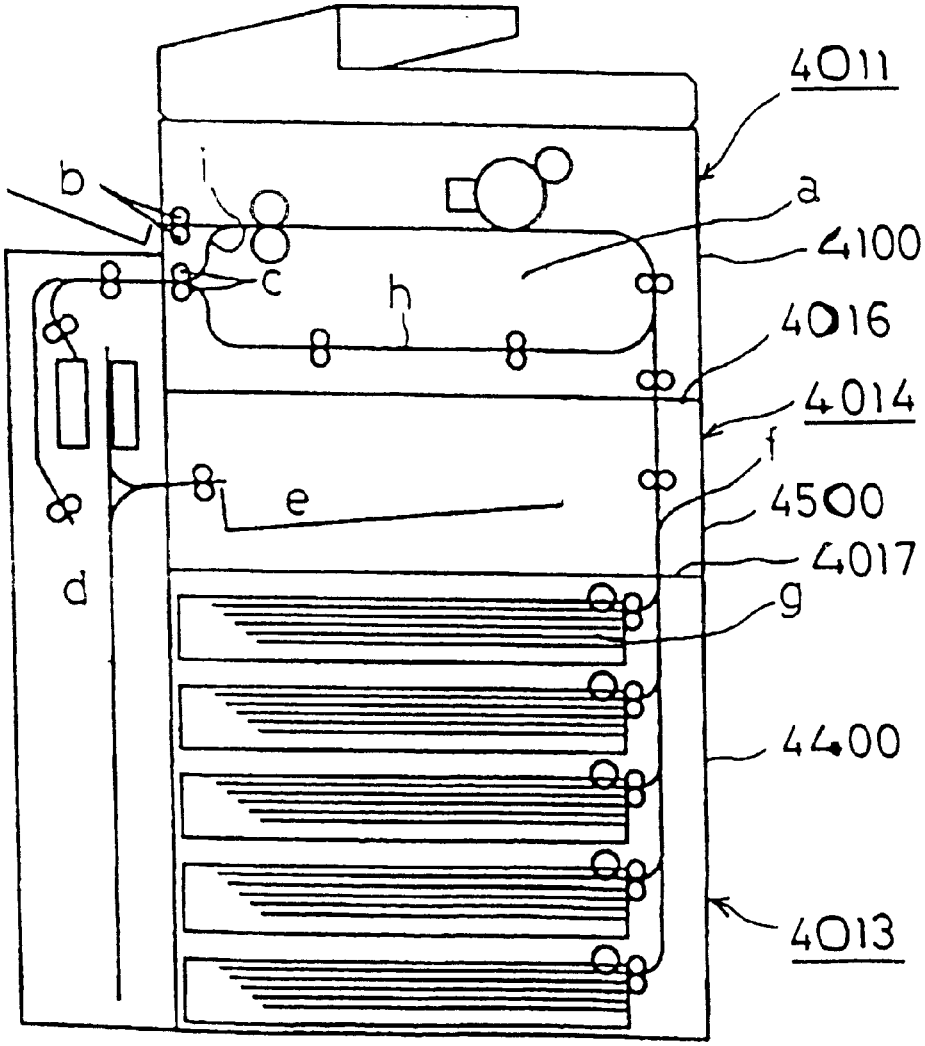
FIG. 69 is an illustration schematically showing an arrangement of the structure of essential portions of the tenth embodiment.

FIG. 69 is an illustration showing schematically an outline of essential structures of the tenth embodiment. Respective reference numbers are the same as in the eighth and ninth embodiments.

Differences between the image forming apparatus of the tenth embodiment and the image forming apparatus of the eighth and ninth embodiments are that the sheet bundle containing section e is provided in the fourth apparatus housing 4014 and that the sheet post processing section d is disposed vertically below the first sheet delivery section d outside the apparatus housings 4011, 4014, 4013. This image forming apparatus of the tenth embodiment also has the same advantages as of the image forming apparatus according to the eighth and ninth embodiments.

Although the above described sheet processing units 50, 4500 and finisher sections 2500, 3500 are described as having respective structures performing sorting, aligning, and stapling of sheets, those sheet processing units and finisher sections not necessarily have a structure performing all of those tasks and can have a structure for doing some task for sheets on which images are formed such as sorting, aligning, or stapling.

What is claimed is:

1. An image forming apparatus having an image forming section for forming images on sheets, comprising:

a sheet processing apparatus disposed to be piled up with a sheet conveying section and the image forming section in a housing of the image forming apparatus for performing aligning and binding of sheets on which images are formed;

wherein the sheet processing apparatus includes:

a processing tray for collecting sheets on which images are formed;

bundle conveying means for conveying a sheet bundle on the processing tray;

a reference member serving as a mounting reference for ends of sheets in a feeding direction of the sheets mounted on the processing tray;

aligning means for aligning the sheets placed on the processing tray in a direction perpendicular to the sheet feeding direction;

binding means for binding the sheets on the processing tray;

an auxiliary tray placed on a downstream side of the processing tray for supporting the ends of the sheets in the feeding direction of the sheets mounted on the processing tray; and auxiliary bundle conveying means for conveying the sheet bundle on the auxiliary tray.

2. An image forming apparatus having an image forming section for forming images on sheets, comprising:

a sheet processing apparatus disposed to be piled up with a sheet conveying section and the image forming section in a housing of the image forming apparatus for performing aligning and binding of sheets on which images are formed;

wherein the sheet processing apparatus includes:

a processing tray for collecting sheets on which images are formed;

bundle conveying means for conveying a sheet bundle on the processing tray;

a reference member serving as a mounting reference for ends of sheets in a feeding direction of the sheets mounted on the processing tray;

aligning means for aligning the sheets placed on the processing tray in a direction perpendicular to the sheet feeding direction;

binding means for binding the sheets on the processing tray;

an auxiliary tray placed on a downstream side of the processing tray for supporting the ends of the sheets in a feeding direction of the sheets mounted on the processing tray; and a rib arranged on the auxiliary tray for reducing a contact area in contact with the sheet and guiding the sheets.

3. An image forming apparatus having an image forming section for forming images on sheets, comprising:

a sheet processing apparatus disposed to be piled up with a sheet conveying section and the image forming section in a housing of the image forming apparatus for performing aligning and binding of sheets on which images are formed;

wherein the sheet processing apparatus includes:

a processing tray for collecting sheets on which images are formed;

bundle conveying means for conveying a sheet bundle on the processing tray;

a reference member serving as a mounting reference for ends of sheets in a feeding direction of the sheets mounted on the processing tray;

aligning means for aligning the sheets placed on the processing tray in a direction perpendicular to the sheet feeding direction; and binding means for binding the sheets on the processing tray, wherein the reference member moves in the sheet feeding direction according to the size of the sheets.

4. The image forming apparatus having an image forming section for forming images on sheets, comprising:

a sheet processing apparatus disposed to be piled up with a sheet conveying section and the image forming section in a housing of the image forming apparatus for performing aligning and binding of sheets on which images are formed;

wherein the sheet processing apparatus includes:

a processing tray for collecting sheets on which images are formed;

bundle conveying means for conveying a sheet bundle on the processing tray;

a reference member serving as a mounting reference for ends of sheets in a feeding direction of the sheets mounted on the processing tray;

aligning means for aligning the sheets placed on the processing tray in a direction perpendicular to the sheet feeding direction;

binding means for binding the sheets on the processing tray; and pushing means for pushing the sheets on the processing tray toward the reference member;

wherein the pushing means is traveling means reciprocally traveling in the feeding direction of the sheets, arranged on the opposite side to the reference member with respect to the processing tray for pushing the sheets or sheet bundle toward the reference member in the feeding direction of the sheets.

5. An image forming apparatus having an image forming section for forming images on sheets, comprising:

a sheet processing apparatus disposed to be piled up with a sheet conveying section and the image forming section in a housing of the image forming apparatus for performing aligning and binding of sheets on which images are formed;

wherein the sheet processing apparatus includes:

a processing tray for collecting sheets on which images are formed;

bundle conveying means for conveying a sheet bundle on the processing tray;

a reference member serving as a mounting reference for ends of sheets in a feeding direction of the sheets mounted on the processing tray;

aligning means for aligning the sheets placed on the processing tray in a direction perpendicular to the sheet feeding direction; and binding means for binding the sheets on the processing tray;

wherein the bundle conveying means is controlled to make conveying speed above the processing tray V1<V2 where a conveying speed of delivery means for delivering, onto the processing tray, sheets on which images are formed is V1, and a conveying speed of the sheet bundle conveyed above the processing tray is V2.

6. A sheet processing apparatus comprising:

an image forming section for forming images on a sheet surface;

a sheet conveying section for conveying sheets on which images are formed at the image forming section;

a first sheet delivery section disposed at an end of a first conveying route branching from the sheet conveying section;

a second sheet delivery section disposed at an end of a second conveying route branching from the sheet conveying section;

a sheet stacking section for stacking the sheets conveyed from the first and second conveying routes;

a sheet bundle containing section arranged at a location other than the sheet stacking section for containing a stacked sheet bundle; and conveying speed regulating means for setting sheet a conveying speed in the second conveying route faster than a sheet conveying speed on an upstream side of the second conveying route and a sheet conveying speed from the sheet conveying section to the first sheet delivery section, during a mode for delivering the sheets from the second sheet delivery section onto the sheet stacking section to stack the sheets thereon until the sheet bundle is completely delivered onto the sheet bundle containing section after the sheets are delivery from the first sheet delivery section onto the sheet stacking section to stack the sheets thereon.

7. A sheet processing apparatus comprising:

an image forming section for forming images on a sheet surface;

a sheet conveying section for conveying sheets on which images are formed at the image forming section;

a first sheet delivery section disposed at an end of a first conveying route branching from the sheet conveying section;

a second sheet delivery section disposed at an end of a second conveying route branching from the sheet conveying section;

a sheet stacking section for stacking the sheets conveyed from the first and second conveying routes;

a sheet bundle containing section for containing a sheet bundle brought and stacked at a location other than the sheet stacking section;

movable stopper means movable along a sheet stacking surface to regulate front ends of the sheets while the sheets from the first and second delivery sections are stacked during a mode for delivering the sheets from the second sheet delivery section onto the sheet stacking section to stack the sheets thereon until the sheet bundle is completely delivered onto the sheet bundle containing section after the sheets are delivered from the first sheet delivery section onto the sheet stacking section to stack the sheets thereon;

stationary stopper means secured to the sheet stacking surface to regulate the front ends of the sheets while the sheets from either of the first and second delivery sections are stacked; and conveying speed regulating means for setting a sheet conveying speed in the second conveying route faster than a sheet conveying speed on an upstream side of the second conveying route and a speed conveying speed from the sheet conveying section to the first sheet delivery section.

8. A sheet processing apparatus comprising:

sheet conveying means for conveying sheets;

first sheet delivery means disposed at an end of a first conveying route branching from the sheet conveying section;

second sheet delivery means disposed at an end of a second conveying route branching from the sheet conveying section;

sheet stacking means for stacking sheets conveyed from the first and second conveying routes;

sheet bundle processing means for processing individually sheet bundles stacked on the sheet stacking means;

sheet bundle aligning means for aligning the sheet bundle stacked on the sheet stacking means;

a plurality of sheet bundle conveying means capable of conveying independently the sheet bundle stacked on the sheet stacking means; and sheet bundle stacking means arranged at a location other than the sheet stacking means for stacking individual sheet bundles conveyed by the sheet bundle conveying means.

9. The sheet processing apparatus according to claim 8, wherein the sheet processing apparatus can selectively switch modes for using only either of the first sheet delivery means or the second sheet delivery means and for using the first sheet delivery means and the second sheet delivery means according to a copying mode set for the sheet processing apparatus.

10. The sheet processing apparatus according to claim 8, wherein the sheet processing apparatus can selectively switch modes for using only either of the first sheet delivery means or the second sheet delivery means and for using the first sheet delivery means and the second sheet delivery means according to a sheet size handled in the sheet processing apparatus.

11. The sheet processing apparatus according to claim 8, wherein the sheet bundle aligning means is disposed at a position where the sheet bundle aligning means operates only for sheets in a stacking region delivered from the first sheet delivery means and does not operate for sheets in a stacking region delivered from the second sheet delivery means.

12. The sheet processing apparatus according to claim 8, wherein the sheet bundle processing means is disposed corresponding to a location within a region for stacking sheets from the first sheet delivery means, outside a region for stacking sheets from the second sheet delivery means, between the first sheet delivery means and the sheet bundle stacking means.

13. The sheet processing apparatus according to claim 8, wherein the sheet processing apparatus has a mode for delivering the sheets from the second sheet delivery section onto the sheet stacking section to stack the sheets thereon until the sheet bundle is completely delivered onto the sheet bundle containing section after the sheets are delivered from the first sheet delivery section onto the sheet stacking section to stack the sheets thereon.

14. An image forming apparatus comprising:

an image forming apparatus main unit having an image forming section for forming images on supplied recording sheets;

a sheet processing unit detachably attached below the image forming apparatus main unit, having a sheet processing section for post-processing recording sheets on which images are formed by the image forming section;

a sheet feeding unit detachably attached below the sheet processing unit, having recording sheet stacking means for stacking image recording sheets to be fed to the image forming apparatus main unit; and a sheet feeding route arranged at the sheet processing unit for guiding the recording sheets from the sheet feeding unit to the image forming apparatus main unit.

15. The image forming apparatus according to claim 14, further comprising a second sheet feeding unit, detachably attached between the image forming apparatus main unit and the sheet processing unit, for feeding sheets to the image forming apparatus main unit and having recording sheet stacking means for stacking recording sheets.

16. The image forming apparatus according to claim 15, wherein the second sheet feeding unit includes a sheet conveying route for guiding, from the image forming apparatus main unit to the sheet processing unit, the recording sheets on which images are formed.

17. The image forming apparatus according to claim 14, 15, or 16, wherein the image forming apparatus main unit includes a delivery tray, placed outside the image forming apparatus main unit, for receiving the recording sheets on which images are formed.

18. The image forming apparatus according to claim 14, wherein the image forming apparatus man unit includes a double side conveying route for conveying recording sheets on both sides which images are to be formed, and wherein a part of the double side conveying route is commonly used as a sheet conveying route for guiding, from the image forming apparatus main unit to the sheet processing unit, the sheets on which images are formed.

19. The image forming apparatus according to claim 14, wherein a processing section of the sheet processing unit is disposed below the image forming apparatus main unit.

20. The image forming apparatus according to claims 14, 15, 16, 18, or 19, wherein a processing section of the sheet processing unit is aligning means for aligning the recording sheets on which images are formed.

21. The image forming apparatus according to claims 14, 15 16, 18, or 19, wherein a processing section of the sheet processing unit is sheet binding means for binding the recording sheet on which images are formed.

22. The image forming apparatus according to claim 21, wherein the sheet binding means is provided at the sheet feeding route.

23. The image forming apparatus according to claim 21, wherein the sheet processing unit includes a sheet bundle delivery tray for receiving the bound recording sheets.

24. The image forming apparatus according to claim 23, wherein the sheet bundle delivery tray is disposed below the image forming apparatus main unit.

25. The image forming apparatus according to claim 24, wherein the sheet bundle delivery tray is disposed within the sheet processing unit.

26. The image forming apparatus according to claim 23, wherein the processing section of the sheet processing unit and the sheet bundle delivery tray are disposed below the image forming apparatus main unit.

27. The image forming apparatus according to claim 23, wherein the sheet bundle delivery tray is disposed outside the sheet processing unit on a side of the sheet binding means.

28. The image forming apparatus according to claim 14 or 15, wherein the recording sheet stacking means has a plurality of stacking stages.

29. An image forming and sheet processing apparatus comprising:

an image forming section for forming images on the sheet surface;

a sheet conveying section for conveying sheets on which images are formed at the image forming section;

image transfer means for transferring images on a sheet surface;

fixing means for fixing the transferred images; and a sheet processor including:

a first sheet delivery section disposed at an end of a first conveying route branching from the sheet conveying section;

a second sheet delivery section disposed at an end of a second conveying route branching from the sheet conveying section;

a sheet stacking section for stacking the sheets conveyed from the first and second conveying routes;

a sheet bundle containing section arranged at a location other than the sheet stacking section for containing a stacked sheet bundle; and conveying speed regulating means for setting a sheet conveying speed in the second conveying route faster than a sheet conveying speed on an upstream side of the first conveying route and a sheet conveying speed from the sheet conveying section to the first sheet delivery section, during a mode for delivering the sheets from the second sheet delivery section onto the sheet stacking section to stack the sheets thereon until the sheet bundle is completely delivered onto the sheet bundle containing section after the sheets are delivered from the first sheet delivery section onto the sheet stacking section to stack the sheets thereon.

30. An image forming and sheet processing apparatus comprising:

an image forming section for forming images on the sheet surface;

a sheet conveying section for conveying sheets on which images are formed at the image forming section;

image transfer means for transferring images on a sheet surface;

fixing means for fixing the transferred images; and a sheet processor including:

a first sheet delivery section disposed at an end of a first conveying route branching from the sheet conveying section;

a second sheet delivery section disposed at an end of a second conveying route branching from the sheet conveying section;

a sheet stacking section for stacking the sheets conveyed from the first and second conveying routes;

a sheet bundle containing section for containing a sheet bundle brought and stacked at a location other than the sheet stacking section;

movable stopper means movable along a sheet stacking surface to regulate front ends of the sheets while the sheets from the first and second delivery sections are stacked during a mode for delivering the sheets from the second sheet delivery section onto the sheet stacking section to stack the sheets thereon until the sheet bundle is completely delivered onto the sheet bundle containing section after the sheets are delivered from the first sheet delivery section onto the sheet stacking section to stack the sheets thereon;

stationary stopper means secured to the sheet stacking surface to regulate the front ends of the sheets while the sheets from either of the first and second delivery sections are stacked; and conveying speed regulating means for setting a sheet conveying speed in the second conveying route faster than a sheet conveying speed on an upstream side of the first conveying route and sheet conveying speed from the sheet conveying section to the first sheet delivery section.

31. An image forming and sheet processing apparatus comprising:

image transfer means for transferring images on a sheet surface;

fixing means for fixing the transferred images; and a sheet processor including:

sheet conveying means for conveying the sheets;

first sheet delivery means disposed at an end of a first conveying route branching from the sheet conveying section;

second sheet delivery means disposed at an end of a second conveying route branching from the sheet conveying section;

sheet stacking means for stacking sheets conveyed from the first and second conveying routes;

sheet bundle processing means for processing individually sheet bundles stacked on the sheet stacking means;

sheet bundle aligning means for aligning the sheet bundle stacked on the sheet stacking means;

a plurality of sheet bundle conveying means capable of conveying independently the sheet bundle stacked on the sheet stacking means; and sheet bundle stacking means arranged at a location other than the sheet stacking means for stacking individual sheet bundles conveyed by the sheet bundle conveying means.

32. An image forming and sheet processing apparatus according to claim 31, wherein the sheet processing apparatus selectively switches modes for using only either of the first sheet delivery means or the second sheet delivery means and for using the first sheet delivery means and the second sheet delivery means according to a copying mode set for the sheet processing apparatus.

33. An image forming and sheet processing apparatus according to claim 31, wherein the sheet processing apparatus selectively switches modes for using only either of the first sheet delivery means or the second sheet delivery means for using the fist sheet delivery means and the second sheet delivery means according to a sheet size handled in the sheet processing apparatus.

34. An image forming and sheet processing apparatus according to claim 31, wherein the sheet bundle aligning means is disposed at a position where the sheet bundle aligning means operates only for sheets in a stacking region delivered from the first sheet delivery means and does not operate for sheets in a stacking region delivered from the second sheet delivery means.

35. An image forming and sheet processing apparatus according to claim 31, wherein the sheet bundle processing means is disposed corresponding to a location within a region for stacking sheets from the first sheet delivery means, outside a region for stacking sheets from the second sheet delivery means, between the first sheet delivery means and the sheet bundle stacking means.

36. An image forming and sheet processing apparatus according to claim 31, wherein the sheet processing apparatus has a mode for delivering the sheets from the second sheet delivery section onto the sheet bundle is completely delivered onto the sheet bundle stacking section after the sheets are delivered from the first sheet delivery section onto the sheet stacking section to stack the sheets thereon.

37. An image forming apparatus having an image forming section for forming images on sheets, comprising:

sheet processing apparatus in combination with a sheet conveying section and the image forming section disposed in a housing of the image forming apparatus for performing aligning and binding sheets on which images are formed;

wherein the sheet processing apparatus includes:

a processing tray for collecting sheets on which images are formed;

bundle conveying means for conveying a sheet bundle on the processing tray;

a reference member serving as a mounting reference for ends of sheets in a feeding direction of the sheets mounted on the processing tray;

aligning means for aligning the sheets placed on the processing tray in a direction perpendicular to the sheet feeding direction;

binding means for binding the sheets on the processing tray;

an auxiliary tray placed on a downstream side of the processing tray for supporting the ends of the sheets in a feeding direction of the sheets mounted on the processing tray; and a rib arranged on the auxiliary tray for reducing a contact area in contact with the sheets and guiding the sheets, wherein the image forming apparatus is capable of forming images multiply on a sheet or forming images on double sides of a sheet, and the sheet processing apparatus is placed substantially below the conveying section for carrying sheets on which the images are formed back to the image forming section.

38. An image forming apparatus having an image forming section for forming images on sheets, comprising:

a sheet processing apparatus in combination with a sheet conveying section and the image forming section disposed in a housing of the image forming apparatus for performing aligning and binding sheets on which images are formed;

wherein the sheet processing apparatus includes:

a processing tray for collecting once sheets on which images are formed;

bundle conveying means for conveying a sheet bundle on the processing tray;

a reference member serving as a mounting reference for ends of sheets in a feeding direction of the sheets mounted on the processing tray;

aligning means for aligning the sheets placed on the processing tray in a direction perpendicular to the sheet feeding direction; and binding means for binding the sheets on the processing tray, wherein the reference member moves in the sheet feeding direction according to the size of the sheets, and wherein the image forming apparatus is capable of forming images multiply on a sheet or forming images on double sides of a sheet, and the sheet processing apparatus is placed substantially below the conveying section for carrying sheets on which the images are formed back to the image forming section.

39. An image forming apparatus having an image forming section for forming images on sheets, comprising:

a sheet processing apparatus in combination with a sheet conveying section and the image forming section disposed in a housing of the image forming apparatus for performing, aligning, binding sheets on which images are formed;

wherein the sheet processing apparatus includes:

a processing tray for collecting sheets on which images are formed;

bundle conveying means for conveying a sheet bundle on the processing tray;

a reference member serving as a mounting reference for ends of sheets in a feeding direction of the sheets mounted on the processing tray;

aligning means for aligning the sheets placed on the processing tray in a direction perpendicular to the sheet feeding direction; and binding means for binding the sheets on the processing tray;

pushing means for pushing the sheets on the processing tray toward the reference member;

wherein the pushing means is traveling means reciprocally traveling in the feeding direction of the sheets, arranged on the opposite side to the reference member with respect to the processing tray for pushing the sheets or sheet bundle toward the reference member in the feeding direction of the sheets, and wherein the image forming apparatus is capable of forming images multiply on a sheet or forming images on double sides of a sheet, and the sheet processing apparatus is placed substantially below the conveying section for carrying sheets on which the images are formed to the image forming section again.

40. An image forming apparatus having an image forming section for forming images on sheets, comprising:

a sheet processing apparatus in combination with a sheet conveying section and the image forming section disposed in a housing of the image forming apparatus for performing aligning and binding of sheets on which images are formed;

wherein the sheet processing apparatus includes:

a processing tray for collecting sheets on which images are formed;

bundle conveying means for conveying a sheet bundle on the processing tray;

a reference member serving as a mounting reference for ends of sheets in a feeding direction of the sheets mounted on the processing tray;

aligning means for aligning the sheets placed on the processing tray in a direction perpendicular to the sheet feeding direction; and binding means for binding the sheets on the processing tray;

wherein the bundle conveying means is controlled to make conveying speed above the processing tray $V1<V2$ where a conveying speed of delivery means for delivering, onto the processing tray, sheets on which images are formed is $V1$, and a conveying speed of a sheet bundle conveyed above the processing tray is $V2$, and wherein the image forming apparatus is capable of forming images multiply on a sheet or forming images on double sides of a sheet, and the sheet processing apparatus is placed substantially below the conveying section for carrying sheets on which the images are formed to the image forming section again.

41. An image forming apparatus having an image forming section for forming images on sheets, comprising:

a sheet processing apparatus in combination with a sheet conveying section and the image forming section disposed in a housing of the image forming apparatus for performing aligning and binding of sheets on which images are formed;

wherein the sheet processing apparatus includes:

a processing tray for collecting sheets on which images are formed;

bundle conveying means for conveying a sheet bundle on the processing tray;

a reference member serving as a mounting reference for ends of sheets in a feeding direction of the sheets mounted on the processing tray;

aligning means for aligning the sheets placed on the processing tray in a direction perpendicular to the sheet feeding direction;

binding means for binding the sheets on the processing tray;

an auxiliary tray placed on a downstream side of the processing tray for supporting the ends of the sheets in the feeding direction of the sheets mounted on the processing tray; and auxiliary bundle conveying means for conveying the sheet bundle on the auxiliary tray;

wherein the image forming apparatus is capable of forming images multiply on a sheet or forming images on double sides of a sheet, and the sheet processing apparatus is placed substantially below the conveying section for carrying sheets on which the images are formed to the image forming section again.

42. An image forming apparatus having an image forming section for forming images on sheets, comprising a sheet processing apparatus in combination with a sheet feeding section and the image forming section disposed in a housing of the image forming apparatus for performing aligning and binding of sheets on which images are formed, the sheet processing apparatus is positioned substantially below the image forming section and above the sheet feeding section, wherein the sheet processing apparatus includes:

a processing tray for collecting sheets on which images are formed;

a transport means for conveying the sheets to the processing tray;

binding means for binding the sheets on the processing tray; and bundle conveying means for conveying a sheet bundle on the processing tray in a direction opposed to the transport direction to a tray.

43. An image forming apparatus according to claim 42, wherein each of the sheet processing apparatus, the sheet feeding section, and the image forming section are constructed as a unit.

44. An image forming apparatus according to claim 43, wherein the sheet processing apparatus includes a sheet conveyance path for connecting the sheet feeding section and the image forming section.

45. An image forming apparatus according to claim 42, wherein the tray is disposed outside the housing of the image forming apparatus.

46. An image forming apparatus according to claim 42, wherein the tray is disposed inside the housing of the image forming apparatus and under the processing tray.

47. An image forming apparatus having an image forming section for forming images on sheets, comprising a sheet processing apparatus in combination with a sheet feeding section and the image forming section incorporated disposed in a housing of the image forming apparatus for performing aligning and binding of sheets on which image are formed, the image forming apparatus being capable of forming multiple images on a sheet or forming images on both sides of a sheet, wherein the sheet processing apparatus is positioned substantially below a sheet conveying section for carrying sheets on which images are formed back to the image forming section, and above the sheet feeding section, wherein the sheet processing apparatus includes;

a processing tray for collecting sheets on which images are formed;

a transport means for conveying the sheets to the processing tray;

binding means for binding the sheets on the processing tray; and bundle conveying means for conveying a sheet bundle on the processing tray in a direction to a tray.

48. An image forming apparatus having an image forming section for forming images on sheets, comprising a sheet processing apparatus in combination with a sheet feeding section and the image forming section incorporated disposed in a housing of the image forming apparatus for performing aligning and binding of sheets on which image are formed, the image forming apparatus is capable of forming multiple images on a sheet or forming images on both sides of a sheet, and the sheet processing apparatus is placed substantially below a sheet conveying section for carrying sheets on which images are formed back to the image forming section, and above the sheet feeding section, wherein the sheet processing apparatus includes;

processing tray for collecting sheets on which images are formed;

a transport means for conveying the sheets to the processing tray;

binding means for binding the sheets on the processing tray; and bundle conveying means for conveying a sheet bundle on the processing tray in a direction opposed to a transport direction to a tray.

49. An image forming apparatus comprising:

image forming apparatus main portion having an image forming means for forming images on supplied recording sheets;

a sheet feeding portion disposed below the image forming apparatus main portion having recording sheet stacking means for stacking image recording sheets to be fed to the image forming apparatus main portion;

a sheet processing portion disposed in a vertical direction beside a frame of the image forming apparatus, the sheet processing portion having a sheet processing means for post-processing recording sheets on which images are formed by the image forming means; and a sheet bundle tray disposed inside the image forming apparatus and disposed below the image forming apparatus main portion, wherein an inlet of the sheet processing portion faces an outlet of the image forming apparatus main portion and the tray is disposed between the image forming apparatus main portion and the sheet feeding portion.

50. An image forming apparatus according to claim 49, wherein each of the image forming apparatus main portion, the sheet feeding portion and the sheet processing portion are constructed as a unit.

51. An image forming apparatus comprising:

an image forming apparatus main portion having an image forming means for forming images on supplied recording sheets;

a sheet feeding portion disposed below the image forming apparatus main portion having recording sheet stacking means for stacking image recording sheets to be fed to the image forming apparatus main portion;

a sheet processing portion disposed in vertical direction beside a frame of the image forming apparatus, the sheet processing portion having a sheet processing means for post-processing recording sheets on which images are formed by the image forming means; and a sheet bundle tray disposed inside the image forming apparatus and disposed below the image forming apparatus main portion;

wherein the sheet processing portion has a carrying conveyance path disposed in vertical direction and the sheet processing means binds a bundle of the sheets which are carried in the vertical direction and piled in the vertical direction.

52. An image forming apparatus according to claim 51, wherein the image forming apparatus main portion has a sheet refeeding conveyance path and the sheet bundle tray is disposed between the sheet refeeding conveyance pass and the sheet feeding portion.

* * * * *

UNITED STATES PATENT AND TRADEMARK OFFICE

CERTIFICATE OF CORRECTION

PATENT NO. : 6,374,077 B1
DATED : April 16, 2002
INVENTOR(S) : Katsuaki Hirai et al.

It is certified that error appears in the above-identified patent and that said Letters Patent is hereby corrected as shown below:

Column 2,
Line 1, “once” should be deleted.

Column 3,
Line 18, “the” should read -- to the --.

Column 4,
Line 39, “Those” should read -- This --.

Column 7,
Line 35, “leng” should read -- lens --.

Column 8,
Line 17, “the” should be deleted.

Column 9,
Line 45, “make” should read -- makes --.

Column 10,
Line 14, “disturbing” should read -- disturb --.

Column 11,
Line 21, “can” should read -- cam --.

Column 12,
Line 26, “prescribe” should read -- prescribed --; and
Line 43, “very” should read -- much --.

Column 13,
Line 30, “very” should read -- much --.

Column 14,
Line 13, “serving as” should read -- serving --.

Column 16,
Line 7, “engages” should read -- engaged --;
Line 32, “substantial” should read -- substantially --; and
Line 52, “very” should read -- much --.

UNITED STATES PATENT AND TRADEMARK OFFICE

CERTIFICATE OF CORRECTION

PATENT NO. : 6,374,077 B1
DATED : April 16, 2002
INVENTOR(S) : Katsuaki Hirai et al.

It is certified that error appears in the above-identified patent and that said Letters Patent is hereby corrected as shown below:

Column 17,
Line 18, “a reference member” should read -- reference members may be --.

Column 19,
Line 42, “that” should read -- that have been --.

Column 20,
Line 9, “Pelectively” should read -- selectively --; and
Line 29, “made cutoff” should read -- cut off --.

Column 22,
Line 2, “produces” should read -- protrudes --; and
Line 24, “flows” should read -- flow --.

Column 23,
Line 30, “between” should be deleted;
Line 42, “tho” should read -- the --; and
Line 53, “rotated” should read -- rotating --.

Column 24,
Line 26, “delivery” should read -- delivered --;
Line 29, “jobs” should read -- the job --; and
Line 33, “Controller,” should read -- controller, --.

Column 25,
Line 53, “2400a” should read -- 3500a --.

Column 26,
Line 48, “already” should read -- have already been --.

Column 28,
Line 34, “to” should read -- to *d* --; and
Line 51, “shift” should read -- shifts --; and “get” should read -- set --.

Column 29,
Line 7, “produces” should read -- protrudes --; and
Line 29, “flows” should read -- flow --.

UNITED STATES PATENT AND TRADEMARK OFFICE

CERTIFICATE OF CORRECTION

PATENT NO. : 6,374,077 B1
DATED : April 16, 2002
INVENTOR(S) : Katsuaki Hirai et al.

It is certified that error appears in the above-identified patent and that said Letters Patent is hereby corrected as shown below:

Column 30,
Line 21, “2540” should read -- 3540 --;
Line 25, “driven” should read -- drive --;
Line 34, “between” should be deleted;
Line 48, “escaped” should read -- having escaped --;
Line 57, “rotated” should read -- rotating --;
Line 63, “makes” should read -- make --; and
Line 66, “prepares” should read -- prepares for --.

Column 31,
Line 31, “delivery” should read -- delivered --; and
Line 34, “jobs” should read -- the job --.

Column 32,
Line 24, “after” should read -- after being --;
Line 57, “introduced” should read -- is introduced --;
Line 58, “is” should read -- and is --; and
Line 59, “stacked” should read -- being stacked --.

Column 34,
Line 61, “necton” should read -- section --.

Column 35,
Line 14, “already” should read -- have already been --.

Column 36,
Line 2, “made cutoff” should read -- cut off --.

Column 37,
Line 3, “to” should read -- to *d* --;
Line 43, “produces” should read -- is extended --; and
Line 65, “flows” should read -- flow --.

Column 39,
Line 6, “between” should be deleted;
Line 22, “escaped” should read -- having escaped --; and
Line 37, “rotated” should read -- rotating --.

UNITED STATES PATENT AND TRADEMARK OFFICE

CERTIFICATE OF CORRECTION

PATENT NO. : 6,374,077 B1
DATED : April 16, 2002
INVENTOR(S) : Katsuaki Hirai et al.

It is certified that error appears in the above-identified patent and that said Letters Patent is hereby corrected as shown below:

Column 40,
Line 23, “45O0b,” should read -- 4500b, --;
Line 24, “delivery” should read -- delivered --; and
Line 27, “jobs” should read -- the job --.

Column 41,
Line 50, “not” should read -- do not --.

Column 44,
Line 12, “sheet a” should read -- a sheet --;
Line 21, “delivery” should read -- delivered --; and
Line 59, “a speed” should read -- a sheet --.

Column 46,
Line 17, “man” should read -- main --; and
Line 19, “which” should read -- of which --.

Column 47,
Line 65, “sheet” should read -- a sheet --.

Column 48,
Line 38, “fist” should read -- first --; and
Lines 57 through 59, “has a mode for delivering the sheets from the second sheet delivery section onto the sheet bundle is completely delivered” should read -- has a mode for delivering the sheets from the second sheet delivery section onto the sheet stacking section to stack the sheets thereon until the sheet bundle is completely delivered --.

Column 49,
Line 34, “sheets” should read -- of sheets --;
Line 37, “once” should be deleted; and
Line 64, “performing, aligning, binding” should read -- performing aligning and binding of --.

Column 51,
Line 66, “image” should read -- images --.

UNITED STATES PATENT AND TRADEMARK OFFICE

CERTIFICATE OF CORRECTION

PATENT NO. : 6,374,077 B1 
DATED : April 16, 2002
INVENTOR(S) : Katsuaki Hirai et al.

It is certified that error appears in the above-identified patent and that said Letters Patent is hereby corrected as shown below:

Column 52,
Line 21, “image” should read -- images --; and
Line 29, “processing” should read -- a processing --.

Signed and Sealed this

Eleventh Day of March, 2003

JAMES E. ROGAN
*Director of the United States Patent and Trademark Office*